US011841163B2

(12) United States Patent
Sugawara et al.

(10) Patent No.: US 11,841,163 B2
(45) Date of Patent: Dec. 12, 2023

(54) SILENCING SYSTEM

(71) Applicant: FUJIFILM Corporation, Tokyo (JP)

(72) Inventors: Yoshihiro Sugawara, Ashigara-kami-gun (JP); Shogo Yamazoe, Ashigara-kami-gun (JP); Shinya Hakuta, Ashigara-kami-gun (JP); Akihiko Ohtsu, Ashigara-kami-gun (JP); Kazuhiro Oki, Ashigara-kami-gun (JP)

(73) Assignee: FUJIFILM Corporation, Tokyo (JP)

( * ) Notice: Subject to any disclaimer, the term of this patent is extended or adjusted under 35 U.S.C. 154(b) by 386 days.

(21) Appl. No.: 17/174,435

(22) Filed: Feb. 12, 2021

(65) Prior Publication Data

US 2021/0164690 A1 Jun. 3, 2021

Related U.S. Application Data

(63) Continuation of application No. PCT/JP2019/027713, filed on Jul. 12, 2019.

(30) Foreign Application Priority Data

Aug. 14, 2018 (JP) ..... 2018-152737

(51) Int. Cl.
*F24F 13/24* (2006.01)
*E04B 1/82* (2006.01)
(Continued)

(52) U.S. Cl.
CPC ..... *F24F 13/24* (2013.01); *E04B 1/8209* (2013.01); *G10K 11/162* (2013.01); *G10K 11/172* (2013.01)

(58) Field of Classification Search
CPC ..... F24F 13/24; E04B 1/8209; G10K 11/162; G10K 11/172
See application file for complete search history.

(56) References Cited

U.S. PATENT DOCUMENTS 6,023,938 A * 2/2000 Taras ..... F24F 13/082 454/206
2016/0195299 A1* 7/2016 Lind ..... F24F 13/24 181/224

(Continued)

FOREIGN PATENT DOCUMENTS

JP 2007-169959 A 7/2007
JP 4820163 B2 11/2011

(Continued)

OTHER PUBLICATIONS

Japanese Office Action for Japanese Application No. 2020-537387, dated Jul. 26, 2022, with English translation.

(Continued)

*Primary Examiner* — Forrest M Phillips
(74) *Attorney, Agent, or Firm* — Birch, Stewart, Kolasch & Birch, LLP

(57) ABSTRACT

An object is to provide a silencing system that can achieve both high ventilation performance and high soundproof performance, can silence a plurality of pieces of resonant sound, and has high general-purpose properties since the silencing system does not need to be designed according to a tubular member. The silencing system includes one or more silencers that are disposed in a tubular member provided to penetrate a wall separating two spaces, and satisfies "0<Re[Bn]<1" and "Im[Bn]>0" in a case where a standardized effective modulus of elasticity in an interior space of the tubular member in which the silencers are disposed is denoted by Bn.

19 Claims, 30 Drawing Sheets

(51) Int. Cl.
*G10K 11/162* (2006.01)
*G10K 11/172* (2006.01)

(56) References Cited

U.S. PATENT DOCUMENTS

| | | | | |
|---|---|---|---|---|
| 2017/0074525 | A1* | 3/2017 | Sato | F24F 1/0022 |
| 2018/0313551 | A1* | 11/2018 | Moon | F24F 1/0047 |
| 2020/0124320 | A1 | 4/2020 | Sugawara et al. | |
| 2021/0012762 | A1* | 1/2021 | Ohtsu | G10K 11/161 |
| 2021/0233506 | A1* | 7/2021 | Ohtsu | G10K 11/161 |
| 2023/0093579 | A1* | 3/2023 | Hettwer | E04B 9/005 181/284 |

FOREIGN PATENT DOCUMENTS

| | | | |
|---|---|---|---|
| JP | 2014-52539 | A | 3/2014 |
| JP | 2016-95070 | A | 5/2016 |
| WO | WO 2019/009338 | A1 | 1/2019 |

OTHER PUBLICATIONS

International Preliminary Report on Patentability and Written Opinion of the International Searching Authority (Forms PCT/IB/326, PCT/IB/373 and PCT/ISA/237) for corresponding International Application No. PCT/JP2019/027713, dated Feb. 25, 2021, with English translation.

International Search Report (Form PCT/ISA/210) for corresponding International Application No. PCT/JP2019/027713, dated Sep. 17, 2019, with English translation.

Japanese Notice of Reasons for Refusal for corresponding Japanese Application No. 2020-537387, dated Feb. 1, 2022, with an English translation.

Extended European Search Report dated Sep. 6, 2021 for corresponding Application No. 19850492.0.

* cited by examiner

SILENCING SYSTEM

CROSS-REFERENCE TO RELATED APPLICATIONS

This application is a Continuation of PCT International Application No. PCT/JP2019/027713 filed on Jul. 12, 2019, which claims priority under 35 U.S.C. § 119(a) to Japanese Patent Application No. 2018-152737 filed on Aug. 14, 2018. Each of the above applications is hereby expressly incorporated by reference, in its entirety, into the present application.

BACKGROUND OF THE INVENTION

1. Field of the Invention

The present invention relates to a silencing system.

2. Description of the Related Art

With regard to tubular members, such as a ventilation port and an air-conditioning duct, which are provided in a wall separating the interior and the exterior and penetrate the interior and the exterior, sound-absorbing materials, such as urethane and polyethylene, are installed in the tubular members to suppress the transmission of noise from the exterior to the interior or to suppress the transmission of noise from the interior to the exterior.

However, since an absorption coefficient for sound having a low frequency of 800 Hz or less is extremely reduced in a case where sound-absorbing materials, such as urethane and polyethylene, are used, a volume needs to be increased to increase the absorption coefficient. However, since the ventilation performance of the ventilation port, the air-conditioning duct, and the like needs to be ensured, there is a limit to the size of the sound-absorbing material. For this reason, there is a problem that it is difficult to achieve both high ventilation performance and high soundproof performance.

Here, the resonant sound of the tubular members may be critical as the noise of the tubular members, such as the ventilation port and the air-conditioning duct. Particularly, resonant sound having the lowest frequency is critical. In a case where the frequency of the resonant sound is 800 Hz or less, the amount of the sound-absorbing material is significantly increased to perform soundproofing using the sound-absorbing material. For this reason, it is generally difficult to output sufficient soundproof performance despite the sacrifice of ventilation. As an example of a commercially available product, the opening ratio of a soundproof sleeve (SK-BO75 manufactured by Shinkyowa Co., Ltd.) made of polyethylene, which is a sound-absorbing material type soundproof product to be inserted into a ventilation sleeve for a house, is 36%, so that the amount of ventilation air is significantly reduced. However, 80% or more of resonant sound is transmitted through the soundproof sleeve.

A resonance type silencer, which silences sound having a specific frequency, is used to silence the resonant sound of such a tubular member.

For example, JP4820163B (JP2007-169959A) discloses ventilation hole structure where a ventilation sleeve for ventilation between a first space and a second space is provided so as to penetrate a partition part partitioning the first space and the second space, a resonance type silencing mechanism for silencing sound passing through the ventilation sleeve is provided in the ventilation sleeve, and the resonance type silencing mechanism is formed on the outer peripheral portion of the ventilation sleeve at a position outside the partition part in the direction of an axis of the ventilation sleeve and at a position between the partition part and a decorative plate that is provided so as to be spaced from the surface of the partition part along the partition part. Further, a side-branch type silencer and a Helmholtz resonator are disclosed as the resonance type silencing mechanism.

Further, JP2016-095070A discloses a silencing tubular body which is used in a state where the silencing tubular body is installed in a sleeve tube of a natural ventilation port. At least one end portion of the silencing tubular body is closed and an opening portion is provided near the other end portion thereof, the length of the silencing tubular body from one end portion to the center of the opening portion is about the half of the total length of the sleeve tube, and a porous material is disposed in the silencing tubular body.

Furthermore, JP2016-095070A discloses that the thickness of the outer wall of a house, a mansion, or the like is in the range of about 200 to 400 mm and sound-insulation performance is lowered in a frequency band of a first resonant frequency (400 to 700 Hz) generated in the sleeve tube provided in the outer wall (see FIG. 15).

SUMMARY OF THE INVENTION

However, according to the inventors' examination, since the resonance type silencer needs to have a length of ¼ of at least the wavelength at a resonant frequency in a case where the resonance type silencer is used to silence sound having the lowest resonant frequency of the tubular member, the size of the silencer is increased. For this reason, there is a problem that it is difficult to achieve both high ventilation performance and high soundproof performance.

Further, the resonance type silencer is to selectively silence sound having a specific frequency (frequency band). In a case where the length, the shape, or the like of the tubular member is changed, the resonant frequency of the tubular member is also changed. For this reason, since the resonance type silencer needs to be designed according to the tubular member, there is a problem that the resonance type silencer has low general-purpose properties.

Furthermore, the resonance of the tubular member occurs at a plurality of frequencies, but the resonance type silencer silences sound having a specific frequency. For this reason, since resonant sound, which is an object to be silenced, is sound having only one frequency and the frequency band of sound to be silenced by the resonance type silencer is narrow, there is a problem that the resonance type silencer cannot silence resonant sound having other frequencies.

Further, it is effective that the resonance type silencer is disposed in an open space. However, in a case where the resonance type silencer is disposed in a resonance body, such as a tubular member, with the equal resonant frequency, the resonance of the tubular member and the resonance of the silencer interact with each other. Accordingly, original resonant transmission sound caused by the tubular member is separated into two frequencies, so that new resonant transmission sound is generated. For this reason, there is a problem that an effect as a silencer is less.

An object of the invention is to solve the problems in the related art and to provide a silencing system that can achieve both high ventilation performance and high soundproof performance, can silence a plurality of pieces of resonant sound, and has high general-purpose properties since the silencing system does not need to be designed according to a tubular member.

In order to achieve the object, the invention has the following configuration.

[1] A silencing system comprising:

one or more silencers that are disposed in a tubular member provided to penetrate a wall separating two spaces, in which "0<Re[Bn]<1" and "Im[Bn]>0" are satisfied in a case where a standardized effective modulus of elasticity in an interior space of the tubular member in which the silencers are disposed is denoted by Bn, and the standardized effective modulus Bn of elasticity is an average value in an octave band in which a first resonant frequency of the tubular member is present.

[2] The silencing system according to [1], in which the silencer does not have a structure resonating at the first resonant frequency of the tubular member.

[3] The silencing system according to [1] or [2], in which the tubular member is a ventilation sleeve, and the silencer is disposed at an end portion of the ventilation sleeve between the wall and a decorative plate that is disposed so as to be spaced from the wall.

[4] The silencing system according to any one of [1] to [3], in which the silencer includes a conversion mechanism for converting sound energy into thermal energy.

[5] The silencing system according to [4], in which the conversion mechanism is a porous sound-absorbing material.

[6] The silencing system according to any one of [1] to [5], in which a cross-sectional area at a position where the silencer is disposed is larger than a cross-sectional area of the tubular member alone in a cross section perpendicular to a central axis of the tubular member.

[7] The silencing system according to any one of [1] to [6], in which the silencer includes a cavity portion that communicates with the interior space of the tubular member, and a total volume of the interior space of the tubular member and the cavity portion of the silencer is larger than a volume of an interior space of the tubular member alone.

[8] The silencing system according to [7], in which a total volume of the interior space of the tubular member is 18000 $cm^3$ or less.

[9] The silencing system according to any one of [1] to [8], in which a shortest distance between one space side and the other space side in the ventilation sleeve in which the silencer is disposed is 1.9 times or less a thickness of the wall.

[10] The silencing system according to any one of [1] to [9], in which a cross section of the tubular member parallel to the wall is 900 $cm^2$ or less.

[11] The silencing system according to any one of [1] to [10], in which at least a part of a ventilation flue, which is a space capable of being ventilated in the ventilation sleeve in which the silencer is disposed, is positioned on a straight line in a plane direction of a cross section perpendicular to a central axis of the ventilation sleeve.

According to the invention, it is possible to provide a silencing system that can achieve both high ventilation performance and high soundproof performance, can silence a plurality of pieces of resonant sound, and has high general-purpose properties since the silencing system does not need to be designed according to a tubular member.

DESCRIPTION OF THE PREFERRED EMBODIMENTS

The invention will be described in detail below.

The descriptions of components to be made below will be based on a representative embodiment of the invention, but the invention is not limited to the embodiment.

Further, in this specification, a numerical range described using "to" means a range that includes numerical values written in the front and rear of "to" as a lower limit and an upper limit.

Furthermore, in this specification, "orthogonal" and "parallel" include the range of an error to be allowed in a technical field to which the invention pertains. For example, "orthogonal" and "parallel" mean that an angle is in a range including an error smaller than ±10° from exact orthogonal or exact parallel, and an error from exact orthogonal or exact parallel is preferably 5° or less and more preferably 3° or less.

In this specification, "the same" and "equal" include the range of an error to be generally allowed in a technical field. Further, in this specification, "the entire", "all", "the entire surface", or the like includes the range of an error to be generally allowed in a technical field, and include the case of 99% or more, 95% or more, or 90% or more in addition to the case of 100%.

[Silencing System]

The configuration of a silencing system according to an embodiment of the invention will be described with reference to the drawings.

A silencing system according to an aspect of the invention comprises one or more silencers that are disposed in a tubular member provided to penetrate a wall separating two spaces, and "0<Re[Bn]<1" and "Im[Bn]>0" are satisfied in a case where a standardized effective modulus of elasticity in an interior space of the tubular member in which the silencers are disposed is denoted by Bn, and the standardized effective modulus Bn of elasticity is an average value in an octave band in which a first resonant frequency of the tubular member is present.

Further, a certain frequency-octave band is the band of a frequency that has the width of one octave including the frequency. It is preferable that Equation (1) is satisfied in an octave band including the frequency as a center frequency. The center frequency of an octave band is not the median of a frequency band and is a frequency that satisfies "upper limit frequency=center frequency×√2" and "lower limit frequency=center frequency/√2".

Figure 1:
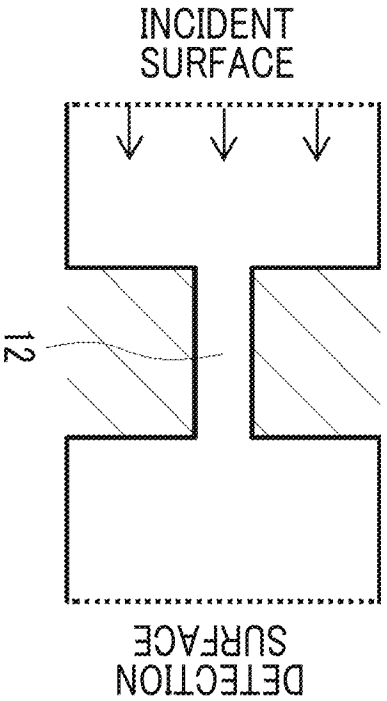
FIG. 1 is a diagram conceptually showing a calculation model that is used to describe a standardized effective modulus of elasticity.
Figure 2:
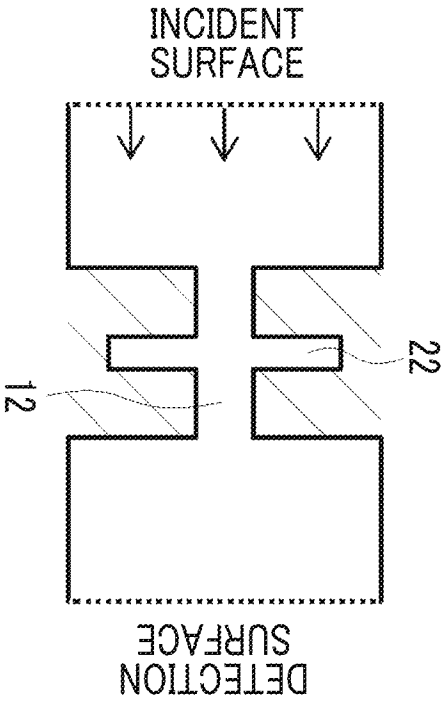
FIG. 2 is a diagram conceptually showing a calculation model that is used to describe a standardized effective modulus of elasticity.
Figure 3:
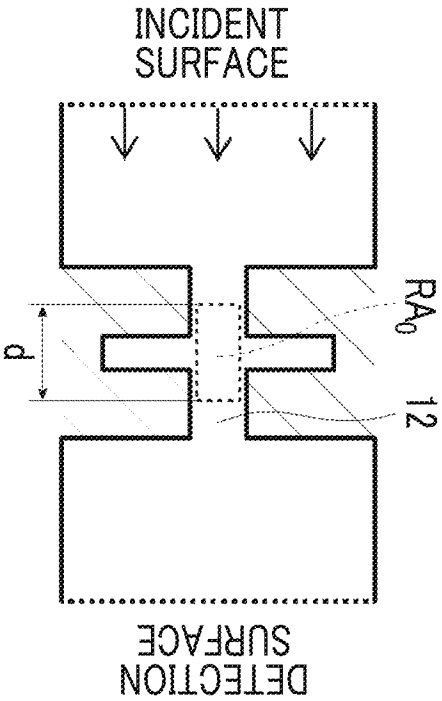
FIG. 3 is a conceptual diagram illustrating a standardized effective modulus of elasticity.

In the invention, an effective modulus of elasticity is the effective modulus of elasticity of air in the interior space of a tubular member that is provided to penetrate a wall separating two spaces. In a case where the tubular member is disposed alone as shown in FIG. 1 (in a case where a silencer is not installed), a modulus of elasticity in the interior space of the tubular member is the modulus of elasticity of air. In contrast, for example, in a case where silencers are disposed in the tubular member in parallel as shown in FIG. 2, a state synonymous with a state where the modulus of elasticity of air in a region $RA_0$ in the interior space of the tubular member is changed is made as shown in FIG. 3. The actually effective modulus of elasticity of air in the interior space of the tubular member, which has been changed in this way in a case where the silencers are disposed, is referred to as an effective modulus of elasticity.

Figure 67:
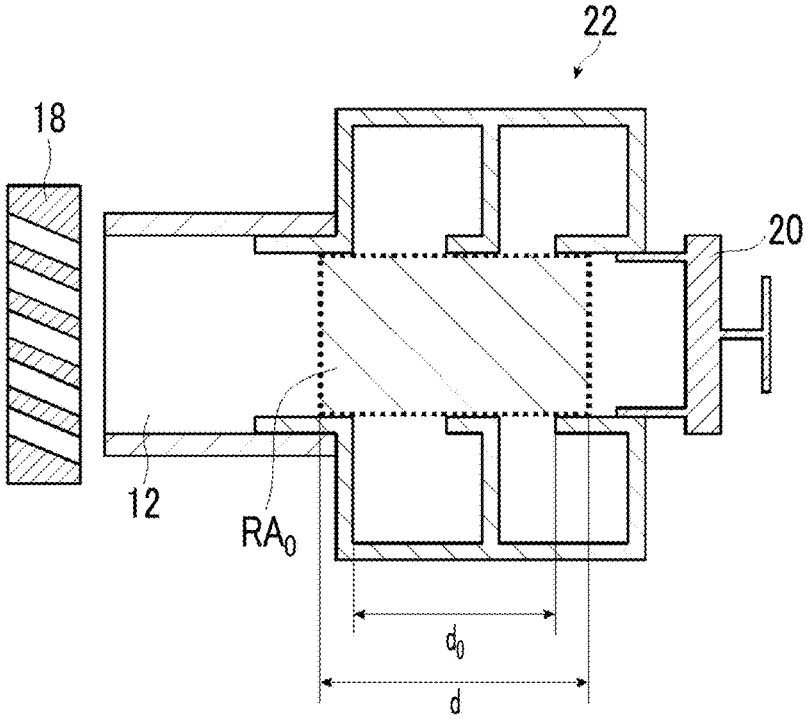
FIG. 67 is a diagram illustrating a region having an effective modulus of elasticity.

The width d of the region $RA_0$ is set to a length of 1/15 of a wavelength at the center frequency of an octave band in which the first resonant frequency of the tubular member is present. For example, the width d of the region $RA_0$ is 91 mm in a case where the center frequency of the octave band in which the first resonant frequency of the tubular member is present is 250 Hz, and the width d of the region $RA_0$ is 45 mm in a case where the center frequency of the octave band in which the first resonant frequency of the tubular member is present is 500 Hz. In a case where the width d of the region $RA_0$ is equal to or smaller than a length of 1/15 of a wavelength at the center frequency of the octave band where the first resonant frequency of the tubular member is present, the actually effective modulus of elasticity of air can be uniquely defined for an acoustic wave that is propagated in the tubular member. The reason for that is that the indeterminacy of 2π, which occurs since an inverse trigonometric function is used in a case where an actually effective modulus of elasticity is calculated, can be avoided. Further, with regard to the position of the region $RA_0$ in an axial direction, the center position of the region $RA_0$ in the axial direction is set as the center position of the opening portion of the silencer in the axial direction. In a case where a plurality of silencers are provided and a plurality of opening portions are provided as in Example 1 (see FIG. 67) to be described later, the center position of a width do of a region including all the opening portions is set as the center position of the region $RA_0$.

First, the range of the real part of a standardized effective modulus of elasticity will be described.

A case where a silencer is not disposed in a tubular member 12 shown in FIG. 1 formed of a straight tube will be considered. The phase velocity $v_0$ of an acoustic wave in the air present in the interior space of the tubular member 12 is represented by Equation (1) in a case where the modulus of elasticity of air in the interior space of the tubular member 12 is denoted by Bair and the density of the air is denoted by ρ.

$$v0=\sqrt{(Bair/\rho)} \quad \text{Equation (1)}$$

Here, an effective modulus Beff of elasticity in the interior space of the tubular member 12 is changed in, for example, a case where a resonance body having a resonant frequency is disposed in the tubular member in parallel. "Disposed in parallel" corresponds to a case where a silencer is disposed not to close the interior space of the tubular member as in a case where a silencer 22 is disposed at the outer peripheral portion of the tubular member 12 as shown in FIG. 2.

The effective modulus Beff of elasticity in this case is represented by Equation (2) in a case where the angular frequency of an acoustic wave propagated in the tubular member is denoted by ω, the resonant angular frequency of the resonance body is denoted by $\omega_i$, and the damping component of the resonance body is denoted by Γ.

$$Beff^{-1}=Bair^{-1}\times\{1-\omega_i^2/(\omega_2-\omega_i^2+i\times\omega\times\Gamma)\} \quad \text{Equation (2)}$$

Here, i denotes the order of each resonance mode of the resonance body. In a case where a standardized effective modulus of elasticity standardized by the modulus Bair of elasticity of air is denoted by Bn, the real part Re[Bn] of a standardized effective modulus of elasticity is Re[Beff/Bair]. Accordingly, in a case where a relationship between the real part Re[Bn] of a standardized effective modulus of elasticity and the angular frequency ω of an acoustic wave is represented from Equation (2) as a graph, the graph is shown as in FIG. 4.

In a case where the effective modulus Beff of elasticity is changed as described above, the velocity v of an acoustic wave propagated in the tubular member can be changed from Equation (1) as follows.

$$v=\sqrt{(Beff/\rho)}$$

In a case where the velocity of an acoustic wave propagated in the tubular member is changed, wave propagation characteristics, such as reflection and transmission, can be manipulated.

Figure 4:
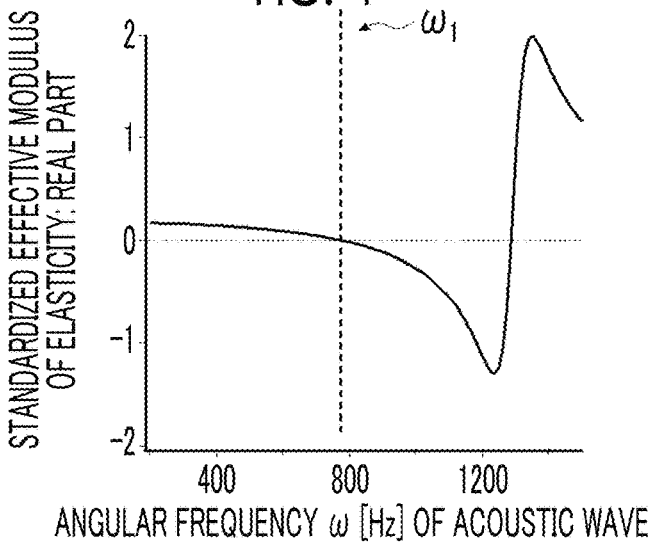
FIG. 4 is a graph showing a relationship between an angular frequency and the real part of a standardized effective modulus of elasticity.

Further, the resonance of the resonance body occurs in a case where the angular frequency ω of an acoustic wave coincides with the resonant angular frequency $\omega_i$ of the resonance body. In this case, the real part Re[Bn] of a standardized effective modulus of elasticity is 0 as shown in FIG. 4.

A standardized effective modulus of elasticity, which is obtained in a case where an air column resonance body is disposed in the tubular member in parallel, is calculated by a transfer matrix method. A graph in which the dependence of a standardized effective modulus of elasticity on the frequency of an acoustic wave and the length of an air column resonance tube is calculated is shown in FIG. 5.

Figure 5:
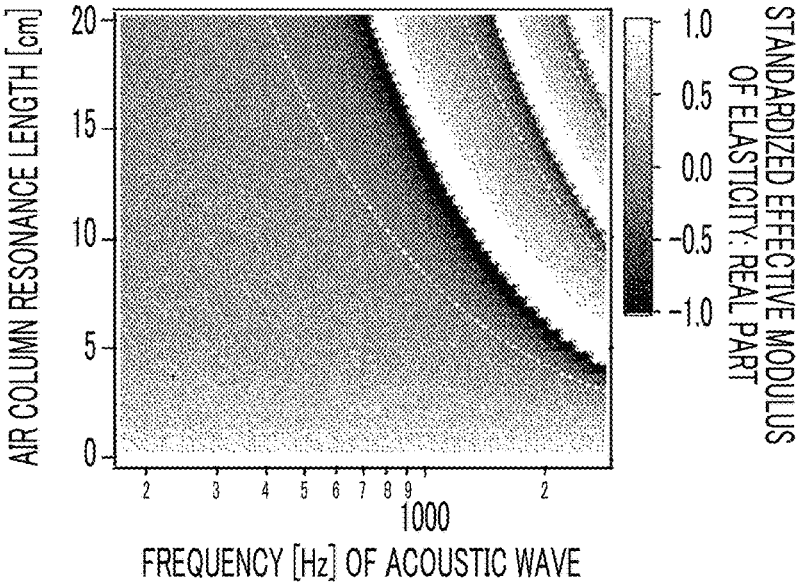
FIG. 5 is a graph showing a relationship among a frequency, an air column resonance length, and the real part of a standardized effective modulus of elasticity.

A white dotted line in FIG. 5 indicates portions where the real part Re[Bn] of a standardized effective modulus Bn of elasticity is 0. According to this, in a region positioned on the left lower side of the white dotted line, "Re[Bn]>0" is satisfied, resonance does not occur, and an effective modulus of elasticity can be controlled with a smaller size. Although a region where "Re[Bn]>0" is satisfied is present even in a right upper region, it is found that the region is not practical since the dependence of an acoustic wave, which is to be propagated, on a frequency is high or a frequency is about 1000 Hz or more.

Transmission characteristics, which are obtained in a case where an air column resonance tube corresponding to the region where "Re[Bn]>0" is satisfied is disposed in the tubular member, will be described.

Figure 6:
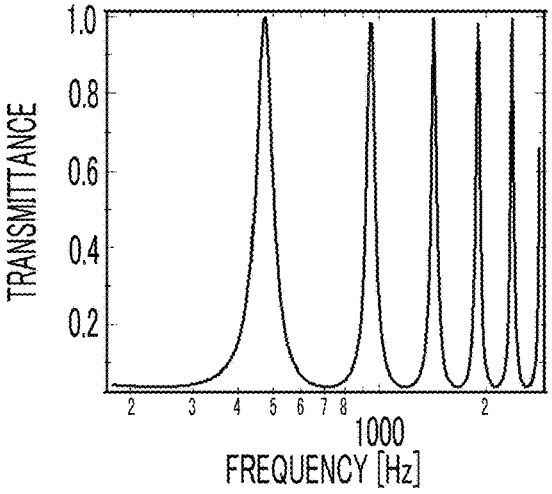
FIG. 6 is a graph showing a relationship between a frequency and transmittance.

First, transmittance, which is obtained in a case where the tubular member is disposed alone without a silencer, is calculated from a simulation using a model shown in FIG. 1. Results are shown in FIG. 6. The diameter of the tubular member is set to 100 mm, the length thereof is set to 300 mm, and transmittance is calculated by a transfer matrix method.

It is found from FIG. 6 that a first resonant frequency of the tubular member in this case is present at about 480 Hz and sound having this resonant frequency is the most critical transmission noise in this tubular member.

Figure 7:
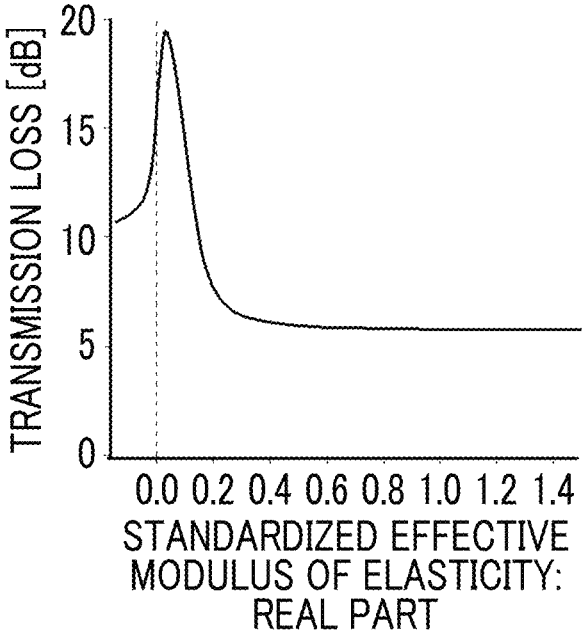
FIG. 7 is a graph showing a relationship between the real part of a standardized effective modulus of elasticity and a transmission loss.

Next, a case where an air column resonance tube is disposed in the tubular member in parallel as shown in FIG. 2 will be considered. A standardized effective modulus of elasticity (an effective modulus of elasticity in a 500 Hz-octave band) controlled by the air column resonance tube and the transmission loss of the tubular member (a transmission loss in a 500 Hz-octave band) are calculated. Results are shown in FIG. 7. A 500 Hz-octave band is the range of 354 Hz to 707 Hz, and the average value of effective moduli of elasticity in this range is an effective modulus of elasticity in a 500 Hz-octave band. The same applies to a transmission loss.

As shown in FIG. 7, a transmission loss is increased in a case where the real part of a standardized effective modulus of elasticity becomes smaller than 1, that is, in a case where an effective modulus of elasticity in the tubular member becomes smaller than the effective modulus of elasticity of air.

From the above description, since noise transmitted through the tubular member can be further reduced in a case where the real part Re[Bn] of a standardized effective modulus Bn of elasticity is in the range of "0<Re[Bn]<1", soundproof performance is improved.

Next, the imaginary part of a standardized effective modulus of elasticity will be described.

A case where an air column resonance tube is disposed in the tubular member in parallel (see FIG. 2) and a porous sound-absorbing material is disposed in the air column resonance tube will be considered.

The real part Re[Bn] and the imaginary part Im[Bn] of a standardized effective modulus of elasticity in a 500 Hz-octave band are calculated from Equation (2) while the length of the air column resonance tube and the flow resistance of the porous sound-absorbing material are changed to various values. The results of the real part are shown in FIG. 8 and the results of the imaginary part are shown in FIG. 9.

Figure 8:
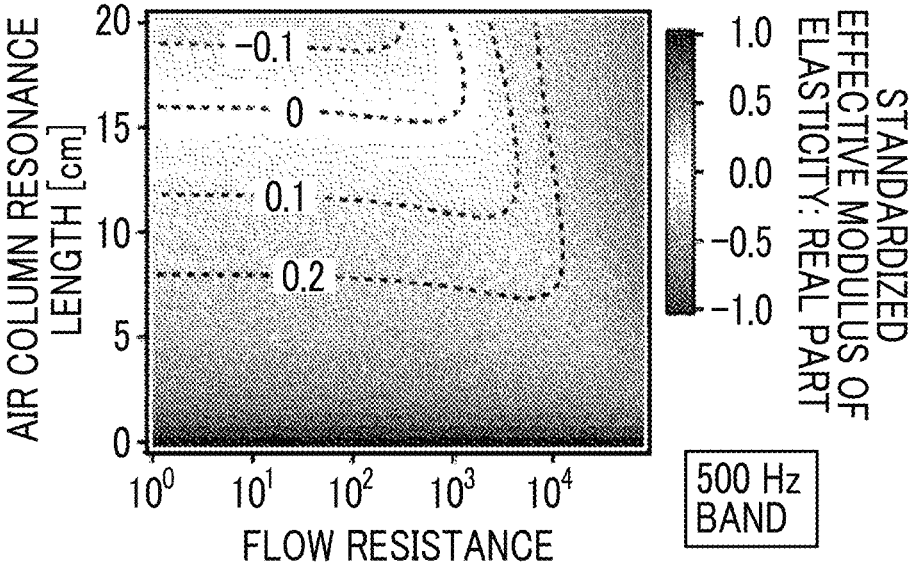
FIG. 8 is a graph showing a relationship among flow resistance, an air column resonance length, and the real part of a standardized effective modulus of elasticity.

It is found from FIG. 8 that a region where the real part of a standardized effective modulus of elasticity satisfies "0<Re[Bn]<1" is enlarged in a region where the flow resistance of the porous sound-absorbing material is $10^3$ or more.

Figure 9:
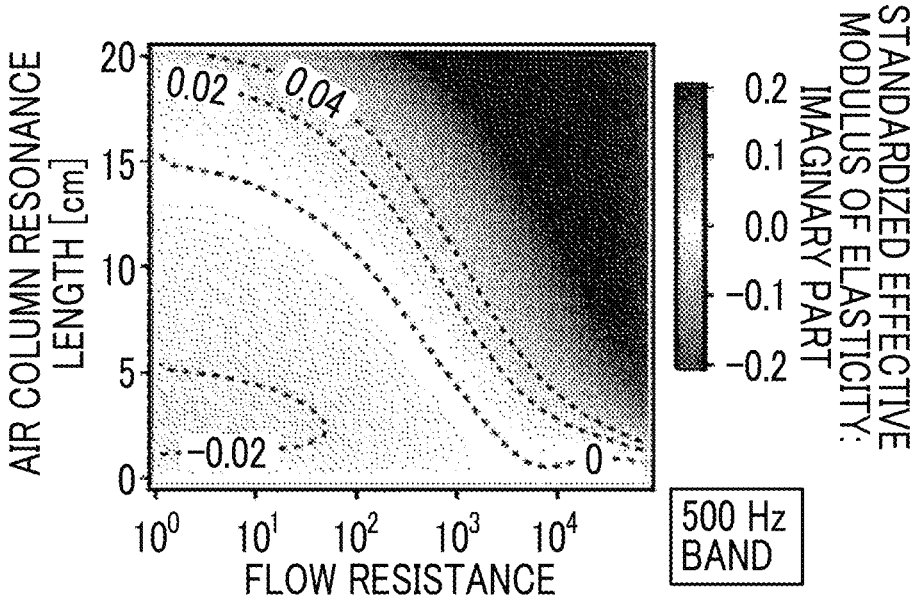
FIG. 9 is a graph showing a relationship among flow resistance, an air column resonance length, and the imaginary part of a standardized effective modulus of elasticity.

Further, it is found from FIG. 9 that the value of the imaginary part Im[Bn] of a standardized effective modulus of elasticity is increased in a right upper region in FIG. 9, that is, a region where flow resistance is high.

Figure 10:
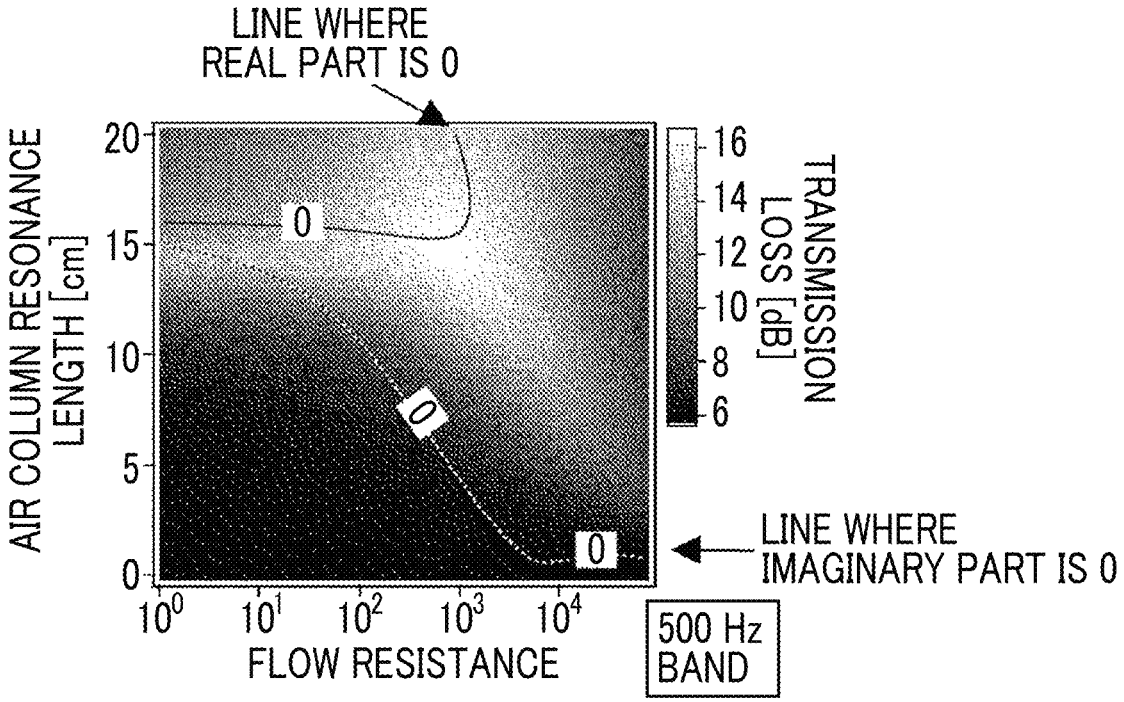
FIG. 10 is a graph showing a relationship among flow resistance, an air column resonance length, and a transmission loss.

Next, a transmission loss is calculated while the length of the air column resonance tube and the flow resistance of the porous sound-absorbing material are changed to various values. Results are shown in FIG. 10. In FIG. 10, a line where the real part Re[Bn] is 0 is shown as a solid line and a line where the imaginary part Im[Bn] is 0 is shown as a white broken line.

It is found from FIG. 10 that soundproof performance is improved since a transmission loss is increased in the above-mentioned enlarged portion of the region where "0<Re[Bn]<1" is satisfied, that is, the region where the flow resistance of the porous sound-absorbing material is $10^3$ or more.

Further, the fact that the porous sound-absorbing material is provided means that an imaginary part is generated in an effective modulus of elasticity, and the fact that the imaginary part Im[Bn] of a standardized effective modulus of elasticity is increased means that the amount of acoustic waves to be converted into other energy is increased. In the invention, the porous sound-absorbing material is a conversion mechanism that converts sound energy into thermal energy.

From the above description, since noise transmitted through the tubular member can be further reduced in a case where the imaginary part Im[Bn] of a standardized effective modulus Bn of elasticity is in the range of "Im[Bn]>0", soundproof performance is improved.

In a case where a resonance type silencer is used to cause the resonant frequency of the resonance type silencer to coincide with the resonant frequency of the tubular member and to silence sound having the lowest resonant frequency of the tubular member, the silencer needs to have a length of at least ¼ of a wavelength λ at the resonant frequency as described above. Accordingly, the size of the silencer is increased. For this reason, there is a problem that it is difficult to achieve both high ventilation performance and high soundproof performance.

Further, the resonance type silencer is to selectively silence sound having a specific frequency (frequency band). For this purpose, the resonance type silencer needs to be designed according to the resonant frequency of the tubular member. For this reason, there is a problem that the resonance type silencer has low general-purpose properties.

Furthermore, the resonance of the tubular member occurs at a plurality of frequencies, but the resonance type silencer silences sound having a specific frequency. For this reason, since resonant sound, which is an object to be silenced, is sound having only one frequency and the frequency band of sound to be silenced by the resonance type silencer is narrow, there is a problem that the resonance type silencer cannot silence resonant sound having other frequencies.

Further, it is effective that the resonance type silencer is disposed in an open space. However, in a case where the resonance type silencer is disposed in a resonance body, such as a tubular member, with the equal resonant frequency, the resonance of the tubular member and the resonance of the silencer interact with each other. Accordingly, original resonant transmission sound caused by the tubular member is separated into two frequencies, so that new resonant transmission sound is generated. For this reason, there is a problem that an effect as a silencer is less.

Furthermore, in a case where a noise source is present in the tubular member (for example, wind noise or the like in a case where wind is present in the air column resonance tube including an opening or a case where a fan for generating wind or the like is operated) and a resonance body is disposed as a silencer, there is a problem that the resonator body amplifies wind noise having a resonant frequency and becomes a new noise source.

In contrast, according to the invention, in a silencing system where one or more silencers are disposed in a tubular member provided to penetrate a wall separating two spaces, the real part Re[Bn] and the imaginary part Im[Bn] of a standardized effective modulus Bn of elasticity in the interior space of the tubular member where the silencers are disposed satisfy "0<Re[Bn]<1" and "Im[Bn]>0".

As described above, the fact that the real part Re[Bn] of a standardized effective modulus Bn of elasticity is larger than 0 means that the silencer does not resonate at the frequency of sound to be silenced by the silencer (the resonant frequency of the tubular member).

Further, the fact that the real part Re[Bn] of a standardized effective modulus Bn of elasticity is smaller than 1 means that the total volume of the interior space of the tubular member in which a silencer is disposed and the silencer is larger than the volume of the interior space of the tubular member alone. The detail thereof will be described below.

Since a region where "Re[Bn]<1" is satisfied is lower effective modulus of elasticity and softer than air, the region where "Re[Bn]<1" is satisfied is a region form the boundary of a free end in a case where the tubular member is installed adjacent to air. The free end is an end from which reflected waves are generated since acoustic waves are freely and easily vibrated at the tip thereof. Examples of the free end include (1) a semi-infinite open space, (2) an expansion space of which the cross-sectional area is larger than the cross-sectional area of the tubular member, (3) a case where the wall surface of the tubular member vibrates so as to receive the energy of acoustic waves (film vibration, a Helmholtz resonance body), and the like. The case of the invention corresponds to (2) and (3), and the cross-sectional area of the silencer is larger than that of the tubular member and the ventilation cross-sectional area of the silencer is equal to or larger than that of the tubular member.

On the other hand, in a case where "Re[Bn]>1" is satisfied, ventilation performance deteriorates. In a case where the modulus of elasticity of an end is higher than that of air and the end is hard, the end is a fixed end and is an end where the vibration of acoustic waves is more limited. Examples of the fixed end include (4) a rigid wall that closes the tubular member, (5) a vibrating wall (a film or the like) that closes the tubular member, (6) a case where a cross-sectional area is set to be smaller than that of the tubular member, and the like. In this case, since ventilation performance is significantly lowered even though soundproof performance can be improved, it is difficult to achieve both soundproof performance and ventilation performance.

However, as an exception, there is a case where ventilation performance may be lowered even though "Re[Bn]<1" is satisfied. As one of the examples thereof, there is a method of forming a mechanism, which lowers a modulus of elasticity, in a region where ventilation performance is lowered due to a reduction in a ventilation cross-sectional area. Since a degree of freedom in design is increased in this method, a design can be provided with high soundproof performance as compared to a case where only a ventilation cross-sectional area is reduced or a mechanism for lowering only a modulus of elasticity is disposed. Accordingly, it is effective that this method is used in a range where the lowering of ventilation performance is allowed.

Further, in a case where the real part Re[Bn] of a standardized effective modulus Bn of elasticity is set to be smaller than 1, a transmission loss can be increased as compared to a case where the silencer is not disposed.

Furthermore, the fact that the imaginary part Im[Bn] of a standardized effective modulus Bn of elasticity is larger than 0 means the dissipation of sound energy in a region generally forming a free end, and means that a conversion mechanism for converting sound energy into thermal energy is provided from a physical meaning in the invention.

From the above description, according to the invention, in a case where the real part Re[Bn] and the imaginary part Im[Bn] of a standardized effective modulus Bn of elasticity satisfy the above-mentioned equations, noise transmitted through the tubular member can be further reduced while high ventilation performance is maintained. Accordingly, high soundproof performance can be obtained.

Further, since the silencing of the invention does not use the resonance of the silencer, the dependence of an acoustic wave on a wavelength is low, soundproof performance can be achieved even in a case where the length, the shape, and the like of the tubular member vary, and general-purpose properties are high since the silencer does not need to be designed according to the tubular member.

Furthermore, since the resonance of the silencer is not used for the silencing of the invention, it is possible not only to silence sound having a specific frequency, which is determined depending on the structure of the silencer, but also to silence a plurality of pieces of resonant sound in a wide frequency band.

Moreover, since the resonance of the silencer is not used for the silencing of the invention, a sufficient silencing effect is obtained without the occurrence of an interaction between the resonance of the tubular member and the resonance of the silencer and the separation of original resonant transmission sound, which is caused by the tubular member, into two frequencies.

Further, since the resonance of the silencer is not used for the silencing of the invention, the amplification of wind noise can be suppressed.

An effective modulus of elasticity can be obtained by the following method.

(Procedure 1)

First, a reflection coefficient R and a transmission coefficient $T_0$ of the tubular member in which the silencer is disposed are derived. A reflection coefficient and a transmission coefficient can be obtained by a method including modeling the structure of a silencer using COMSOL or a transfer matrix method and calculating a reflection coefficient and a transmission coefficient using an acoustic tube (plane wave) model, or a method including disposing a silencer in an acoustic tube and obtaining a reflection coefficient and a transmission coefficient from experiments.

(Procedure 2)

Next, effective impedance ξ and an effective index n of refraction are calculated from the reflection coefficient R and the transmission coefficient $T_0$, which are obtained by Procedure 1, by methods disclosed in Physical Review B 76, 144302 (2007) and Physical Review B 65, 195104 (2002). The effective impedance ξ and the effective index n of refraction are represented by Equation (3). 2πm (m is an integer) is the indeterminacy of 2π that occurs in a case where an inverse trigonometric function is used in a derivation process, and m is 0 in a region defined in the invention.

$$\xi = \frac{r}{1 - 2R + R^2 + T^2},\ n = \frac{-i\ \log(x) + 2\pi m}{kd} \qquad \text{Equation (3)}$$

r and x in Equation (3) are obtained from Equation (4). Further, T is an effective transmission coefficient, and is represented by "$T=T_0\times\exp(-i\times k\times d)$". k is a wave number (the inverse number of a wavelength), and d is the thickness of the region $RA_0$.

$$r = \mp\sqrt{(R^2 - T^2 - 1)^2 - 4T^2},\ x = \frac{1 - R^2 + T^2 + r}{2T} \qquad \text{Equation (4)}$$

(Procedure 3)

Next, a standardized effective modulus Bn of elasticity is calculated from the effective impedance and the effective index n of refraction, which are obtained by Procedure 2, by Equation (5).

$$Bn=\xi/n \qquad \text{Equation (5)}$$

Here, a case where a resonance type silencer having the same resonant frequency as the resonant frequency of the tubular member is disposed in the tubular member will be described using a simulation. In a case where the resonance type silencer having the same resonant frequency as the resonant frequency of the tubular member is disposed in the tubular member in parallel as described above, "Re[Bn]=0" is satisfied.

An acoustic module of finite element method-calculation software COMSOL ver5.3 (manufactured by COMSOL Inc.) is used in the simulation.

Figure 11:
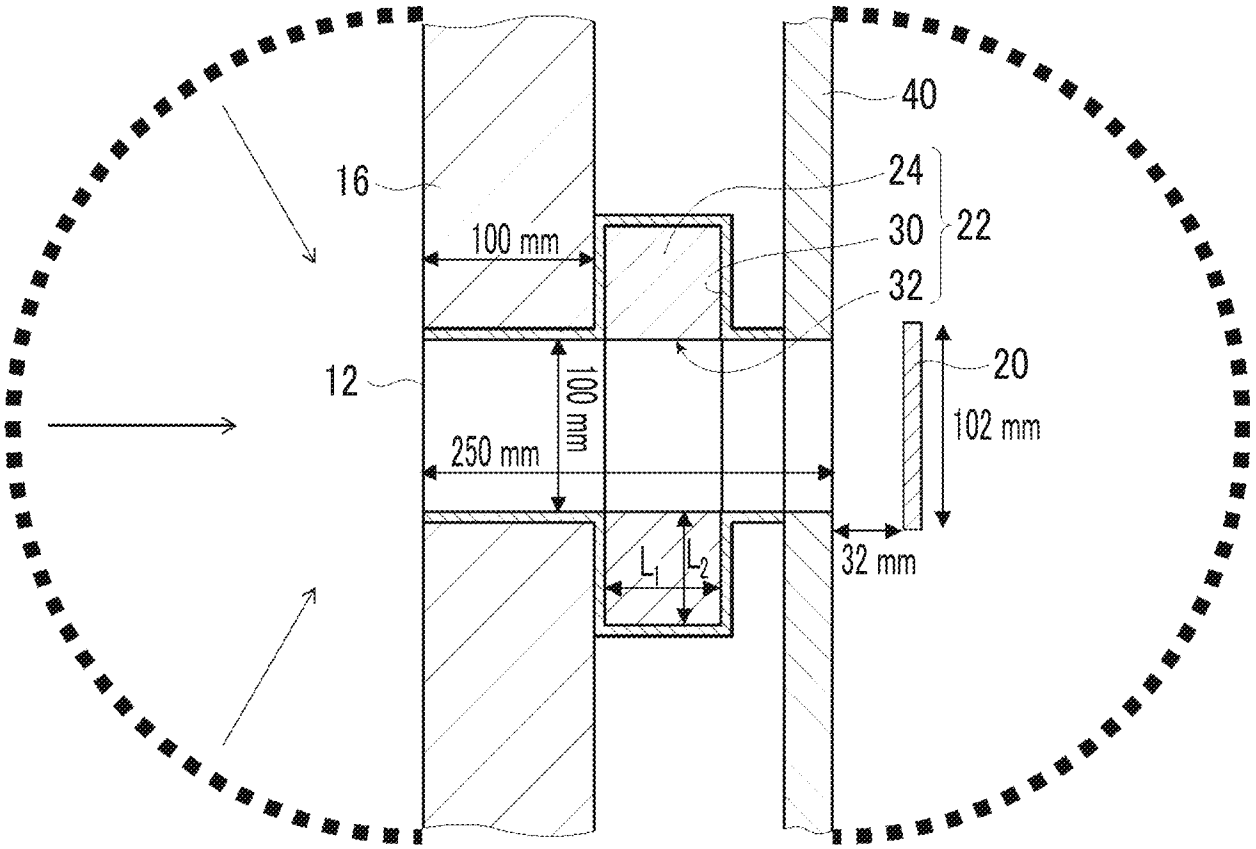
FIG. 11 is a diagram illustrating a method for a simulation.

As shown in FIG. 11, in the simulation, the diameter of a ventilation sleeve (tubular member) is set to 100 mm, the thickness of a wall is set to 100 mm, the thickness of a decorative plate is set to 10 mm, and a distance between the wall and the decorative plate is set to 140 mm. That is, the total thickness of the wall and the decorative plate is set to 250 mm.

As shown in FIG. 11, this simulation model is used to make acoustic waves be incident from the hemispherical surface of one space, which is partitioned by the wall, and to obtain the amplitude of an acoustic wave, which reaches the hemispherical surface of the other space, per unit volume. The hemispherical surface is a hemispherical surface that has a center at the center position of the open surface of the ventilation sleeve and has a radius of 500 mm. The amplitude of the acoustic wave, which is made to be incident, per unit volume is set to 1.

Further, the simulation model is modeled so that a lid of a register (a diameter of 102 mm) is disposed at a position spaced from the end face of the ventilation sleeve, which faces an acoustic wave-detection surface, by 32 mm.

First, a calculation is made for a case where a silencer is not disposed (hereinafter, also referred to as the case of a straight tube), as a reference.

Figure 12:
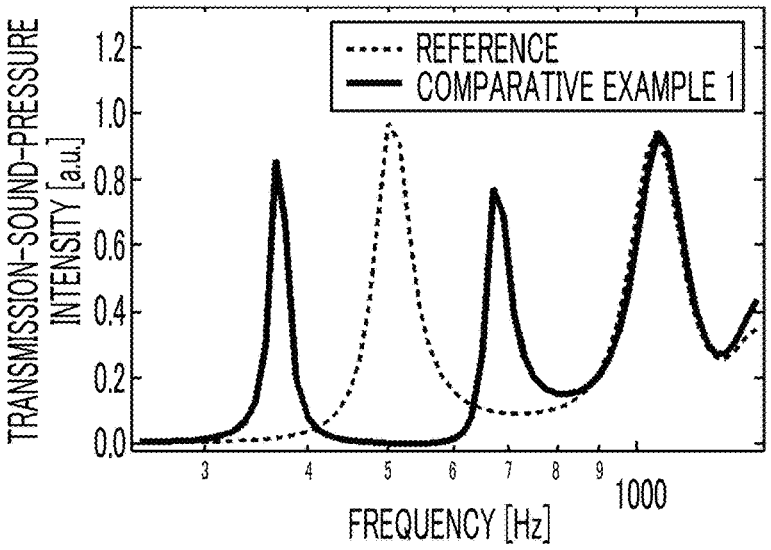
FIG. 12 is a graph showing a relationship between a frequency and transmission-sound-pressure intensity.

The results of the simulation are shown in FIG. 12 as a graph of a relationship between a frequency and transmission-sound-pressure intensity.

It is found from FIG. 12 that the frequency of first resonance of the ventilation sleeve 12 in a case where a silencer is not disposed (in the case of a straight tube) is about 515 Hz.

Next, an air column resonance type silencer of which the resonant frequency is about 515 Hz will be designed.

Figure 13:
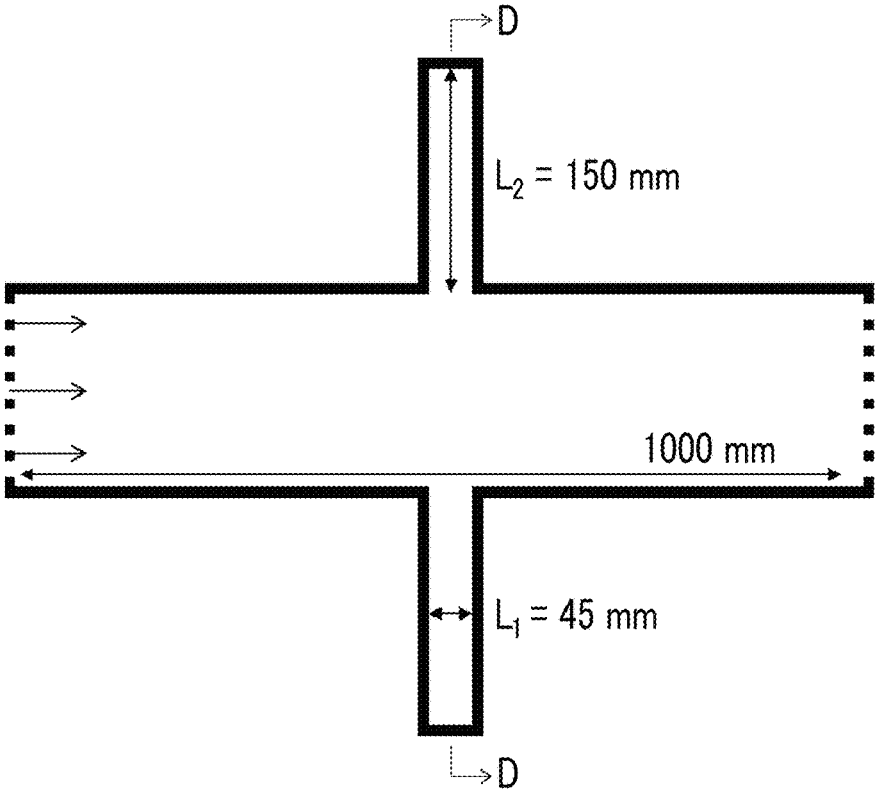
FIG. 13 is a conceptual diagram illustrating a method of evaluating a calculation model of Comparative Example.
Figure 14:
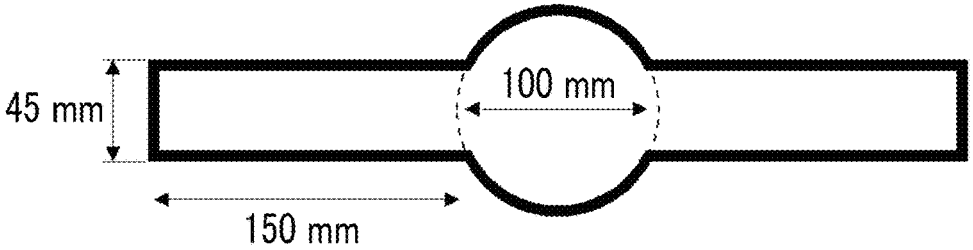
FIG. 14 is a cross-sectional view taken along line D-D of FIG. 13.

A model where air column resonance type silencers are connected to the outer peripheral portion of an acoustic tube having a length of 1000 mm and a diameter of 100 mm as shown in FIGS. 13 and 14 is made, and the basic acoustic characteristics of the air column resonance type silencer are evaluated. Plane waves are made to be incident on the acoustic tube from one end face of the acoustic tube, and the amplitude of the acoustic wave, which reaches the other end face of the acoustic tube, per unit volume is obtained. The amplitude of the acoustic wave, which is made to be incident, per unit volume is set to 1. The square of a value, which is obtained in a case where the integrated value of a sound pressure amplitude on the detection surface is divided by the integrated value of a sound pressure amplitude on the incident surface, is defined as transmission-sound-pressure intensity.

One surface of the air column resonance type silencer in a longitudinal direction is opened and is connected to the acoustic tube. Further, the position of the air column resonance type silencer in the axial direction of the acoustic tube is set substantially at the middle position of the acoustic tube.

Figure 15:
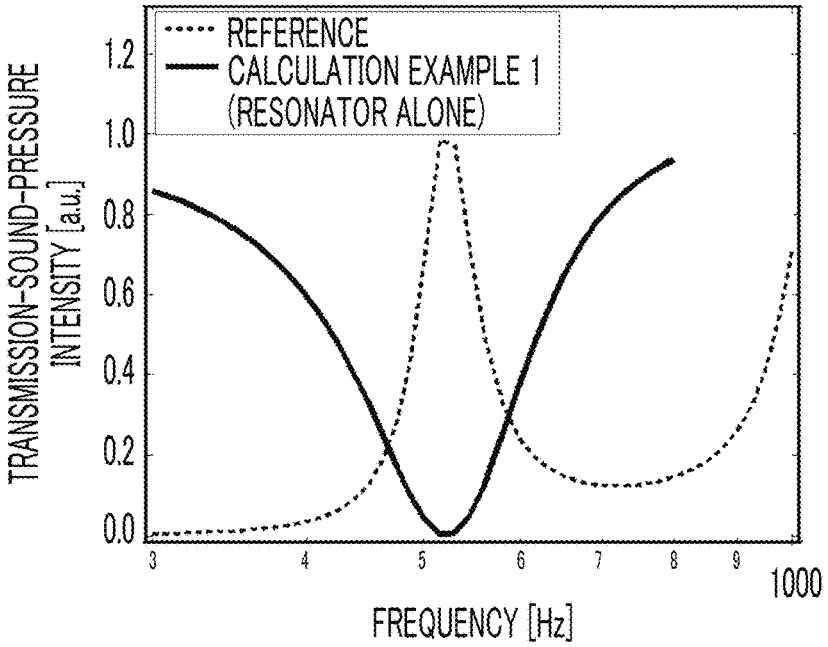
FIG. 15 is a graph showing a relationship between a frequency and transmission-sound-pressure intensity.

The air column resonance type silencer is formed in the shape of a rectangular parallelepiped of which the size of the cross section is 45 mm×45 mm, and a relationship between a frequency and transmission-sound-pressure intensity is calculated to obtain a resonant frequency while the length of the air column resonance type silencer is changed to various values. As a result, it is found that the resonant frequency of the air column resonance type silencer is about 515 Hz at a length of 150 mm as shown in FIG. 15 as Calculation Example 1.

Figure 16:
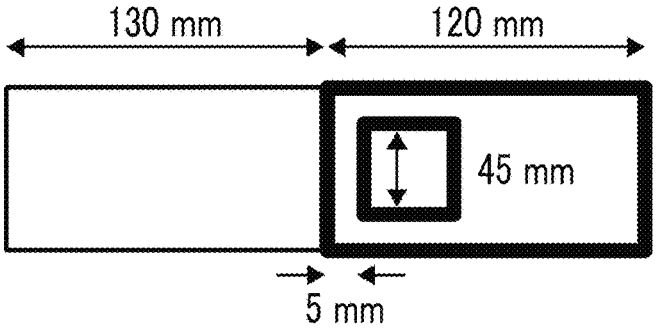
FIG. 16 is a schematic side view illustrating configuration of Comparative Example.

Next, a model where a silencer including the air column resonance type silencer is modeled and is connected to a ventilation sleeve as shown in FIG. 16 is made, and acoustic waves are made to be incident from the hemispherical surface of one space, which is partitioned by a wall, and the amplitude of the acoustic wave, which reaches the hemispherical surface of the other space, per unit volume is obtained in the same way as described above. The cross-sectional view taken at the position of the air column resonance type silencer of FIG. 16 is the same as FIG. 14.

As shown in FIGS. 14 and 16, the model of the air column resonance type silencer is adapted so that a tubular silencer is disposed at an end portion of a ventilation sleeve, includes two air column resonance tubes formed in the shape of a prismatic column of 45 mm×45 mm, having a length (depth) of 150 mm, and provided on side surfaces thereof, and has a diameter (100 mm) equal to the diameter of the ventilation sleeve. The length of the ventilation sleeve in an axial direction is set to 130 mm, and the length of a tubular portion of the silencer in the axial direction is set to 120 mm. The position of the air column resonance tube in the axial direction is set to a position spaced from the end face of the silencer, which faces the ventilation sleeve, by 5 mm.

The results of the simulation are shown in FIG. 12 as a graph of a relationship between a frequency and transmission-sound-pressure intensity (Comparative Example 1). Further, the results of an experiment are shown in FIG. 17 as a graph of a relationship between a frequency and transmission-sound-pressure intensity.

In the experiment, a silencer having the above-mentioned shape and dimensions is produced using an acrylic plate having a thickness of 5 mm and a relationship between a frequency and transmission-sound-pressure intensity is measured using a simple and small soundproof room to be described later by the same method as that of Example.

Figure 17:
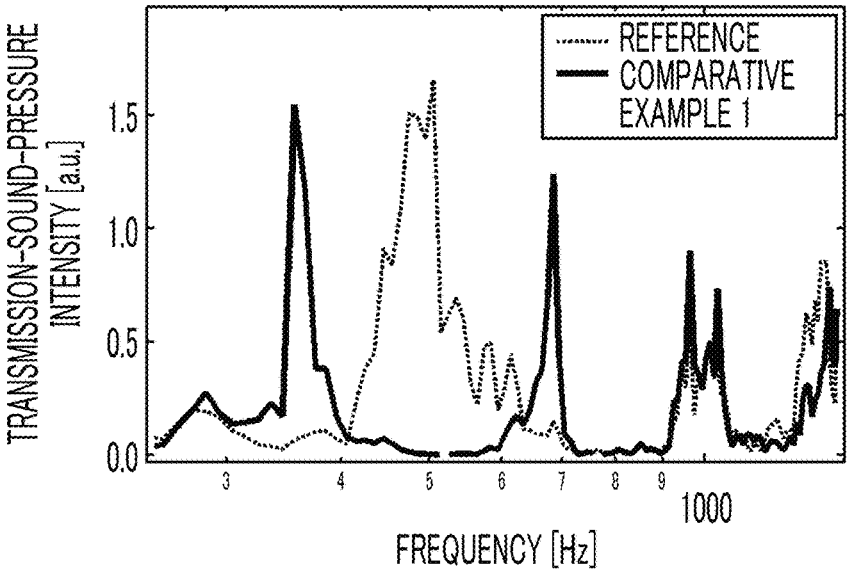
FIG. 17 is a graph showing a relationship between a frequency and transmission-sound-pressure intensity.

As shown in FIGS. 12 and 17 as Comparative Example 1, it is found that peaks of transmission-sound-pressure intensity are generated on both sides of the first resonant frequency of the ventilation sleeve, which is obtained in a case where the resonance type silencer is not disposed, in a case where the resonance type silencer is disposed at the ventilation sleeve. That is, peaks are generated at two frequencies, that is, a frequency lower than and a frequency higher than the first resonant frequency that is obtained in a case where the resonance type silencer is not disposed. This is caused by a phenomenon where two modes of a bonding mode and an anti-bonding mode are separated due to a strong interaction in a case where the resonance type silencer is disposed in the sound field space of the ventilation sleeve where resonance is to occur.

As a result, sound having the first resonant frequency of the ventilation sleeve can be silenced, but two peaks exist newly.

Since other new peaks of transmission-sound-pressure intensity are generated in a case where a resonance type silencer is used as a silencer for the ventilation sleeve as described above, sound cannot be sufficiently silenced.

Here, in terms of soundproof performance and ventilation performance, the real part of a standardized effective modulus of elasticity satisfies "$0<Re[Bn]<1$", more preferably satisfies "$0.05\leq Re[Bn]\leq 0.8$", more preferably satisfies "$0.1\leq Re[Bn]\leq 0.6$", and still more preferably satisfies "$0.15\leq Re[Bn]\leq 0.5$". Further, the imaginary part of a standardized effective modulus of elasticity preferably satisfies "$0<Im[Bn]\leq 0.5$", more preferably satisfies "$0.0005\leq Im[Bn]\leq 0.45$", still more preferably satisfies "$0.001\leq Im[Bn]\leq 0.4$", and particularly satisfies "$0.0015\leq Im[Bn]\leq 0.3$".

Furthermore, in order to make configuration where the real part and the imaginary part of a standardized effective modulus Bn of elasticity satisfy "$0<Re[Bn]<1$" and "$Im[Bn]>0$", it is preferable that the silencer has a structure having a wavelength shorter than a wavelength at the first resonant frequency of the tubular member and it is preferable that the silencer does not have a structure resonating at the first resonant frequency of the tubular member.

Moreover, it is preferable that a cross-sectional area at a position where the silencer is disposed is larger than the cross-sectional area of the tubular member alone in a cross section perpendicular to the central axis of the tubular member. That is, it is preferable that the outer diameter of the silencer is larger than the outer diameter of the tubular member.

Further, in order to make configuration where the real part and the imaginary part of a standardized effective modulus Bn of elasticity satisfy "$0<Re[Bn]<1$" and "$Im[Bn]>0$", it is preferable that the silencer includes a cavity portion communicating with the interior space of the tubular member and the total volume of the interior space of the tubular member and the cavity portion of the silencer in a state where the silencer is disposed in the tubular member is larger than the volume of the interior space of the tubular member alone.

In a case where the tubular member is a ventilation sleeve provided in a house, a mansion, or the like, the cross-sectional shape of the ventilation sleeve corresponds to about 30 cm square at the maximum and the thickness of a wall is about 20 cm. Accordingly, the cross-sectional area of the tubular member is about 900 $cm^2$ at the maximum. That is, the cross-sectional area of the tubular member is 900 $cm^2$ or less in the case of the ventilation sleeve. Further, the volume of the interior space of the tubular member alone is about 18000 $cm^3$ at the maximum. That is, the volume of the interior space of the tubular member alone is 18000 $cm^3$ or less in the case of the ventilation sleeve.

Furthermore, in order to make configuration where the real part and the imaginary part of a standardized effective modulus Bn of elasticity satisfy "$0<Re[Bn]<1$" and "$Im[Bn]>0$", it is preferable that the silencer includes a conversion mechanism for converting sound energy into thermal energy.

Configuration where a standardized effective modulus Bn of elasticity satisfies "$0<Re[Bn]<1$" and "$Im[Bn]>0$" will be specifically described below.

First Embodiment

Figure 18:
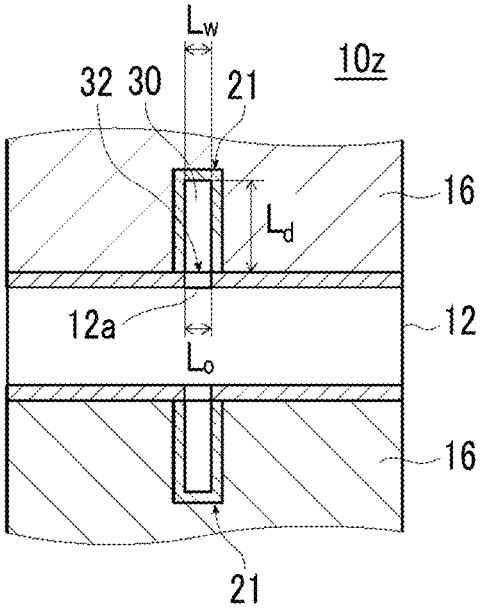
FIG. 18 is a schematic cross-sectional view showing an example of a silencing system according to a preferred first embodiment of the invention.

FIG. 18 is a schematic cross-sectional view showing an example of a silencing system according to a preferred first embodiment of the invention.

As shown in FIG. 18, a silencing system 10*z* has configuration where silencers 21 are disposed on the outer peripheral surface of a cylindrical tubular member 12 provided to penetrate a wall 16 separating two spaces.

The tubular member 12 is, for example, a ventilation sleeve, such as a ventilation port and an air-conditioning duct.

The silencers 21 are to silence sound having frequencies that include the frequency of first resonance occurring in the tubular member.

Each silencer 21 has the shape of a substantially rectangular parallelepiped extending in the radial direction of the tubular member 12, and includes a cavity portion 30 that is formed therein so as to have the shape of a substantially rectangular parallelepiped. An opening portion 32, which allows the cavity portion 30 and the outside to communicate with each other, is formed on the end face of each cavity portion 30 facing the tubular member 12.

The opening portions 32 of the silencers 21 are connected to peripheral surface-opening portions 12*a* formed on the peripheral surface of the tubular member 12. Since the opening portions 32 are connected to the peripheral surface-opening portions 12*a*, the opening portions 32 are connected to a sound field space of first resonance occurring in the tubular member 12 of the silencing system 10*z*.

The tubular member 12 may be a general duct used for various devices without being limited to a ventilation port, an air-conditioning duct, and the like.

Further, in a case where the depth of the cavity portion 30 in the traveling direction of acoustic waves in the cavity portion 30 of the silencer 21 is denoted by La and the width of the opening portion 32 of the silencer 21 in the axial direction of the tubular member 12 (hereinafter, also simply referred to as the axial direction) is denoted by $L_o$, the depth $L_d$ of the cavity portion 30 is larger than the width $L_o$ of the opening portion 32 as shown in FIG. 18.

Here, the traveling direction of acoustic waves in the cavity portion 30 can be obtained from a simulation. Since the cavity portion 30 extends in the radial direction in the example shown in FIG. 18, the traveling direction of acoustic waves in the cavity portion 30 is the radial direction (a vertical direction in FIG. 18). Accordingly, the depth $L_d$ of the cavity portion 30 is a length from the opening portion 32 to the upper end of the cavity portion 30 in the radial direction. In a case where the depth of the cavity portion 30 varies depending on a position, the depth $L_d$ of the cavity portion 30 is the average value of depths obtained at the respective positions.

Further, in a case where the width of the opening portion 32 varies depending on a position, the width $L_o$ of the opening portion 32 is the average value of widths obtained at the respective positions.

Furthermore, in a case where the wavelength of the acoustic wave at the resonant frequency of first resonance occurring in the tubular member 12 of the silencing system is denoted by λ, it is preferable that the depth $L_d$ of the cavity portion 30 of the silencer 21 is smaller than the wavelength 2 and satisfies "$0.02\times\lambda<L_d<0.25\times\lambda$," in a state where the flow resistance $\sigma_l$ [Pa·s/m$^2$] of a porous sound-absorbing material to be described later disposed in the silencer is in a suitable range to be described later. That is, the depth $L_d$ of the cavity portion 30 is smaller than λ/4 and the silencer 21 does not have a structure that resonates at a first resonant frequency of the tubular member.

The silencer 21 and the cavity portion 30 formed in the silencer 21 are formed in the shape of a substantially rectangular parallelepiped in the example shown in FIG. 18, but may be formed in various shapes, such as a cylindrical shape, without being limited thereto. Further, the shape of the opening portion 32 can also be set to various shapes, such as a rectangular shape, a polygonal shape, a circular shape, and an elliptical shape, without being limited thereto.

Furthermore, in a case where the frequency of first resonance occurring in the tubular member 12 is denoted by $F_0$ and the resonant frequency of the silencer 21 is denoted by $F_1$, it is preferable that "$1.15\times F_0<F_1$" is satisfied. In a case where a relationship between the frequency $F_0$ of first resonance, which occurs in the tubular member 12, and the resonant frequency $F_1$ of the silencer 21 satisfies the above-mentioned range, the transmission-sound-pressure intensity at first resonance occurring in the tubular member 12 at the resonant frequency $F_1$ of the silencer 21 becomes 25% or less of the peak value. Accordingly, an interaction between first resonance occurring in the tubular member 12 and the resonance of the silencer is reduced.

In terms of being capable of further reducing an interaction by further reducing the transmission-sound-pressure intensity at first resonance occurring in the tubular member 12 at the resonant frequency $F_1$ of the silencer 21, the frequency $F_0$ of first resonance occurring in the tubular member 12 and the resonant frequency $F_1$ of the silencer 21 preferably satisfy "$1.17\times F_0<F_1$", more preferably satisfy "$1.22\times F_0<F_1$", and still more preferably satisfy "$1.34\times F_0<F_i$". In cases where the above-mentioned conditions are satisfied, the transmission-sound-pressure intensity at first resonance occurring in the tubular member 12 at the resonant frequency $F_1$ of the silencer 21 becomes 20% or less, 15% or less, and 10% or less of the peak value.

This is the same in the other embodiments.

Figure 19:
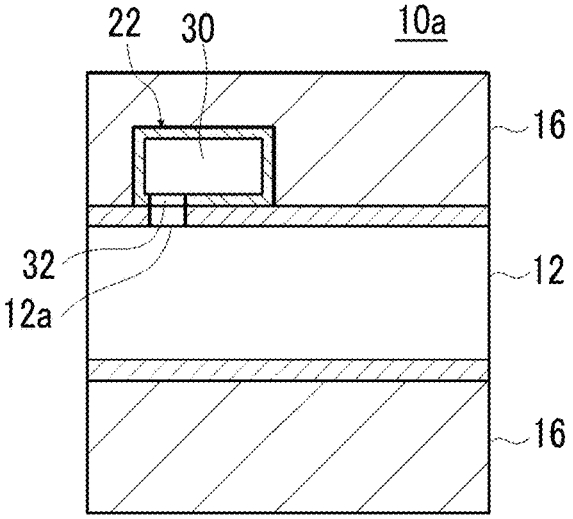
FIG. 19 is a schematic cross-sectional view showing another example of the silencing system according to the preferred first embodiment of the invention.

Further, the cavity portion 30 of the silencer 21 extends in the radial direction and the traveling direction of acoustic waves in the cavity portion 30 is the radial direction in the example shown in FIG. 18, but the cavity portion 30 and the traveling direction are not limited thereto. For example, as shown in FIG. 19, the cavity portion 30 may extend in the axial direction and the traveling direction of acoustic waves in the cavity portion 30 may be the axial direction. In the following description, the silencer 21 shown in FIG. 18 will also be referred to as a vertical cylinder type silencer.

Figure 20:
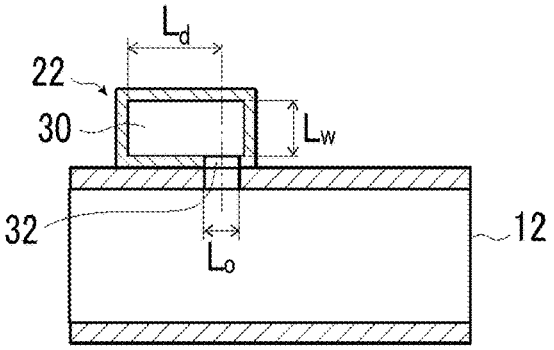
FIG. 20 is a diagram illustrating the depth $L_d$ and the width $L_w$ of a cavity portion of a silencer.

FIG. 19 is a schematic cross-sectional view showing an example of the silencing system according to the preferred embodiment of the invention. Furthermore, FIG. 20 is a diagram illustrating the depth $L_d$ and the width $L_w$ of the cavity portion of the silencer. The wall 16 is not shown in FIG. 20. The wall 16 may not be shown even in subsequent drawings.

As shown in FIG. 19, a silencing system 10*a* has configuration where a silencer 22 is disposed on the outer peripheral surface of a cylindrical tubular member 12 provided to penetrate a wall 16 separating two spaces.

The tubular member 12 is, for example, a ventilation sleeve, such as a ventilation port and an air-conditioning duct.

The silencer 22 has the shape of a substantially rectangular parallelepiped, which extends in an axial direction in a cross section parallel to the axial direction and is curved along the outer peripheral surface of the tubular member 12, and includes a cavity portion 30 that is formed therein so as to have the shape of a substantially rectangular parallelepiped extending in the axial direction. Further, the silencer 22 includes an opening portion 32 that is positioned on the surface of the silencer 22 facing the tubular member 12 at one end portion of the silencer 22 in the axial direction and allows the cavity portion 30 and the outside to communicate with each other. That is, the silencer 22 includes an L-shaped space. The opening portion 32 is connected to a peripheral surface-opening portion 12*a* formed on the peripheral surface of the tubular member 12. Since the opening portion 32 is connected to the peripheral surface-opening portion 12*a*, the opening portion 32 is connected to a sound field space of first resonance occurring in the tubular member 12 of the silencing system 10*a*.

Here, since the cavity portion 30 extends in the axial direction in the example shown in FIG. 19, the traveling direction of acoustic waves in the cavity portion 30 is the axial direction (a horizontal direction in FIG. 19). Accordingly, as shown in FIG. 20, the depth $L_d$ of the cavity portion 30 is a length from the center position of the opening portion 32 to the farther end face of the cavity portion 30 in the axial direction.

In the following description, the silencer 22 shown in FIG. 19 will also be referred to as an L-shaped silencer.

Each of the silencer 21 shown in FIG. 18 and the silencer 22 shown in FIG. 19 comprises a conversion mechanism for converting sound energy into thermal energy, such as the viscosity of fluid near the wall surface of the silencer and the unevenness (surface roughness) of the wall surface or a porous sound-absorbing material 24 to be described later disposed in the silencer.

As described above, the silencing system 10*z* in which the silencers 21 shown in FIG. 18 are disposed and the silencing system 10*a* in which the silencer 22 shown in FIG. 19 is disposed can have configuration where a standardized effective modulus Bn of elasticity in the interior space of the tubular member 12 satisfy "$0<\mathrm{Re}[Bn]<1$" and "$\mathrm{Im}[Bn]>0$". Accordingly, since noise transmitted through the tubular member can be further reduced while high ventilation performance is maintained, high soundproof performance can be obtained.

Further, since the silencer 22 is formed in the shape including an L-shaped space, the effective outer diameter of the silencer 22, that is, the outer diameter of the silencing system can be further reduced. Accordingly, higher ventilation performance can be obtained while high soundproof performance is maintained. The effective outer diameter will be described in detail later.

Here, the silencers are disposed on the outer periphery of the tubular member 12 in the examples shown in FIGS. 18 and 19, but the disposition of the silencers is not limited thereto. The opening portions of the silencers only have to be connected to the sound field space of the first resonance of the tubular member 12.

The sound field space will be described with reference to FIG. 21.

Figure 21:
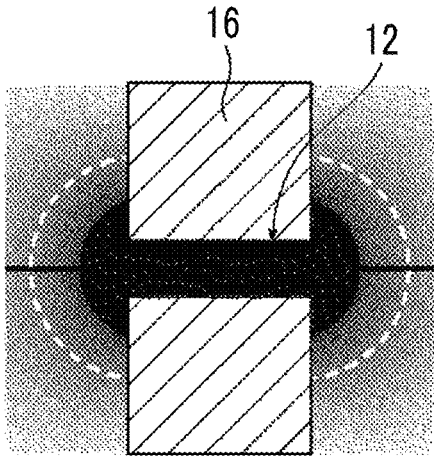
FIG. 21 is a diagram illustrating a sound field space.

FIG. 21 is a diagram showing the distribution of sound pressure in a first resonance mode of the tubular member 12 provided to penetrate the wall 16 separating two spaces that is obtained from a simulation. As found from FIG. 21, the sound field space of the first resonance of the tubular member 12 is a space in the tubular member 12 and within an open-end correction distance. As well known, the antinodes of the standing wave of the sound field protrude outside the tubular member 12 by an open-end correction distance. An open-end correction distance in the case of the cylindrical tubular member 12 is given as about 1.2×tube diameter.

The silencer 22 only has to be disposed at a position where the opening portion 32 is connected to the sound field space of the first resonance of the tubular member 12. Accordingly, the opening portion 32 of the silencer 22 may be disposed outside the open end face of the tubular member 12 as in a silencing system 10*b* shown in FIG. 22. Alternatively, the silencer 22 may be disposed in the tubular member 12 as in a silencing system 10*c* shown in FIG. 23.

Figure 22:
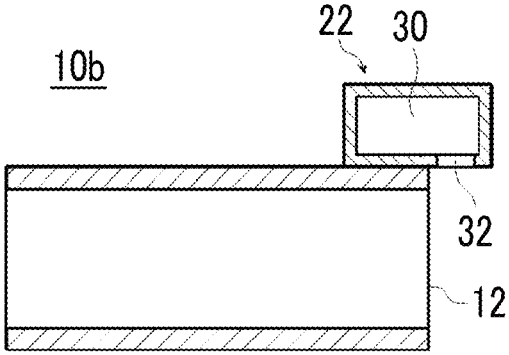
FIG. 22 is a cross-sectional view conceptually showing another example of the silencing system according to the first embodiment of the invention.
Figure 23:
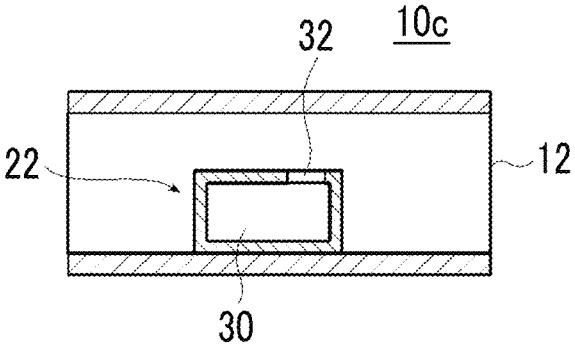
FIG. 23 is a cross-sectional view conceptually showing another example of the silencing system according to the first embodiment of the invention.

In the silencing system 10*b* shown in FIG. 22 and the silencing system 10*c* shown in FIG. 23, the silencer 22 is disposed so that the opening portion 32 faces the central axis side of the tubular member 12. The central axis of the tubular member 12 is an axis passing through the centroid of the cross section of the tubular member 12.

Here, the position of the opening portion 32 of the silencer 22 in the axial direction is not limited. A frequency band where sound is more suitably silenced can be controlled depending on the position of the opening portion 32.

For example, in a case where the opening portion 32 of the silencer 22 is disposed at a position where the sound pressure of the acoustic waves having the first resonant frequency is high, that is, in the middle of the tubular member in the axial direction to silence acoustic waves having the first resonant frequency of the tubular member 12, higher soundproof performance can be achieved.

Further, in terms of soundproof performance and ventilation performance, the depth La of the cavity portion 30 of the silencer 22 preferably satisfies "$0.022\times\lambda<L_d<0.23\times\lambda$", more preferably satisfies "$0.032\times\lambda<L_d<0.21\times\lambda$.", and still more preferably satisfies "$0.042\times\lambda<L_d<0.19\times\lambda$," in a state where the flow resistance $\sigma_1$ [Pa·s/m$^2$] of a porous sound-absorbing material to be described later disposed in the silencer is in a suitable range to be described later.

Furthermore, the width $L_w$ (see FIG. 20) of the cavity portion 30 in a direction orthogonal to the depth direction of the cavity portion 30 in a cross section parallel to the axial direction preferably satisfies "$0.02\times\lambda<L_w<0.15\times\lambda$", preferably satisfies "$0.03\times\lambda<L_w<0.12\times\lambda$", and more preferably satisfies "$0.04\times\lambda<L_w<0.1\times\lambda$" in a state where the flow resistance $\sigma_1$ [Pa·s/m$^2$] of a porous sound-absorbing material to be described later disposed in the silencer is in a suitable range to be described later. In FIG. 18, the width of the cavity portion 30 is a length in a horizontal direction and coincides with the width $L_w$ of the opening portion 32.

Further, the conversion mechanism, which converts sound energy into thermal energy, is the viscosity of fluid near the wall surface of the silencer and the unevenness (surface roughness) of the wall surface of the silencer, the porous sound-absorbing material disposed in the silencer, or the like as described above and it is preferable that the porous sound-absorbing material is used.

Figure 24:
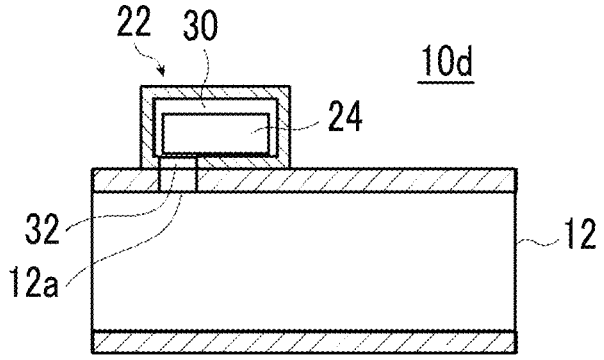
FIG. 24 is a cross-sectional view conceptually showing another example of the silencing system according to the first embodiment of the invention.
Figure 25:
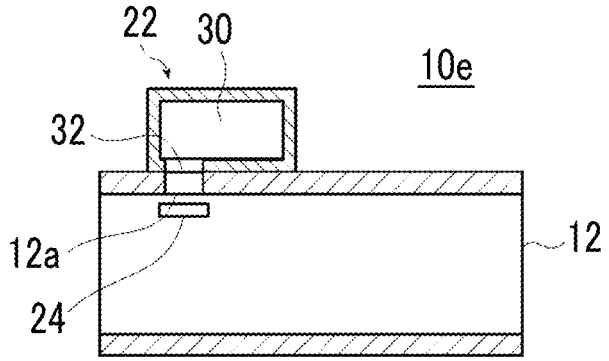
FIG. 25 is a cross-sectional view conceptually showing another example of the silencing system according to the first embodiment of the invention.

As in a silencing system 10*d* shown in FIG. 24, a porous sound-absorbing material 24 only has to be disposed in at least a part of the inside of the cavity portion 30 of the silencer 22. Alternatively, as in a silencing system 10*e* shown in FIG. 25, a porous sound-absorbing material 24 may be disposed so as to cover at least a part of the opening portion 32 of the silencer 22.

The flow resistance $\sigma_1$ [Pa·s/m$^2$] per unit thickness of the porous sound-absorbing material 24 preferably satisfies "$3.0<\log(\sigma_1)<4.7$", more preferably satisfies "$3.3<\log(\sigma_1)<4.6$", and more preferably satisfies "$3.8<\log(\sigma_1)<4.4$". In the expressions, the unit of $L_d$ is [mm] and log is common logarithm. The normal incidence sound absorption coefficient of a sound-absorbing material having a thickness of 1 cm is measured and fitting is performed with Mikimodel (J. Acoust. Soc. Jpn., 11(1) pp. 19-24 (1990)) to evaluate the flow resistance of the sound-absorbing material. Alternatively, the flow resistance of the sound-absorbing material may be evaluated according to "ISO 9053".

Further, in a case where a ratio (opening width/cylinder length) of the width of the opening portion to the length of the cavity portion 30 in the depth direction of the cavity portion 30 (hereinafter, also referred to as a cylinder length) is denoted by $K_{rate}$ (%), the flow resistance $\sigma_1$ [Pa·s/m$^2$] per unit length of the porous sound-absorbing material 24 preferably satisfies "$(0.014\times K_{rate}+3.00)<\log\sigma_1<(0.015\times K_{rate}+3.9)$" in the case of "$5\%<K_{rate}\leq 50\%$" and preferably satisfies "$(0.004\times K_{rate}+3.5)<\log\sigma_1<(0.007\times K_{rate}+4.3)$" in the case of "$50\%<K_{rate}$". Furthermore, the flow resistance $\sigma_1$ [Pa·s/m$^2$] per unit length of the porous sound-absorbing material 24 more preferably satisfies "$(0.020\times K_{rate}+3.05)<\log\sigma_1<(0.015\times K_{rate}+3.85)$" in the case of "$5\%<K_{rate}<50\%$" and more preferably satisfies "$(0.004\times K_{rate}+3.7)<\log\sigma_1<(0.007\times K_{rate}+4.25)$" in the case of "$50\%<K_{rate}$". Moreover, the flow resistance $\sigma_1$ [Pa·s/m$^2$] per unit length of the porous sound-absorbing material 24 still more preferably satisfies "$0.020\times K_{rate}+3.10)<\log\sigma_1<(0.016\times K_{rate}+3.8)$" in the case of "$5\%<K_{rate}<50\%$" and still more preferably satisfies "$(0.004\times K_{rate}+3.93)<\log\sigma_1<(0.007\times K_{rate}+4.15)$" in the case of "$50\%<K_{rate}$". In the expressions, log is common logarithm.

The results of a simulation performed about a relationship between a ratio $K_{rate}$ of an opening width to a cylinder length and the flow resistance $\sigma_1$ [Pa·s/m$^2$] per unit length of the porous sound-absorbing material 24 will be described.

Figure 26:
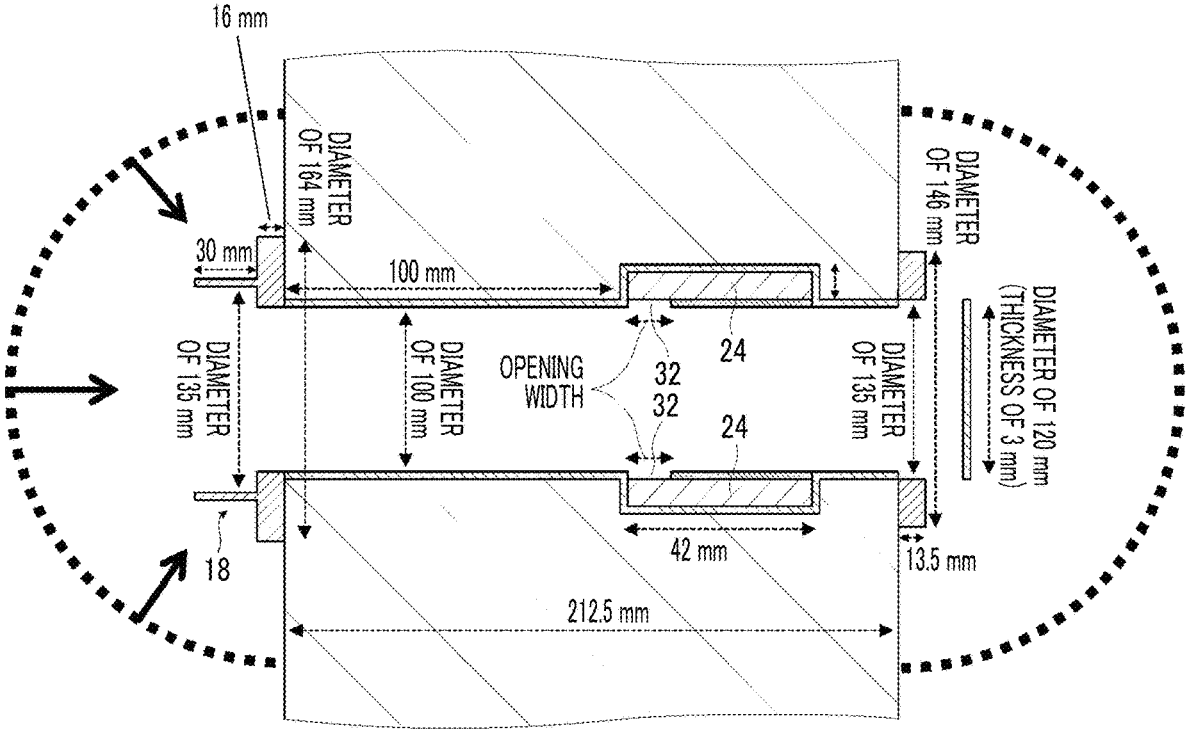
FIG. 26 is a cross-sectional view schematically showing a model of a silencing system used in a simulation.

FIG. 26 is a cross-sectional view schematically showing a model of a silencing system used in the simulation.

As shown in FIG. 26, the thickness of a wall 16 is set to 212.5 mm and the diameter of a tubular member 12 is set to 100 mm. A silencer 22 is disposed at a position that is spaced from a wall provided on the incident side (the left side in FIG. 26) by 100 mm. The silencer 22 is disposed in a tubular shape on the outer periphery of the tubular member 12 so that the axial direction of the silencer 22 is a depth direction. The length of a cavity portion 30 of the silencer 22 (cylinder length) is set to 42 mm. The width of the cavity portion 30 is set to 37 mm. The opening portion 32 is disposed in the shape of a slit in the peripheral direction of the tubular member 12. The opening portion 32 is formed on the incident side (the left side in FIG. 26) in the axial direction. A porous sound-absorbing material 24 is disposed over the entire region of the cavity portion 30 of the silencer 22.

Further, a louver (cover member) is disposed at an opening portion of the tubular member 12 on which acoustic waves are to be incident, and a register (air volume-adjusting member) is disposed at an opening portion of the tubular member 12 from which acoustic waves are to be emitted.

The louver and the register are modeled using a commercially available louver and a commercially available register as references.

Furthermore, a simulation is performed about acoustic waves transmitted through the tubular member while the flow resistance $\sigma_1$ of the porous sound-absorbing material 24 and the width of the opening portion are changed to various values. A transmission loss is calculated through the simulation from the sound pressure of acoustic waves that are transmitted through the tubular member and are propagated from one space (the left side in FIG. 26) to the other space (the right side in FIG. 26).

Figure 27:
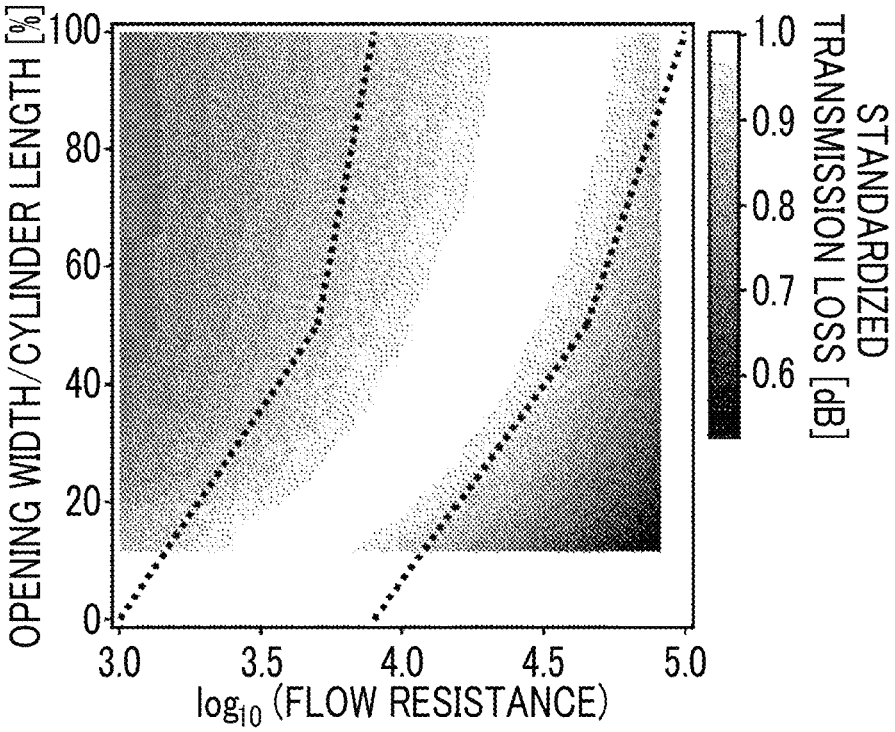
FIG. 27 is a graph showing a relationship among flow resistance, opening width/cylinder length, and a standardized transmission loss.

Results are shown in FIG. 27. FIG. 27 is a graph showing a relationship among flow resistance, opening width/cylinder length, and a standardized transmission loss. The standardized transmission loss is a value that is obtained in a case where a value where a transmission loss is maximum is standardized as 1.

It is found from FIG. 27 that flow resistance has an optimum range depending on opening width/cylinder length. A region inside dotted lines in FIG. 26 is a region where a standardized transmission loss is equal to or larger than about 0.8. In a case where this region is represented by an expression, it is preferable that "$(0.014\times K_{rate}+3.00)<\log \sigma_1<(0.015\times K_{rate}+3.9)$" is satisfied in the case of "$5\%<K_{rate}\leq 50\%$" and it is more preferable that "$(0.004\times K_{rate}+3.5)<\log \sigma_1<(0.007\times K_{rate}+4.3)$" is satisfied in the case of "$50\%<K_{rate}$".

The porous sound-absorbing material 24 is not particularly limited, and a sound-absorbing material publicly known in the related art can be appropriately used. For example, foamed materials, such as urethane foam, flexible urethane foam, wood, a ceramic particle-sintered material, and phenolic foam, and a material containing fine air; fiber, such as glass wool, rock wool, microfiber (Thinsulate manufactured by 3M Company, and the like), a floor mat, carpet, melt-blown nonwoven fabric, metal nonwoven fabric, polyester nonwoven fabric, metal wool, felt, an insulation board, and glass nonwoven fabric, and nonwoven fabric materials; a wood wool cement board; nanofiber materials, such as silica nanofiber; a gypsum board; and various publicly known sound-absorbing materials can be used.

Further, in a case where the sound-absorbing material is to be disposed in the cavity portion of the silencer, it is preferable that the shape of the sound-absorbing material is formed according to the shape of the cavity portion. Since the cavity portion is easily and uniformly filled with the sound-absorbing material in a case where the shape of the sound-absorbing material is formed according to the shape of the cavity portion, cost can be reduced and maintenance can be easily performed.

Furthermore, the silencing system includes one silencer 22 in the example shown in FIG. 19, but is not limited thereto. The silencing system may include two or more silencers 22. For example, as in a silencing system 10*f* shown in FIG. 28, two silencers 22 may be disposed on the outer peripheral surface of a tubular member 12 and may be connected to peripheral surface-opening portions 12*a* formed on the peripheral surface of the tubular member 12. Alternatively, two silencers 22 may be disposed in the tubular member 12.

In a case where the silencing system includes two or more silencers 22, it is preferable that the two or more silencers 22 are disposed so as to be rotationally symmetric with respect to the central axis of the tubular member 12.

Figure 29:
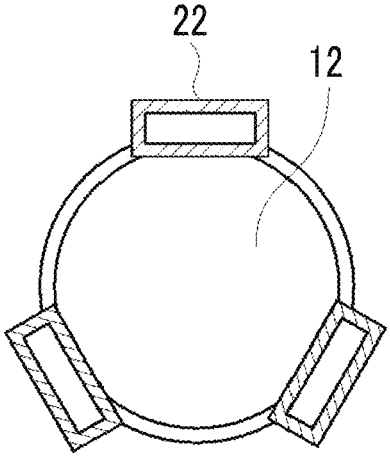
FIG. 29 is a cross-sectional view conceptually showing another example of the silencing system according to the first embodiment of the invention.

For example, as shown in FIG. 29, a silencing system may include three silencers 22 and the three silencers 22 may be disposed on the outer peripheral surface of the tubular member 12 at regular intervals in the peripheral direction so as to be rotationally symmetric. The number of silencers 22 is not limited to three, and for example, two silencers 22 may be disposed so as to be rotationally symmetric and four or more silencers 22 may be disposed so as to be rotationally symmetric.

Even in a case where silencers 22 are to be disposed in the tubular member 12, it is preferable that two or more silencers 22 are disposed so as to be rotationally symmetric.

Further, in a case where a plurality of silencers 22 are to be arranged on the outer peripheral surface of the tubular member 12 in the peripheral direction of the tubular member 12, the plurality of silencers 22 may be connected to each other. For example, as in an example shown in FIG. 30, eight silencers 22 may be connected to each other in the peripheral direction.

Even in a case where silencers 22 are to be disposed in the tubular member 12 and the plurality of silencers 22 are to be arranged on the inner peripheral surface of the tubular member 12 in the peripheral direction, the plurality of silencers 22 may be connected to each other.

Figure 28:
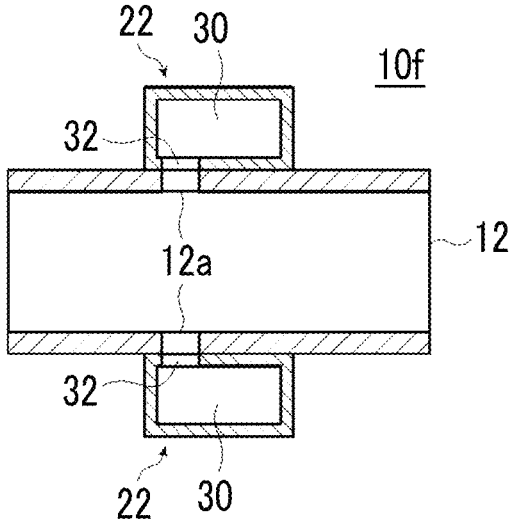
FIG. 28 is a cross-sectional view conceptually showing another example of the silencing system according to the first embodiment of the invention.
Figure 31:
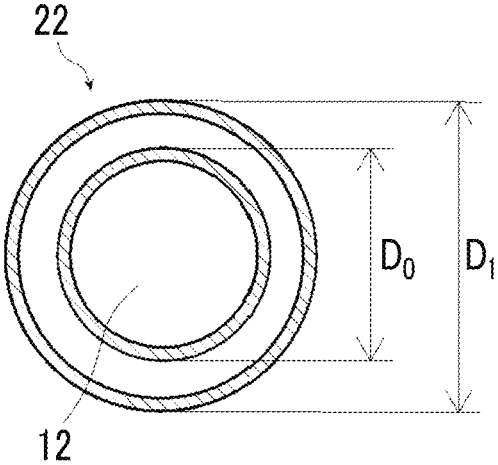
FIG. 31 is a cross-sectional view conceptually showing another example of the silencing system according to the first embodiment of the invention.

Furthermore, the silencer 22 has a substantially rectangular parallelepiped shape along the outer peripheral surface of the tubular member 12 in the example shown in FIG. 28, but is not limited thereto. The silencer 22 only has to have various three-dimensional shapes including a cavity portion. Alternatively, as shown in FIG. 31, the silencer 22 may have an annular shape along the entire outer peripheral surface of the tubular member 12 in the peripheral direction. In this case, the opening portion 32 is formed in the shape of a slit extending in the peripheral direction of the inner peripheral surface of the tubular member 12.

Even in a case where the silencer 22 is to be disposed in the tubular member 12, the silencer 22 may have an annular shape along the entire inner peripheral surface of the tubular member 12 in the peripheral direction.

Further, in a case where the silencer 22 is to be disposed on the outer peripheral surface of the tubular member 12, the outer diameter (effective outer diameter) of the silencer 22 obtained in a case where it is assumed that the silencer 22 covers the entire outer peripheral surface of the tubular member 12 in the peripheral direction is denoted by $D_1$, and the outer diameter (effective outer diameter) of the tubular member 12 is denoted by $D_0$ (see FIG. 31), it is preferable that "$D_1<D_0+2\times(0.045\times\lambda+5\text{ mm})$" is satisfied. The units of $D_1$, $D_0$, and $\lambda$ of the expression are mm. In other words, it is preferable that a cross-sectional area at a position where the silencer is disposed is larger than the cross-sectional area of the tubular member alone in a cross section perpendicular to the central axis of the tubular member.

Accordingly, since the real part and the imaginary part of a standardized effective modulus Bn of elasticity satisfy "$0<\mathrm{Re}[Bn]<1$" and "$\mathrm{Im}[Bn]>0$", high soundproof performance can be achieved while an increase in the size of the silencing system is suppressed.

The effective outer diameter is a circle equivalent diameter. In a case where the cross section of an element does not have a circular shape, the diameter of a circle having an area equal to the cross-sectional area of the element is defined as the effective outer diameter. Furthermore, in a case where the silencer 22 is to be disposed on the inner peripheral surface of the tubular member 12, the inner diameter of the silencer 22 obtained in a case where it is assumed that the silencer 22 covers the entire inner peripheral surface of the tubular member 12 in the peripheral direction is denoted by $D_2$, and the inner diameter of the tubular member 12 is denoted by Do, it is preferable that "$0.75 \times D_0 < D_2$" is satisfied.

Accordingly, high soundproof performance can be achieved while ventilation performance is ensured through the suppression of an increase in the size of the silencing system.

Figure 30:
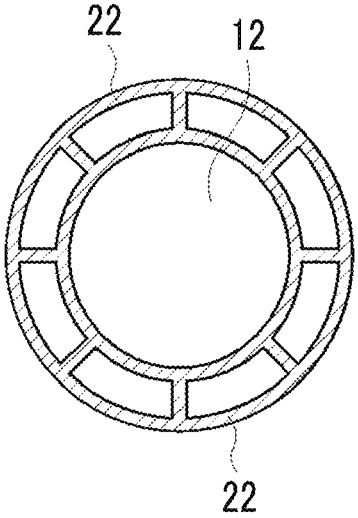
FIG. 30 is a cross-sectional view conceptually showing another example of the silencing system according to the first embodiment of the invention.

Further, the silencing system has configuration where the plurality of silencers 22 are arranged in the peripheral direction of the tubular member 12 in the examples shown in FIGS. 28 to 30, but is not limited thereto. The plurality of silencers 22 may be arranged in the axial direction of the tubular member 12. In other words, the opening portions 32 of the plurality of silencers 22 may be disposed on at least two or more positions in the axial direction of the tubular member 12.

Figure 32:
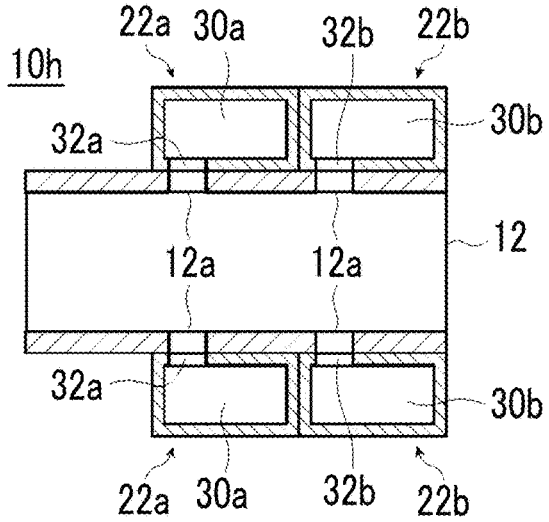
FIG. 32 is a cross-sectional view conceptually showing another example of the silencing system according to the first embodiment of the invention.

For example, a silencing system 10*h* shown in FIG. 32 includes silencers 22*a* that are connected to peripheral surface-opening portions 12*a* of a tubular member 12 at the substantially middle portion of the tubular member 12 in an axial direction and silencers 22*b* that are connected to peripheral surface-opening portions 12*a* near one end portion of the tubular member 12.

Further, two silencers are disposed even in the peripheral direction so as to be rotationally symmetric in the example shown in FIG. 32. In this way, two or more silencers may be disposed in each of the peripheral direction and the axial direction.

The silencing system has configuration where the two silencers are disposed in the axial direction in the example shown in FIG. 32, but is not limited thereto. Three or more silencers may be disposed in the axial direction.

Furthermore, in a case where a plurality of silencers are to be disposed in the axial direction, it is preferable that silencers of which cavity portions have different depths $L_d$ are disposed at the respective positions of opening portions.

Figure 33:
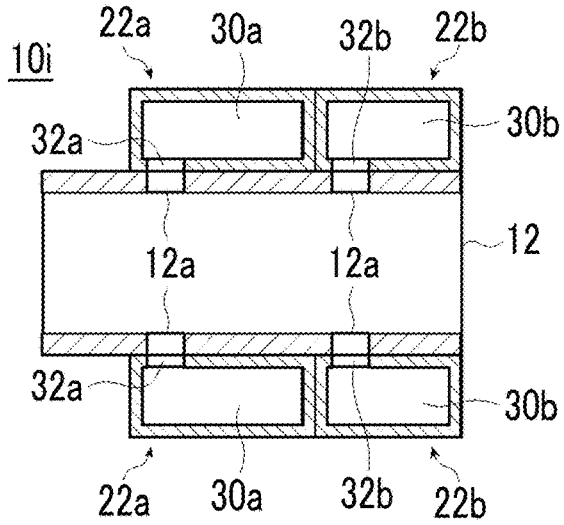
FIG. 33 is a cross-sectional view conceptually showing another example of the silencing system according to the first embodiment of the invention.

For example, a silencing system 10*i* shown in FIG. 33 includes silencers 22*a* that are connected to peripheral surface-opening portions 12*a* of a tubular member 12 at the substantially middle portion of the tubular member 12 in an axial direction and silencers 22*b* that are connected to peripheral surface-opening portions 12*a* near one end portion of the tubular member 12. The depth $L_d$ of a cavity portion 30*a* of each silencer 22*a* positioned at the middle portion and the depth $L_d$ of a cavity portion 30*b* of each silencer 22*b* positioned near one end portion are different from each other.

Further, in a case where a plurality of silencers are to be disposed in the axial direction, it is preferable that sound-absorbing materials having different acoustic characteristics are disposed in cavity portions at the respective positions of opening portions.

Figure 34:
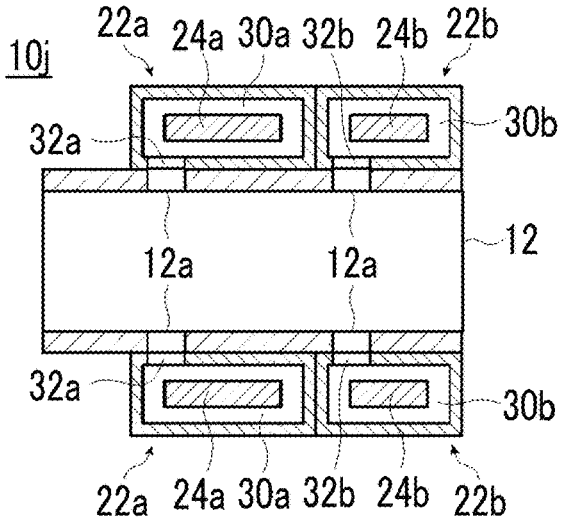
FIG. 34 is a cross-sectional view conceptually showing another example of the silencing system according to the first embodiment of the invention.

For example, a silencing system 10*j* shown in FIG. 34 includes silencers 22*a* that are connected to peripheral surface-opening portions 12*a* of a tubular member 12 at the substantially middle portion of the tubular member 12 in an axial direction and silencers 22*b* that are connected to peripheral surface-opening portions 12*a* near one end portion of the tubular member 12. A porous sound-absorbing material 24*a* is disposed in a cavity portion 30*a* of each silencer 22*a* positioned at the middle portion, and a porous sound-absorbing material 24*b* is disposed in a cavity portion 30*b* of each silencer 22*b* positioned near one end portion. The sound absorption characteristics of the porous sound-absorbing material 24*a* and the sound absorption characteristics of the porous sound-absorbing material 24*b* are different from each other.

A wavelength at which sound can be suitably silenced is changed depending on a position where the silencer (opening portion) is disposed in the axial direction in the silencing system according to the embodiment of the invention. Accordingly, since sound in different wavelength ranges can be silenced in a case where a plurality of silencers are disposed in the axial direction, sound can be silenced in a wider band. Further, in a case where the depth La of the cavity portion and the sound absorption characteristics of the sound-absorbing material are adjusted according to a wavelength where sound can be suitably silenced at each of the positions of the opening portions in the axial direction, sound can be more suitably silenced.

Furthermore, the cavity portion 30 of each silencer 21 has a depth $L_d$ from the opening portion in the radial direction in the example shown in FIG. 18 and the cavity portion 30 of the silencer 22 has a depth $L_d$ from the opening portion 32 in the axial direction in the example shown in FIG. 19, but the cavity portion 30 is not limited thereto. The cavity portion 30 may have a depth from the opening portion 32 in the peripheral direction.

Figure 35:
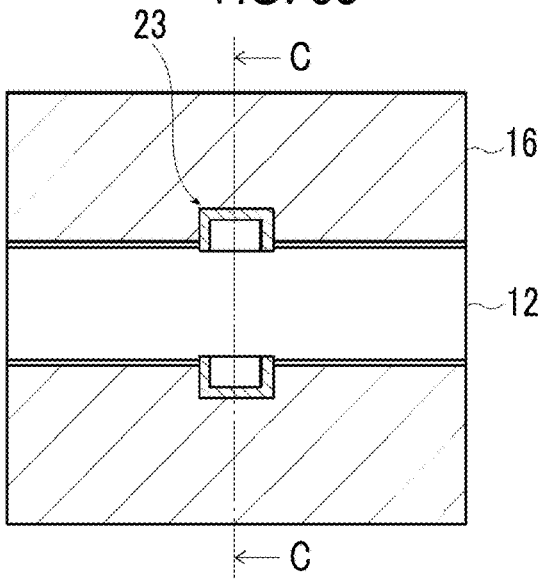
FIG. 35 is a cross-sectional view conceptually showing another example of the silencing system according to the first embodiment of the invention.
Figure 36:
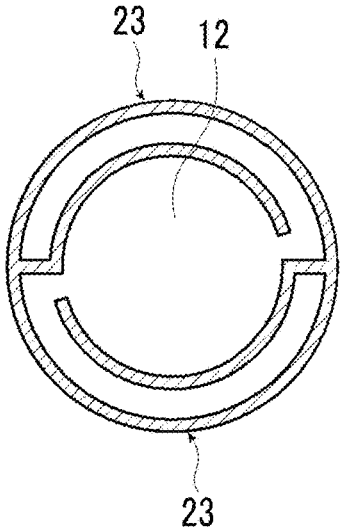
FIG. 36 is a cross-sectional view taken along line C-C of FIG. 35.

FIG. 35 is a cross-sectional view schematically showing another example of the silencing system according to the embodiment of the invention, and FIG. 36 is a cross-sectional view taken along line C-C of FIG. 35.

In a silencing system shown in FIGS. 35 and 36, two silencers 23 are disposed along the outer peripheral surface of a tubular member 12. A cavity portion 30 of each silencer 23 extends from an opening portion 32 in the peripheral direction of the tubular member 12. That is, each silencer 23 has a depth from the opening portion 32 in the peripheral direction.

According to this configuration, the length of the silencer in the axial direction can be shortened.

The silencing system includes the two silencers 23 in the example shown in FIG. 36, but is not limited thereto. The silencing system may include three or more silencers 23.

Figure 37:
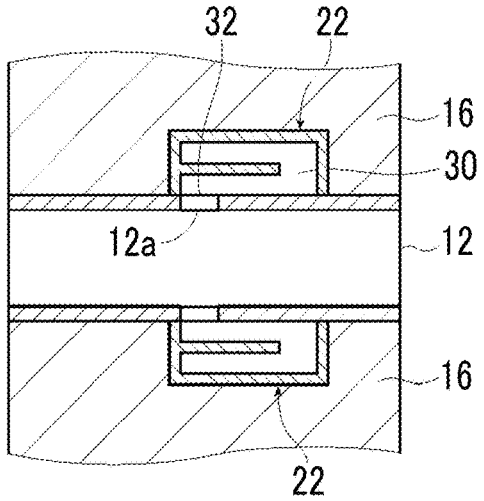
FIG. 37 is a cross-sectional view conceptually showing another example of the silencing system according to the first embodiment of the invention.

Further, the depth of the cavity portion 30 of the silencer 22 extends in one direction in the example shown in FIG. 19, but is not limited thereto. For example, the shape of a cavity portion 30 may be a substantially C shape where a depth direction is folded as shown in FIG. 37. After acoustic waves entering the cavity portion 30 shown in FIG. 37 travel from an opening portion 32 to the right side in FIG. 37, the acoustic waves are then folded and travel to the left side in FIG. 37. Since the depth $L_d$ of the cavity portion 30 is a length in the traveling direction of acoustic waves, the depth $L_d$ of the cavity portion 30 shown in FIG. 37 is a length corresponding to a folded shape.

Here, the silencing system according to the embodiment of the invention may have configuration where a part of a silencing device including a silencer and an insertion part is inserted into and disposed in a tubular member (ventilation sleeve).

Figure 38:
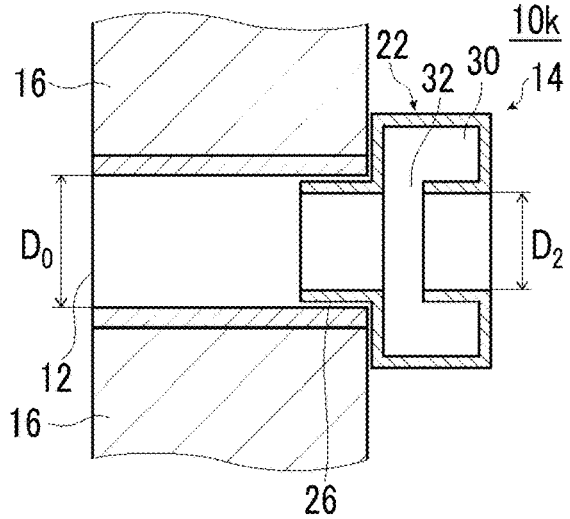
FIG. 38 is a cross-sectional view conceptually showing another example of the silencing system according to the first embodiment of the invention.

FIG. 38 is a schematic cross-sectional view showing another example of the silencing system according to the embodiment of the invention.

A silencing system 10*k* shown in FIG. 38 has configuration where a silencing device 14 silencing sound passing through a tubular member 12 is installed on one end face side of the tubular member 12.

The silencing device 14 includes an insertion part 26 and a silencer 22. The insertion part 26 is a cylindrical member of which both ends are open, and the silencer 22 is connected to one end face of the insertion part 26. Further, since the outer diameter of the insertion part 26 is smaller than the inner diameter of the tubular member 12, the insertion part 26 can be inserted into the tubular member 12.

The silencer 22 has the same configuration as the above-mentioned L-shaped silencer 22 except that the silencer 22 is disposed at the end face of the insertion part 26. Further, the silencer 22 is disposed along the peripheral surface of the insertion part 26 so as not to close the inner hole of the insertion part 26. Furthermore, the silencer 22 is disposed so that an opening portion 32 of the silencer 22 faces the central axis of the insertion part 26 (the central axis of the tubular member 12). The central axis of the insertion part 26 is an axis passing through the centroid of the cross section of the insertion part 26.

The end face of the insertion part 26 where the silencer 22 is not disposed is inserted into the tubular member 12, so that the silencing device 14 is installed. Since the effective outer diameter of the silencer 22 is larger than the inner diameter of the tubular member 12, the insertion part 26 is inserted into the tubular member 12 up to a position where the silencer 22 is in contact with the end face of the tubular member 12. Accordingly, the silencer 22 is disposed near the open end face of the tubular member 12. That is, the opening portion 32 of the silencer 22 is disposed in a space within the open-end correction distance of the tubular member 12. Accordingly, the opening portion 32 of the silencer 22 is connected to the sound field space of the first resonance of the tubular member 12.

Since the silencing device including the silencer and the insertion part is adapted to be inserted into and installed on the tubular member in this way, the silencing device can be easily installed on an existing ventilation port, an existing air-conditioning duct, and the like without large-scale work or the like. Accordingly, the replacement of the silencer can be easily performed in a case where the silencer deteriorates or is damaged. Further, since the diameter of a through-hole of a concrete wall does not need to be changed in a case where the silencing device is to be used for a ventilation sleeve of a house or the like, the silencing device is easily mounted. Furthermore, the silencing device is easily additionally installed in a case where a renovation is to be made.

Further, the wall of a house, such as a mansion, includes, for example, a concrete wall, a gypsum board, a heat insulating material, a decorative plate, wallpaper, and the like, and a ventilation sleeve is provided so as to penetrate these. In a case where the silencing device 14 shown in FIG. 38 is to be installed on the ventilation sleeve of this wall, it is preferable that the wall 16 of the invention corresponds to the concrete wall and the silencer 22 of the silencing device 14 is installed on the outside of the concrete wall and installed between the concrete wall and the decorative plate (see FIG. 43).

In the example shown in FIG. 38, the silencing system 10*k* has configuration where the insertion part 26 of the silencing device 14 is inserted into the tubular member 12, so that the silencing device 14 is disposed at the opening portion of the tubular member 12. However, the silencing system 10*k* is not limited thereto.

For example, a silencing device 14 may be adapted to be attached to the wall 16 by an adhesive or the like without including an insertion part.

Figure 39:
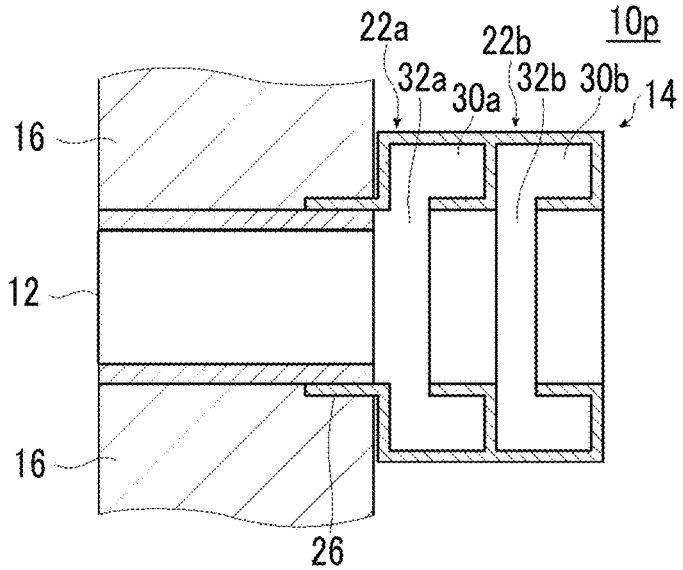
FIG. 39 is a cross-sectional view conceptually showing another example of the silencing system according to the first embodiment of the invention.

Alternatively, as in a silencing system 10*p* shown in FIG. 39, the inner diameter of an insertion part 26 of a silencing device 14 may be set to a diameter substantially equal to the outer diameter of a tubular member 12 disposed in the wall 16 and the tubular member 12 may be inserted into the insertion part 26 of the silencing device 14 so that the silencing device 14 is installed. The insertion part 26 is disposed between the tubular member 12 and the wall 16.

Alternatively, the inner diameter of an insertion part 26 of a silencing device 14 may be set to be larger than the outer diameter of a tubular member 12 and the insertion part 26 may be disposed in the wall 16.

According to the configuration shown in FIG. 39, a reduction in an opening ratio caused by the insertion of the insertion part 26 into the tubular member 12 can be suppressed. Accordingly, the ventilation performance of the tubular member 12 can be improved.

In a case where the insertion part 26 is disposed in the wall 16 as shown in FIG. 39, a groove in which the insertion part 26 is to be disposed may be formed in the wall 16 according to the size and shape of the insertion part 26. Alternatively, in a case where the wall 16 is to be produced, concrete may be poured to produce the wall 16 in a state where the silencing device 14 (and the tubular member 12) is installed in advance.

The silencing device 14 includes the L-shaped silencer 22 in the example shown in FIG. 38, but is not limited thereto. The silencing device 14 may include the vertical cylinder type silencer 21 or may include the silencer 23 having a depth in the peripheral direction.

Even in the silencing device 14 of the silencing system 10*k* shown in FIG. 38, it is preferable that a porous sound-absorbing material 24 is disposed in the cavity portion 30 or near the opening portion 32.

Further, it is preferable that the silencing device 14 includes a plurality of silencers 22.

In a case where the silencing device 14 includes a plurality of silencers 22, the silencers 22 may be disposed at regular intervals in the peripheral direction so as to be rotationally symmetric.

Figure 40:
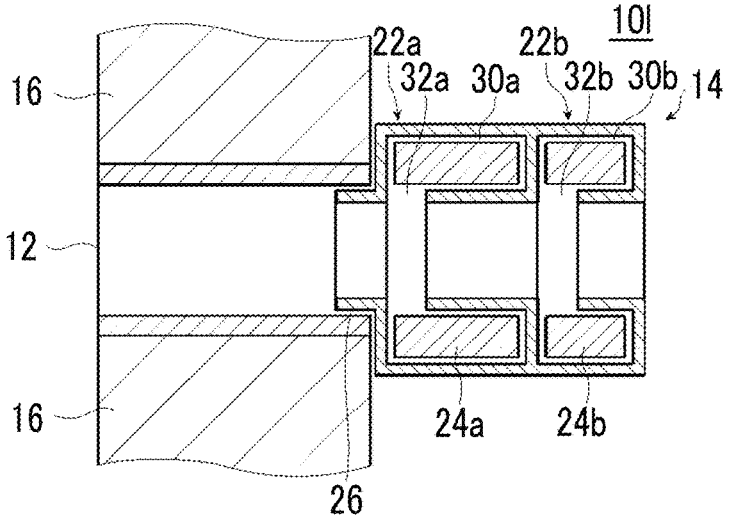
FIG. 40 is a cross-sectional view conceptually showing another example of the silencing system according to the first embodiment of the invention.

Alternatively, as in a silencing system 10*l* shown in FIG. 40, a silencing device 14 may include a plurality of silencer 22 in the axial direction and opening portions 32 of the plurality of silencers 22 may be disposed on at least two or more positions in the axial direction.

Furthermore, in a case where a plurality of silencers are to be disposed in the axial direction, it is preferable that silencers having different depths La of the cavity portions are disposed at the respective positions of the opening portions.

For example, a silencing device shown in FIG. 40 includes a silencer 22*a* and a silencer 22*b* in this order from an insertion part 26 in an axial direction. The depth $L_a$ of a cavity portion 30*a* of the silencer 22*a* and the depth $L_a$ of a cavity portion 30*b* of the silencer 22*b* are different from each other.

Further, in a case where a plurality of silencers are to be disposed in the axial direction, it is preferable that sound-absorbing materials having different acoustic characteristics are disposed in cavity portions at the respective positions of opening portions.

For example, a silencing device shown in FIG. 40 includes a silencer 22*a* and a silencer 22*b* in this order from an insertion part 26 in an axial direction. A porous sound-absorbing material 24*a* is disposed in a cavity portion 30*a* of the silencer 22*a*, and a porous sound-absorbing material 24*b* is disposed in a cavity portion 30*b* of the silencer 22*b*. The sound absorption characteristics of the porous sound-absorbing material 24*a* and the sound absorption characteristics of the porous sound-absorbing material 24*b* are different from each other.

Furthermore, in a case where a sound-absorbing material is to be disposed in a cavity portion of a silencer, a plurality of sound-absorbing materials may be disposed in one cavity portion.

Figure 41:
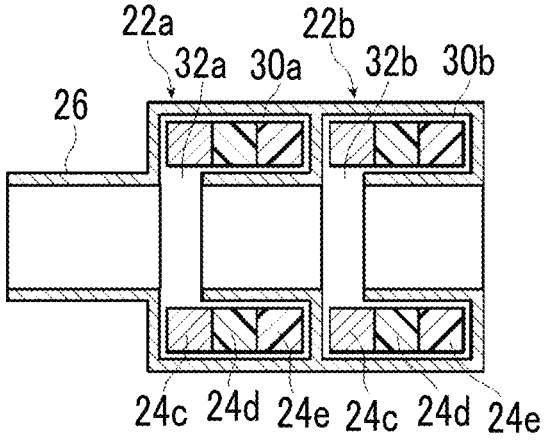
FIG. 41 is a cross-sectional view conceptually showing another example of a silencing device.

A silencing device shown in FIG. 41 includes a silencer 22*a* and a silencer 22*b* in this order from an insertion part 26 in an axial direction. Three porous sound-absorbing materials 24*c*, 24*d*, and 24*e* are disposed in each of a cavity portion 30*a* of the silencer 22*a* and a cavity portion 30*b* of the silencer 22*b*. In each cavity portion, the porous sound-absorbing materials 24*c* to 24*e* are laminated in the depth direction of the cavity portion.

Since the plurality of sound-absorbing materials are disposed in the cavity portion, the cavity portion is easily filled with the sound-absorbing materials from the opening portion in a case where the silencing device is to be manufactured and the sound-absorbing materials are easily replaced in a case where maintenance is to be performed.

Further, it is more preferable that a sound-absorbing material molded according to the shape of the cavity portion is divided into a plurality of pieces.

The plurality of porous sound-absorbing materials 24*c* to 24*e* disposed in the same cavity portion may be the same kind of sound-absorbing material, or at least one of the sound-absorbing materials may be a different kind of sound-absorbing material, that is, may be a sound-absorbing material having different sound absorption performance (flow resistance, a material, structure, or the like).

In a case where a plurality of different kinds of sound-absorbing materials are disposed in the cavity portion, silencing performed by the silencer is easily controlled to sound absorption performance suitable for the shape of the silencer (cavity portion), sound as an object to be absorbed, or the like.

Figure 42:
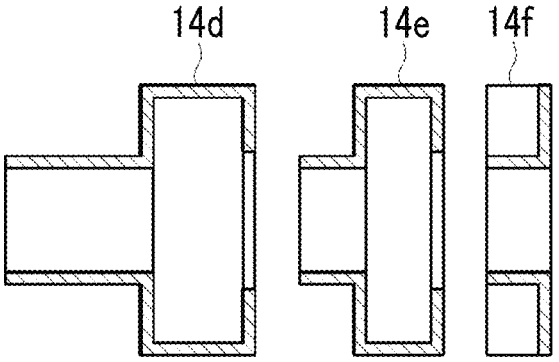
FIG. 42 is a cross-sectional view conceptually showing another example of the silencing device.

For example, a silencing device may be adapted so that silencers can be separated as shown in FIG. 42. In a case where the silencers can be separated, silencers of which the sizes, the number, and the like are changed are easily produced. Furthermore, the installation of the sound-absorbing material in the cavity portion and the replacement of the sound-absorbing material are easily performed.

For example, a distance between a concrete wall and a decorative plate varies, and varies depending on a position even in the same mansion or varies depending on a construction company. In a case where a silencing device is designed and produced on each occasion depending on a distance between the concrete wall and the decorative plate, it takes cost. Further, in a case where a silencing device is designed thin to be capable of being applied to all distances, soundproof performance is lowered. Accordingly, since a plurality of separated silencers can be appropriately combined and installed depending on a distance between the concrete wall and the decorative plate in a case where a silencing device is to be installed between the concrete wall and the decorative plate, soundproof performance can be maximized at low cost.

Furthermore, it is preferable that a silencing device 14 is attachably and detachably installed on the tubular member 12. Accordingly, the replacement, reform, and the like of the silencing device 14 can be easily performed.

Further, the silencing device 14 may be installed on any of the interior-side end face and the exterior-side end face of the tubular member 12, and it is preferable that the silencing device 14 is installed on the interior-side end face.

Furthermore, the silencing system may include at least one of a cover member that is installed on one end face of the tubular member or an air volume-adjusting member that is installed on the other end face thereof. The cover member is a louver or the like that is publicly known in the related art and is installed on a ventilation port, an air-conditioning duct, and the like. Further, the air volume-adjusting member is a register, which is publicly known in the related art, or the like.

Furthermore, the cover member and the air volume-adjusting member may be installed on the end face of the tubular member where the silencing device is installed, or may be installed on the end face of the tubular member where the silencing device is not installed.

Figure 43:
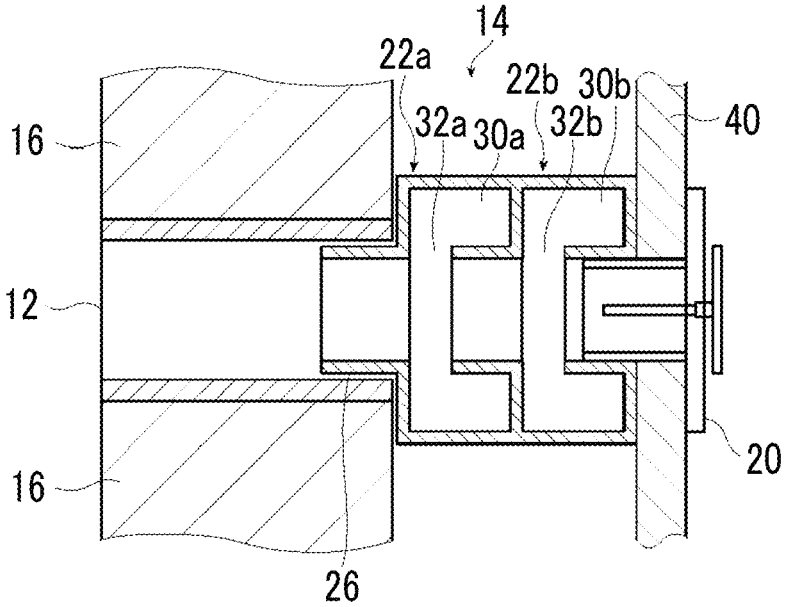
FIG. 43 is a cross-sectional view conceptually showing another example of the silencing system according to the first embodiment of the invention.

For example, in a case where an air volume-adjusting member 20 is to be installed on the silencing device 14 as shown in FIG. 43, it is preferable that the air volume-adjusting member 20 is installed so as to cover the entire silencing device 14 as seen in the axial direction. The same applies to a case where the cover member is installed on the silencing device 14.

The fact that the silencing system may include a cover member and an air volume-adjusting member is the same even in other embodiments.

Figure 44:
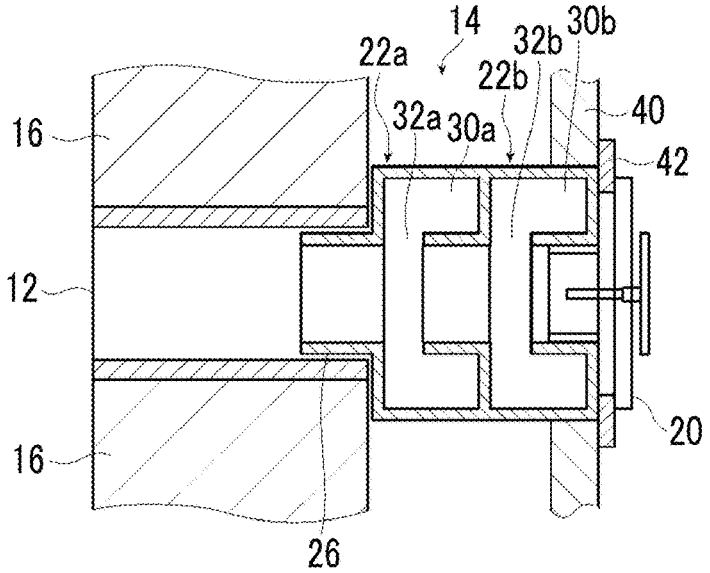
FIG. 44 is a cross-sectional view conceptually showing another example of the silencing system according to the first embodiment of the invention.

Here, in a general house, such as a mansion, a concrete wall and a decorative plate are installed so as to be spaced from each other and a heat insulating material and the like are disposed between the concrete wall and the decorative plate. It is preferable that the silencing device 14 is installed in a space between the concrete wall and the decorative plate. In this case, as shown in FIG. 43, the silencing device 14 may be adapted so that an end face of the silencing device 14 facing the decorative plate 40 is disposed closer to the wall 16 than the surface of the decorative plate 40 facing the tubular member 12. Alternatively, as shown in FIG. 44, the silencing device 14 may be adapted so that an end face of the silencing device 14 facing the decorative plate 40 is disposed so as to be flush with the surface of the decorative plate 40 opposite to the tubular member 12. That is, the diameter of a through-hole formed in the decorative plate 40 may be set to be substantially equal to the outer diameter of the silencing device 14 and the silencing device 14 may be inserted into the through-hole of the decorative plate 40. The silencing device 14 is adapted in the example shown in FIG. 44 so that the end face of the silencing device 14 facing the decorative plate 40 and the surface of the decorative plate 40 opposite to the tubular member 12 are flush with each other, but is not limited thereto. A part of the silencing device 14 may be present on a plane where the decorative plate 40 is positioned.

In a case where the silencing device 14 is adapted to be inserted into the through-hole of the decorative plate 40, the installation, replacement, and the like of the silencing device are easy.

The silencing performance of the silencer 22 is higher as the size of the silencer 22 of the silencing device 14 is larger.

Figure 45:
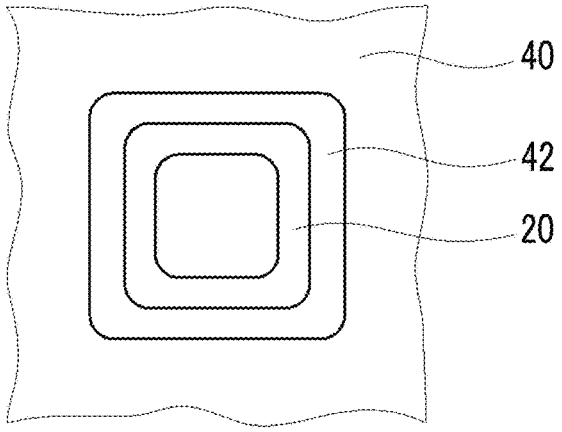
FIG. 45 is a diagram of the silencing system of FIG. 44 viewed from an air volume-adjusting member side.

Here, in a case where the silencing device 14 is adapted so that the end face of the silencing device 14 facing the decorative plate 40 is disposed so as to be flush with the surface of the decorative plate 40 opposite to the tubular member 12 as shown in FIG. 44, there is a concern that the through-hole (a boundary between the silencing device 14 and the decorative plate 40) formed in the decorative plate 40 may be visually recognized from the interior even though the air volume-adjusting member 20, such as a register, is installed on the decorative plate 40 side in a case where the size of the silencer 22 is large. Therefore, it is preferable that a boundary cover 42 is installed between the air volume-adjusting member 20 and the decorative plate 40 and the silencing device 14 as shown in FIG. 44. Accordingly, since the through-hole of the decorative plate 40 is hidden by the boundary cover 42 as shown in FIG. 45 as seen from the interior side (the air volume-adjusting member 20 side), design can be enhanced.

The silencing device 14 and the boundary cover 42 are formed of separate members in the example shown in FIG. 44, but the silencing device 14 and the boundary cover 42 may be integrally formed. That is, the silencing device 14 may be provided with a flange.

Figure 46:
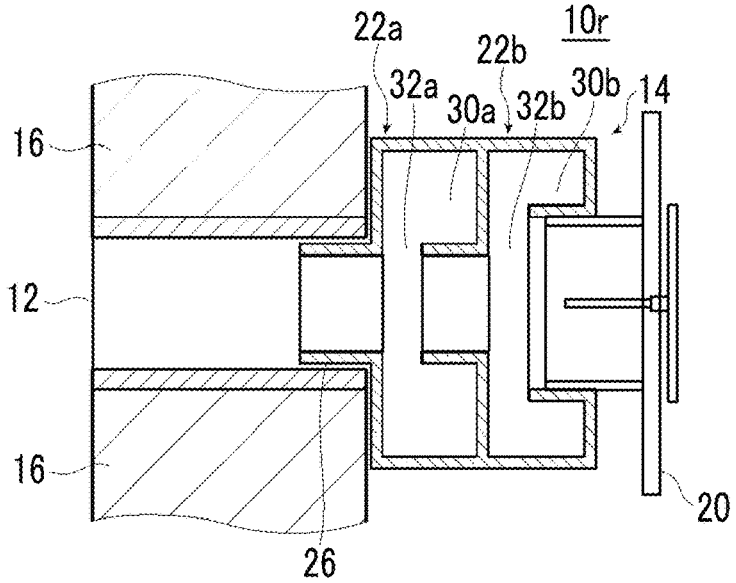
FIG. 46 is a cross-sectional view conceptually showing another example of the silencing system according to the first embodiment of the invention.

Further, the inner diameter of the silencing device 14 is constant at a diameter substantially equal to the diameter of the tubular member 12 in the examples shown in FIG. 43 and the like, but is not limited thereto. As in a silencing system 10*r* shown in FIG. 46, the inner diameter of a silencer 22 may be set to be larger than the inner diameter of an insertion part 26, that is, larger than the inner diameter of a tubular member 12.

In a case where the inner diameter of the silencer 22 is set to be larger than the inner diameter of the tubular member 12, a large air volume-adjusting member 20 for a tubular member having a diameter larger than the diameter of the tubular member 12 can be used. In a case where the large air volume-adjusting member 20 is used, the through-hole of the decorative plate 40 is hidden by the air volume-adjusting member 20. Accordingly, design can be enhanced.

Furthermore, the silencing device 14 and the air volume-adjusting member 20 may be integrated with each other.

As shown in FIG. 43 and the like, the air volume-adjusting member 20, such as a commercially available register, includes an insertion portion and is installed through the insertion of the insertion portion into the silencing device 14. However, since the length of the insertion portion of the commercially available register is set to about 5 cm for the ensuring of stiffness and sealability in a case where the register is to be connected, there is a concern that the design of the silencing device 14 may be limited. In contrast, in terms of an increase in the degree of freedom in the design of the silencing device 14 and the simplification of construction, it is preferable that the silencing device 14 and the air volume-adjusting member 20 are integrated with each other.

In a case where the silencing system includes the cover member and the air volume-adjusting member, first resonance occurring in the tubular member is the first resonance of the tubular member of the silencing system that includes the cover member, the air volume-adjusting member, and the silencing device. Accordingly, the depth $L_d$ of the cavity portion of the silencer is shorter than ¼ of the wavelength λ of an acoustic wave at the resonant frequency of the first resonance of the tubular member of the silencing system that includes the cover member, the air volume-adjusting member, and the silencing device.

Further, in the examples shown in FIG. 43 and the like, the silencing device 14 is disposed so that the central axis of the silencing device 14 coincides with the central axis of the tubular member 12, that is, the silencing device 14 is formed in a shape rotationally symmetric with respect to the central axis of the tubular member 12. However, the silencing device 14 is not limited thereto.

Figure 47:
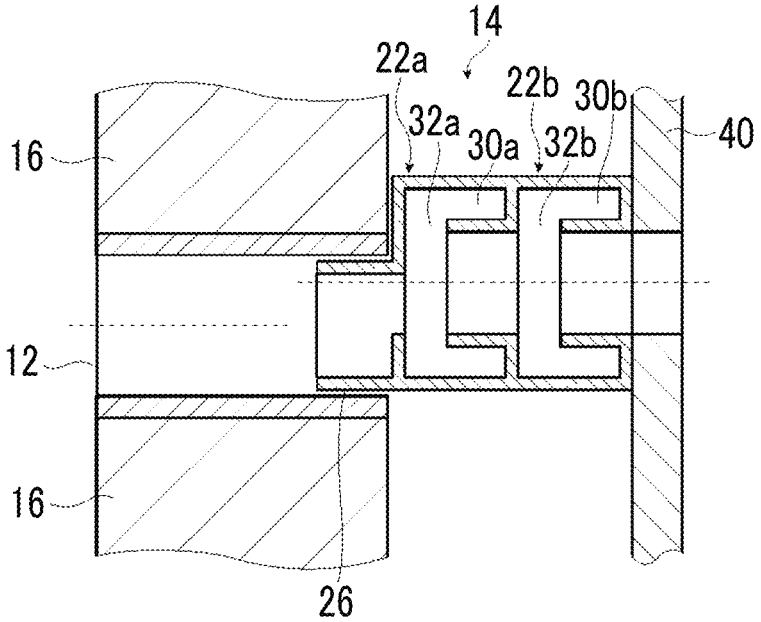
FIG. 47 is a cross-sectional view conceptually showing another example of the silencing system according to the first embodiment of the invention.

As in a silencing system shown in FIG. 47, a silencing device 14 may be disposed so that the central axis of the silencing device 14 is shifted from the central axis of a tubular member 12 in a direction perpendicular to the central axis.

Configuration where the central axis of the silencing device 14 and the central axis of the tubular member 12 coincide with each other is preferable in terms of ventilation performance. On the other hand, in a case where the central axis of the silencing device 14 and the central axis of the tubular member 12 are shifted from each other, the reflection of sound is increased. For this reason, in terms of the improvement of soundproof performance, it is preferable that the central axis of the silencing device 14 and the central axis of the tubular member 12 are shifted from each other. Particularly, this is effective in a high-frequency region where straightness is high.

In a case where the silencing device is disposed so that the central axis of the silencing device 14 is shifted from the central axis of the tubular member 12 in a direction perpendicular to the central axis, it is preferable that the other space side can be visually recognized from one space side through the ventilation sleeve as seen in a direction perpendicular to the wall. That is, it is preferable that at least a part of a space which can be ventilated in a ventilation sleeve in which the silencer is disposed, that is, a ventilation flue is positioned on a straight line in a plane direction of the cross section perpendicular to the central axis of the ventilation sleeve. Accordingly, a pressure loss caused by the bending of the ventilation flue can be reduced.

Further, it is preferable that the shortest distance between one space side and the other space side in the ventilation sleeve in which the silencer is disposed is 1.9 times or less the thickness of the wall.

Here, the thickness of a wall for a house, that is, the total thickness of a concrete wall and a decorative plate including a space between the concrete wall and the decorative plate (hereinafter, also referred to as the total thickness of the wall and the decorative plate) is in the range of about 175 mm to 400 mm. Accordingly, the length of a ventilation sleeve (annular member) to be used for a house is in the range of 175 mm to 400 mm. The first resonant frequency of resonance occurring in a ventilation sleeve having a length in this range is in the range of about 355 Hz to 710 Hz.

Considering the soundproofing of a ventilation sleeve to be used for a wall for a house, the total thickness of the concrete wall and the decorative plate, that is, the length of the ventilation sleeve is in the range of 175 mm to 400 mm. Accordingly, considering a case where the wavelength of the first resonance of the ventilation sleeve is shortest (λ is 497 mm in a case where the length of the ventilation sleeve is 175 mm), in terms of obtaining sufficient soundproof performance, the width $L_w$ of the cavity portion is preferably 5.5 mm or more, more preferably 15 mm or more, and still more preferably 25 mm or more.

The total thickness of the wall for a house (the total thickness of a concrete wall and a decorative plate) is 400 mm at the maximum and the thickness of the concrete wall is at least 100 mm. Accordingly, in terms of the fact that the cavity portion can be disposed in a space between the concrete wall and the decorative plate of a house, the width $L_w$ of the cavity portion is preferably 300 mm or less. In terms of general-purpose properties in addition to this, the width $L_w$ of the cavity portion is more preferably 200 mm or less and still more preferably 150 mm or less.

Likewise, considering a case where the wavelength of the first resonance of the ventilation sleeve is shortest (λ is 497 mm in a case where the length of the ventilation sleeve is 175 mm), in terms of obtaining sufficient soundproof performance, the depth $L_d$ of the cavity portion is preferably 25.3 mm or more, more preferably 27.8 mm or more, and still more preferably 30.3 mm or more.

Meanwhile, the silencer is disposed between the columns of a house in a radial direction. A distance between the columns of a house is about 450 mm at the maximum, and the length of the ventilation sleeve is at least about 100 mm. Accordingly, in terms of the fact that the cavity portion can be disposed in a space between the columns of a house, the depth $L_d$ of the cavity portion is preferably 175 mm or less (=(450 mm−100 mm)/2), more preferably 130 mm or less, and still more preferably 100 mm or less.

Further, in a case where a porous sound-absorbing material is to be disposed in a part of the cavity portion 30 of the silencer 22, it is preferable that the porous sound-absorbing material is disposed so as to cover the opening portion 32 or so as to narrow the opening portion 32. That is, it is preferable that the sound-absorbing material is disposed in the cavity portion 30 at a position close to the opening portion 32. Further, it is preferable that the sound-absorbing material is disposed at a position spaced from the end face of the cavity portion 30 far from the opening portion 32 in a depth direction.

A difference in soundproof performance, which is caused by a difference in the position of the sound-absorbing material in the cavity portion 30, is examined through the following simulation.

Figure 48:
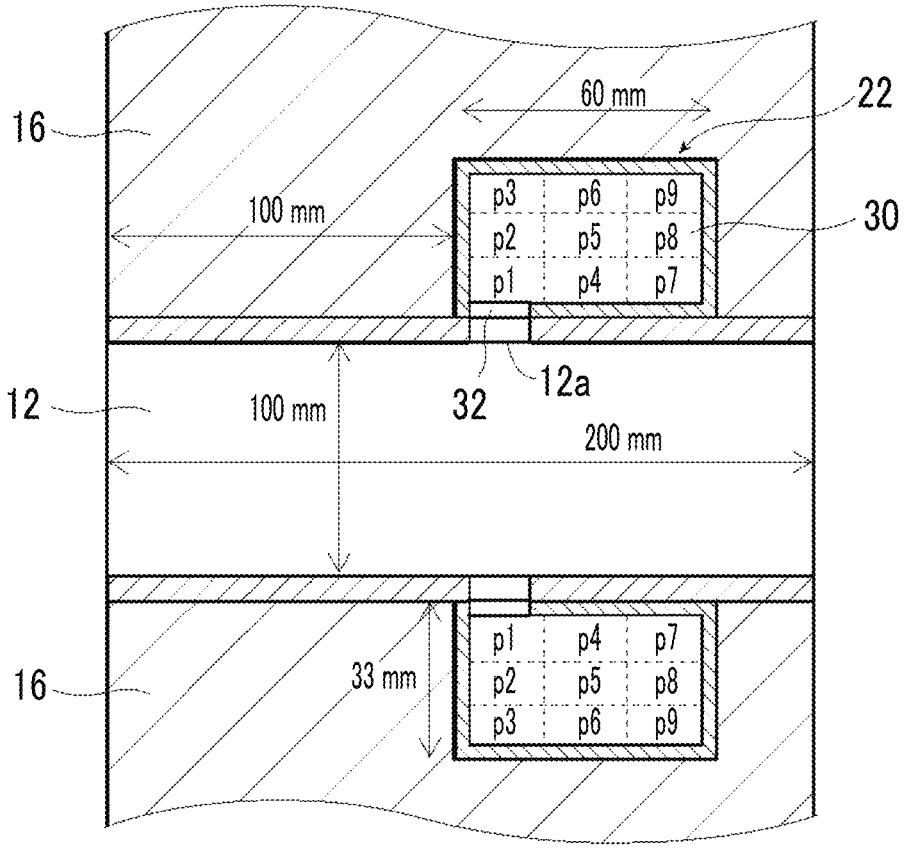
FIG. 48 is a schematic diagram of a simulation model.

FIG. 48 is a schematic diagram illustrating a simulation model.

As shown in FIG. 48, the length of a tubular member is set to 200 mm and the diameter of the tubular member is set to 100 mm in a simulation. A silencer 22 is installed in a tubular shape on the outer periphery of the tubular member 12. A distance between the silencer 22 and the end face of the tubular member 12 on which acoustic waves are to be incident in an axial direction is set to 100 mm. An opening portion 32 of the silencer 22 is disposed in the shape of a slit in the peripheral direction of the tubular member. The width of the opening portion 32 is set to 15 mm. The length of a cavity portion 30 in the axial direction is set to 60 mm, and the width of the cavity portion 30 in a direction perpendicular to the axial direction is set to 33 mm.

A simulation is performed using a model where the inner region of the cavity portion 30 is divided into nine regions as seen in a certain cross section parallel to the axial direction and a porous sound-absorbing material 24 having a flow resistance of 13000 [Pa·s/m$^2$] is disposed in each of the nine divided regions p1 to p9 as shown in FIG. 48. p1 denotes a region closest to the opening portion 32, p2 and p3 denote regions farther from the opening portion 32 than the region p1 in the radial direction. Further, p4 and p7 denote regions farther from the opening portion 32 than the region p1 in the axial direction. p5 and p8 denote regions farther from the opening portion 32 than the region p2 in the axial direction. p6 and p9 denote regions farther from the opening portion 32 than the region p3 in the axial direction.

Figure 49:
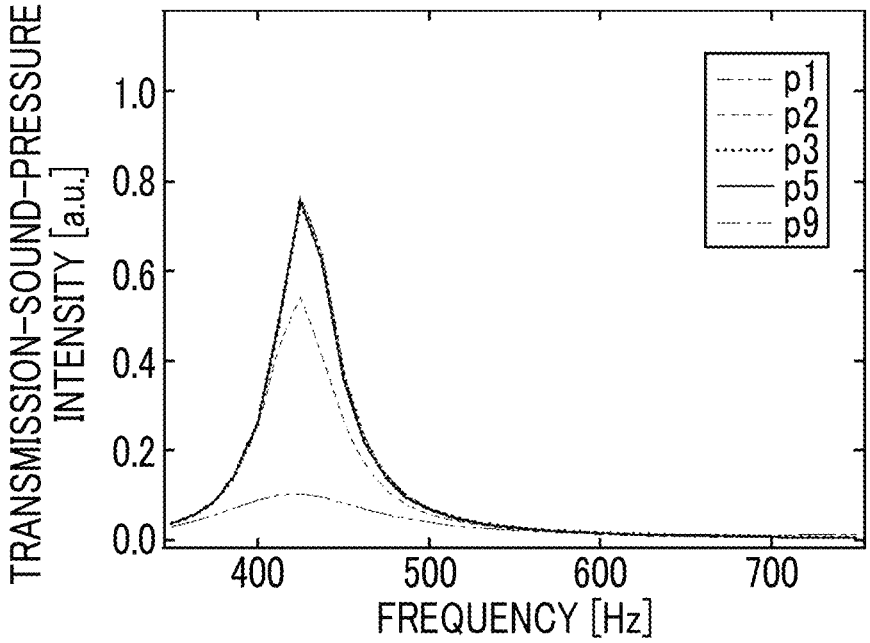
FIG. 49 is a graph showing a relationship between transmission-sound-pressure intensity and a frequency.

FIG. 49 is a graph showing a relationship between transmission-sound-pressure intensity and a frequency in a case where a sound-absorbing material is disposed in each of the regions p1, p2, p3, p5, and p9. With regard to transmission-sound-pressure intensity, the peak of transmission sound pressure, which is obtained in a case where the silencer is not installed, (transmission sound pressure at the first resonant frequency) is standardized as 1. Since the first resonant frequency in a tubular member in which a silencer is not installed is 630 Hz, transmission sound pressure at 630 Hz is peak sound pressure.

Figure 50:
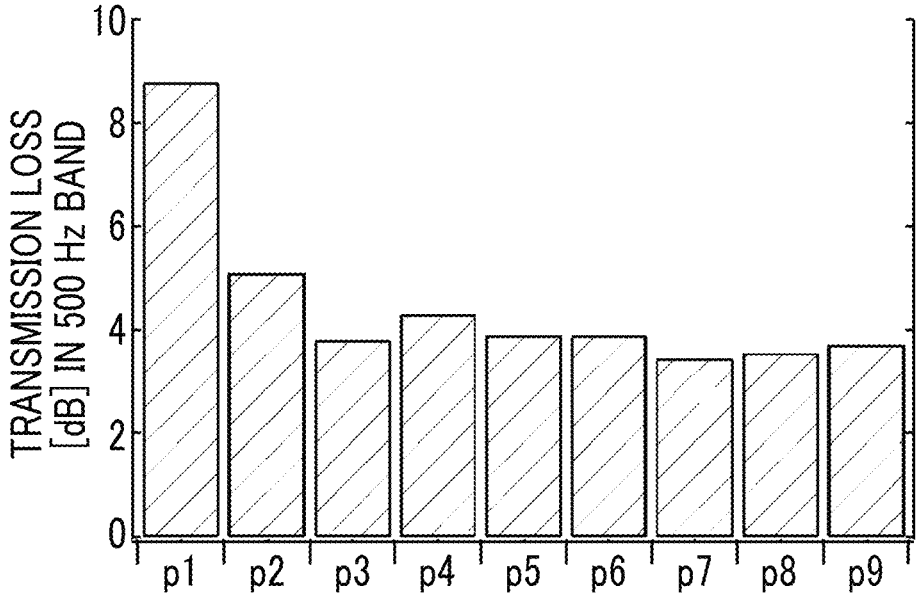
FIG. 50 is a graph showing a transmission loss in a 500 Hz band.

Further, FIG. 50 is a graph showing a transmission loss in a 500 Hz band in a case where a sound-absorbing material is disposed in each of the regions p1 to p9. A transmission loss in a 500 Hz band is an average value of transmission losses obtained at a frequency in the range of 354 Hz to 707 Hz.

As shown in FIGS. 49 and 50, it is found that transmission-sound-pressure intensity is lowest, a transmission loss in a 500 Hz band is highest, and soundproof performance is highest in the case of configuration where a sound-absorbing material is disposed in the region p1 closest to the opening portion 32, that is, configuration where the opening portion 32 is covered. Further, it is found that transmission-sound-pressure intensity is low, a transmission loss in a 500 Hz band is high, and soundproof performance is high as compared to the case of configuration where a sound-absorbing material is disposed in each of the other regions except for the region p1 in the case of configuration where a sound-absorbing material is disposed in each of the regions p2 and p4 close to the opening portion 32.

Figure 51:
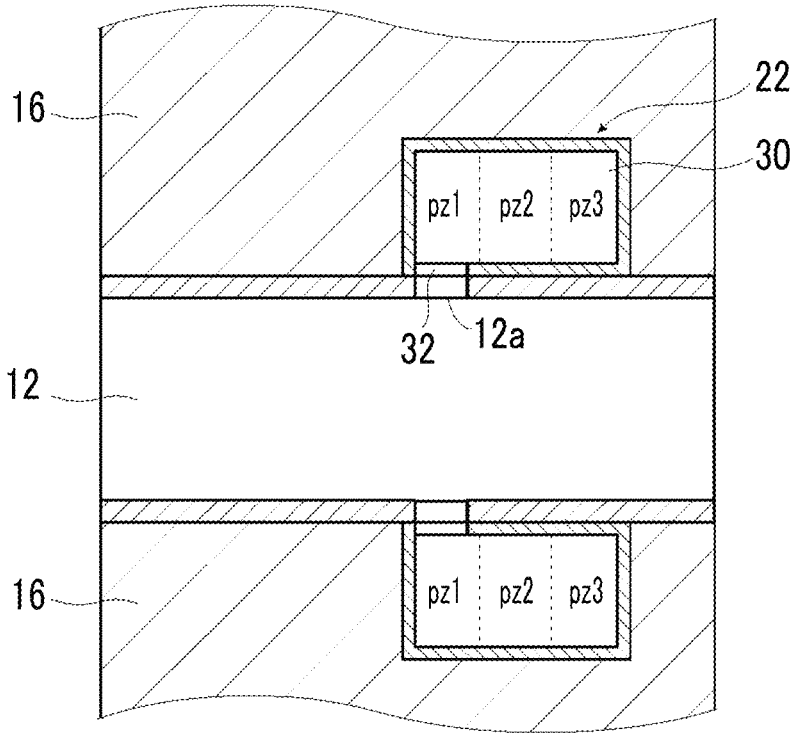
FIG. 51 is a schematic diagram illustrating a simulation model.

Next, a simulation is performed using a model where the inner region of the cavity portion 30 is divided into three regions in the axial direction as seen in a certain cross section parallel to the axial direction and a porous sound-absorbing material 24 having a flow resistance of 13000 [Pa·s/m$^2$] is disposed in each of the three divided regions pz1 to pz3 as shown in FIG. 51. pz1 denotes a region closest to the opening portion 32, and pz2 and pz3 denote regions farther from the opening portion 32 than the region pz1 in the axial direction.

Figure 52:
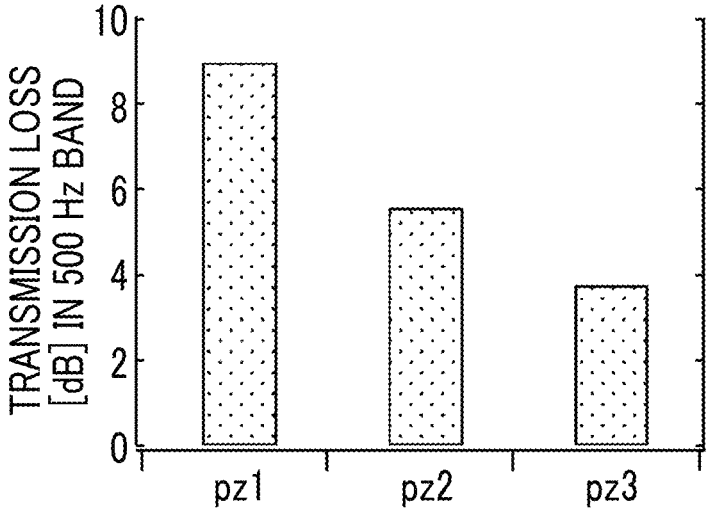
FIG. 52 is a graph showing a transmission loss in a 500 Hz band.

FIG. 52 is a graph showing a transmission loss in a 500 Hz band in a case where the sound-absorbing material is disposed in each of the regions pz1 to pz3.

Figure 53:
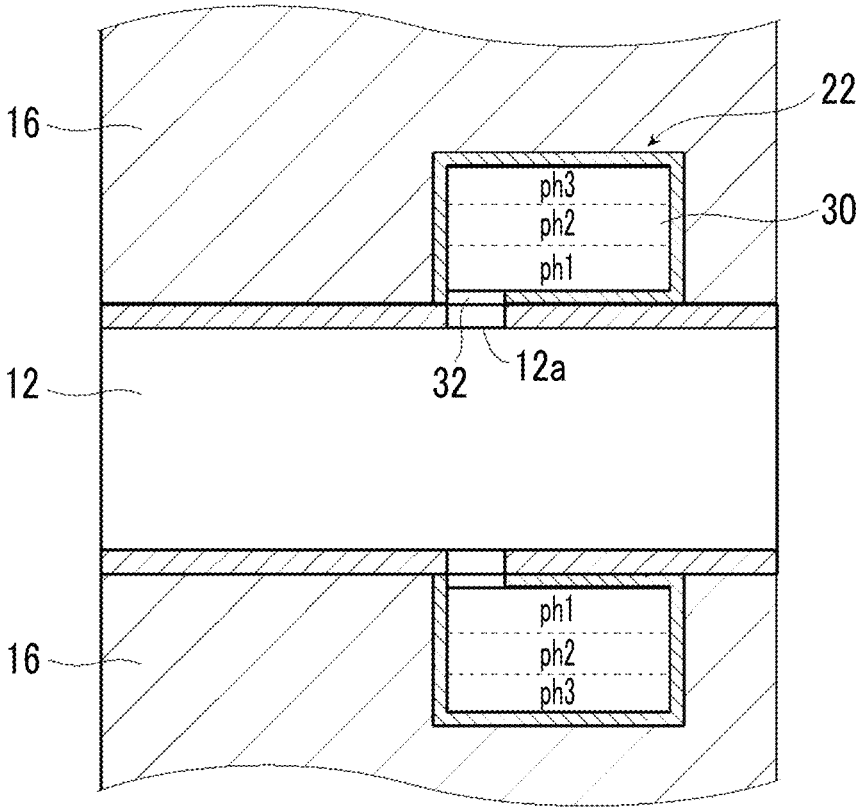
FIG. 53 is a schematic diagram illustrating a simulation model.

Further, a simulation is performed using a model where the inner region of the cavity portion 30 is divided into three regions in the radial direction as seen in a certain cross section parallel to the axial direction and a porous sound-absorbing material 24 having a flow resistance of 13000 [Pa·s/m$^2$] is disposed in each of the three divided regions ph1 to ph3 as shown in FIG. 53. ph1 denotes a region closest to the opening portion 32, and ph2 and ph3 denote regions farther from the opening portion 32 than the region ph1 in the radial direction.

Figure 54:
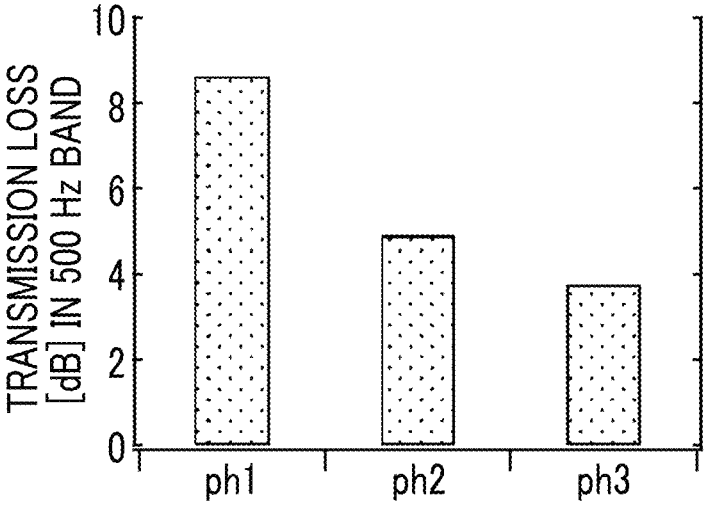
FIG. 54 is a graph showing a transmission loss in a 500 Hz band.

FIG. 54 is a graph showing a transmission loss in a 500 Hz band in a case where the sound-absorbing material is disposed in each of the regions ph1 to ph3.

As shown in FIGS. 52 and 54, it is found that a transmission loss in a 500 Hz band is higher and soundproof performance is higher as a region in which the sound-absorbing material is disposed is closer to the opening portion 32.

Furthermore, the silencer 22 may include second opening portions 38 that are formed at positions not connected to the sound field space of first resonance occurring in the tubular member 12 and communicate with the cavity portion 30.

Figure 55:
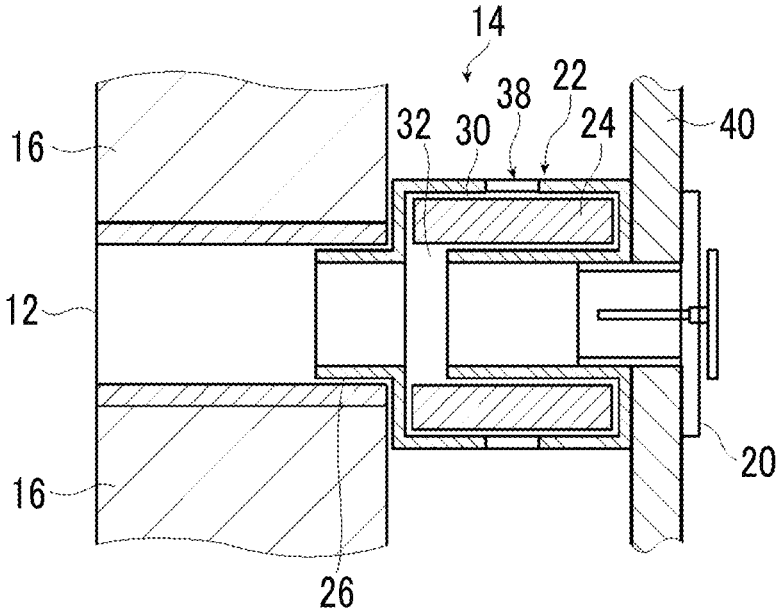
FIG. 55 is a cross-sectional view conceptually showing another example of the silencing system according to the first embodiment of the invention.

FIG. 55 is a cross-sectional view conceptually showing another example of the silencing system according to the embodiment of the invention.

In the silencing system shown in FIG. 55, surfaces facing the surfaces including opening portions 32 among wall surfaces, which form the cavity portion 30 of the silencer 22, include the second opening portions 38. Since the silencer 22 includes the second opening portions 38 that are formed at positions not connected to the sound field space of first resonance occurring in the tubular member 12 and communicate with the cavity portion 30, the real part of a standardized effective modulus of elasticity can be further reduced. Further, since the real part of a standardized effective modulus of elasticity can be further reduced without an increase in the volume of the cavity portion 30, the silencer can be reduced in size.

Positions where the second opening portions 38 are formed are not limited as long as the positions of the second opening portions 38 are not connected to the sound field space of first resonance occurring in the tubular member 12. Furthermore, the size of the second opening portion 38 is not limited, but it is preferable that the size of the second opening portion 38 is large.

Here, there is a concern that water or moisture may permeate into a wall or water or moisture may enter the cavity portion from the wall in the case of configuration where the second opening portions 38 are formed at positions not connected to the sound field space of first resonance occurring in the tubular member 12. Accordingly, each second opening portion 38 of the silencing system shown in FIG. 55 may be covered with a membrane member. The membrane member is a membrane member that allows acoustic waves to easily pass and does not allow water to pass; and a thin resin film, such as Saran Wrap (registered trademark), nonwoven fabric subjected to water-repellent treatment, and the like can be used as the membrane member. Accordingly, it is possible to prevent water or moisture from entering while maintaining the small real part of a standardized effective modulus of elasticity. The same material as the material of a windproof film 44 to be described later can be used as the material of the membrane member.

Figure 56:
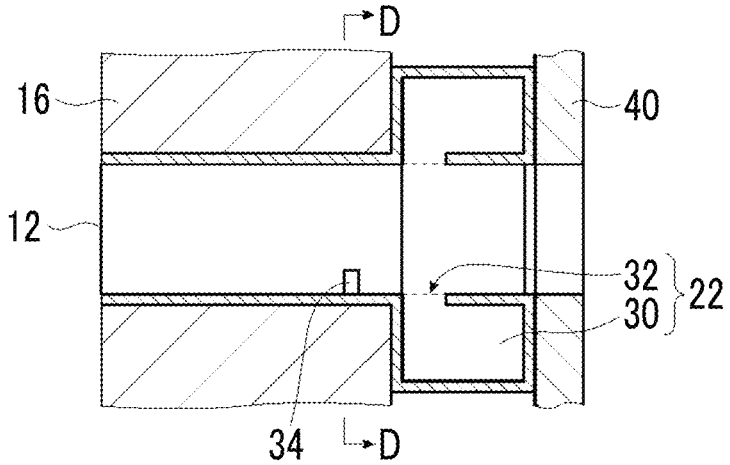
FIG. 56 is a cross-sectional view conceptually showing another example of the silencing system according to the first embodiment of the invention.
Figure 57:
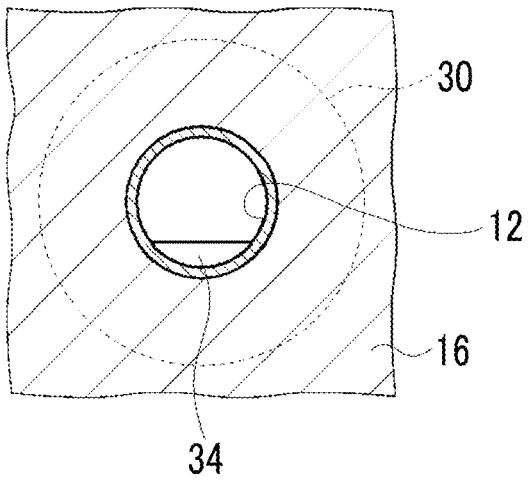
FIG. 57 is a cross-sectional view taken along line D-D of FIG. 56.

Further, an entering prevention plate 34 may be provided in the tubular member 12 as in an example shown in FIGS. 56 and 57.

FIG. 56 is a schematic cross-sectional view showing another example of the silencing system according to the embodiment of the invention. Further, FIG. 57 is a cross-sectional view taken along line D-D of FIG. 56.

As shown in FIGS. 56 and 57, the entering prevention plate 34 is a plate-like member that is provided at a lower portion in the tubular member 12 in a vertical direction so as to stand in the radial direction of the tubular member 12.

Since a ventilation sleeve (tubular member) installed in a wall of a house communicates with the outside, there is a case where rainwater enters the ventilation sleeve through an external louver, an external hood, or the like in the case of strong wind, such as a typhoon. Since the silencer including the cavity portion is connected to the ventilation sleeve in the silencing system according to the embodiment of the invention, there is a concern that rainwater having entered the ventilation sleeve may enter the cavity portion and may be accumulated.

In contrast, since the entering prevention plate 34 is provided in the tubular member 12 as shown in FIGS. 56 and 57, it is possible to prevent rainwater, which has entered the tubular member 12 from the outside, from entering the cavity portion 30 of the silencer 22.

It is preferable that the height of the entering prevention plate 34 in the vertical direction is in the range of 5 mm to 40 mm.

Figure 58:
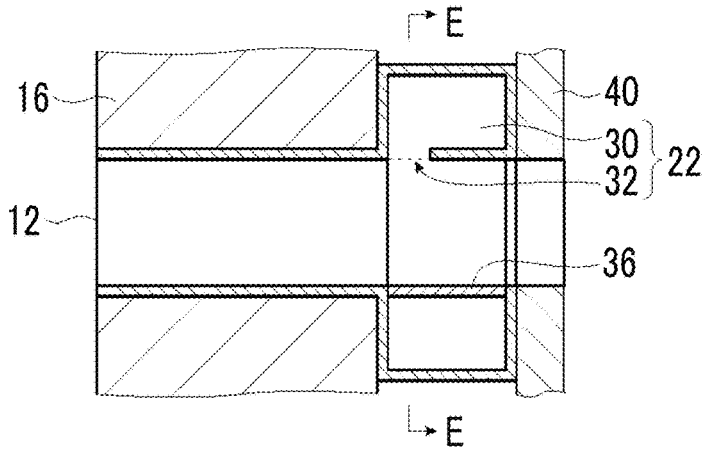
FIG. 58 is a cross-sectional view conceptually showing another example of the silencing system according to the first embodiment of the invention.
Figure 59:
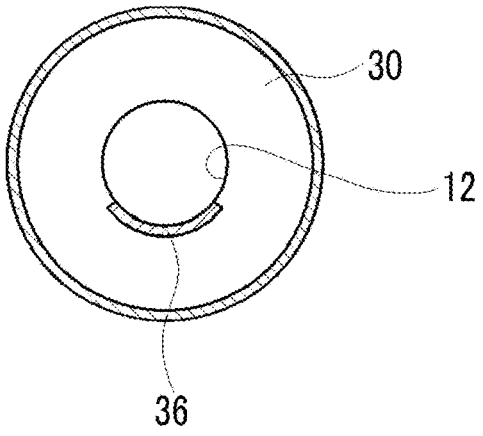
FIG. 59 is a cross-sectional view taken along line E-E of FIG. 58.

Further, configuration where a region below the opening portion 32 of the silencer 22 in the vertical direction is closed by a lid portion 36 as shown in FIGS. 58 and 59 may be used as configuration that prevents rainwater from entering the cavity portion 30 of the silencer 22.

FIG. 58 is a schematic cross-sectional view showing another example of the silencing system according to the embodiment of the invention. Further, FIG. 59 is a cross-sectional view taken along line E-E of FIG. 58.

Since the region below the opening portion 32 of the silencer 22 in the vertical direction is closed by the lid portion 36 as shown in FIGS. 58 and 59, it is possible to prevent rainwater, which has entered the tubular member 12 from the outside, from entering the cavity portion 30 of the silencer 22.

Figure 60:
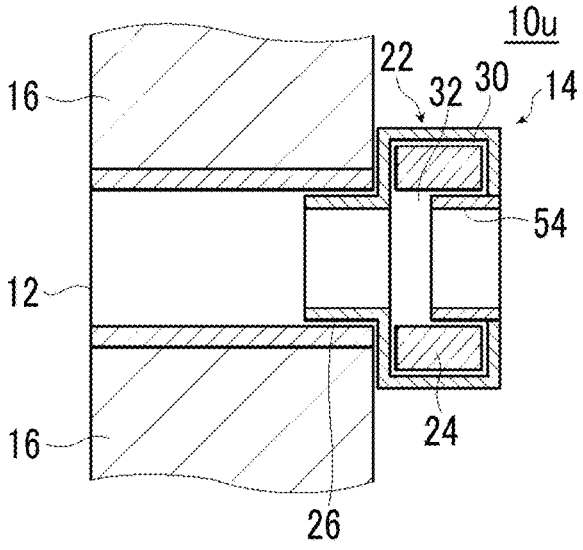
FIG. 60 is a cross-sectional view conceptually showing another example of the silencing system according to the first embodiment of the invention.

Furthermore, as shown in FIG. 60, a member forming the surface of the silencer 22 where the opening portion 32 is formed may be formed of a separate member (partition member 54) and the partition member 54 may be adapted to be replaceable. Since the size of the opening portion 32 can be easily changed in a case where the partition member 54 is adapted to be replaceable, the resonant frequency of the silencer 22 can be appropriately set. Further, the porous sound-absorbing material 24 installed in the cavity portion 30 can be easily replaced.

Examples of the materials of the silencer 22 and the silencing device 14 can include a metal material, a resin material, a reinforced plastic material, carbon fiber, and the like. Examples of the metal material can include metal materials, such as aluminum, titanium, magnesium, tungsten, iron, steel, chromium, chromium molybdenum, nichrome molybdenum, and alloys thereof. Further, examples of the resin material can include resin materials, such as an acrylic resin, poly(methyl methacrylate), polycarbonate, polyamide-imide, polyarylate, polyetherimide, polyacetal, polyetheretherketone, polyphenylene sulfide, polysulfone, polyethylene terephthalate, polybutylene terephthalate, polyimide, and triacetyl cellulose. Furthermore, examples of the reinforced plastic material can include carbon fiber reinforced plastics (CFRP) and glass fiber reinforced plastics (GFRP).

Here, in terms of the fact that the silencer 22 and the silencing device 14 can be used for an exhaust port and the like, it is preferable that the silencer 22 and the silencing device 14 are made of a material having heat resistance higher than the heat resistance of a flame retardant material. For example, heat resistance can be defined by time that satisfies the items of Article 108(2) of the Order for Enforcement of the Building Standards Act. A case where the time satisfying the items of Article 108(2) of the Order for Enforcement of the Building Standards Act is equal to or longer than 5 minutes and shorter than 10 minutes corresponds to a flame retardant material, a case where the time satisfying the items of Article 108(2) of the Order for Enforcement of the Building Standards Act is equal to or longer than 10 minutes and shorter than 20 minutes corresponds to a quasi-noncombustible material, and a case where the time satisfying the items of Article 108(2) of the Order for Enforcement of the Building Standards Act is equal to or longer than 20 minutes corresponds to a noncombustible material. However, there are many definitions of heat resistance in the respective fields. For this reason, depending on a field where the silencing system is used, the silencer 22 and the silencing device 14 may be made of a material having heat resistance that is equal to or higher than flame retardance defined in the field.

Figure 61:
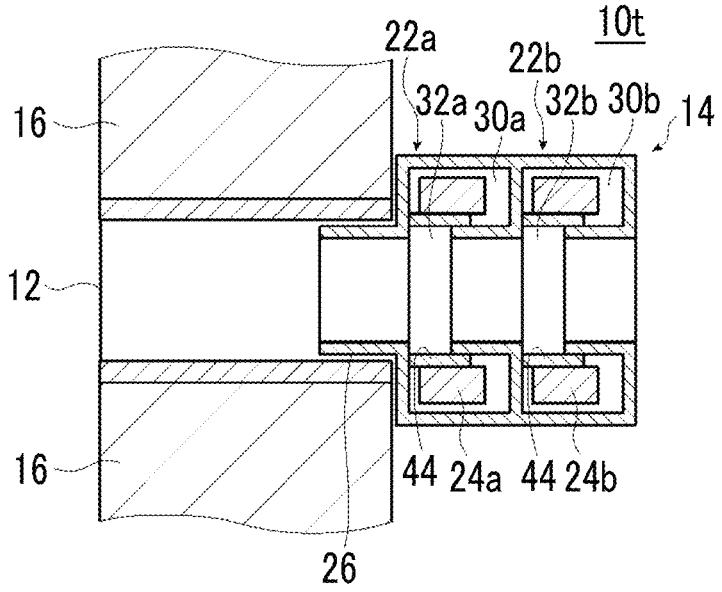
FIG. 61 is a cross-sectional view conceptually showing another example of the silencing system according to the first embodiment of the invention.

Further, it is preferable that an opening portion 32 of each silencer 22 is covered with a windproof film 44 transmitting acoustic waves and blocking air (wind) as in a silencing system 10*t* shown in FIG. 61.

A pressure loss of the entire silencing system in the case of configuration where air can flow into the cavity portion 30 of the silencer 22 is larger than that in the case of a straight tube. For this reason, there is a concern that the amount of ventilation air may be reduced. In contrast, in a case where the opening portion 32 of each silencer 22 is covered with the windproof film 44, the effect of silencing performed by the silencer 22 is obtained since the windproof film 44 transmits acoustic waves. Further, since the windproof film 44 blocks air, the flow of air into the cavity portion 30 is suppressed, so that a pressure loss can be reduced.

The windproof film 44 may be a non-ventilation film or may be a film of which the ventilation performance is low.

Resin materials, such as an acrylic resin, such as poly (methyl methacrylate) (PMMA), polyethylene terephthalate (PET), polycarbonate, polyamide-imide, polyarylate, polyetherimide, polyacetal, polyetheretherketone, polyphenylene sulfide, polysulfone, polybutylene terephthalate, polyimide, and triacetyl cellulose, can be used as the material of the non-ventilation windproof film 44.

A porous film made of the resin, porous metal foil (porous aluminum foil, and the like), nonwoven fabric (resin-bonded nonwoven fabric, thermal bonded nonwoven fabric, spunbond nonwoven fabric, spunlace nonwoven fabric, and nanofiber nonwoven fabric), woven fabric, paper, and the like can be used as the material of the windproof film 44 of which the ventilation performance is low.

In a case where a porous film, porous metal foil, nonwoven fabric, and woven fabric are used, a sound-absorbing effect can be obtained from through-hole portions of these. That is, these also function as a conversion mechanism for converting sound energy into thermal energy.

The thickness of the windproof film 44 also depends on a material, but is preferably in the range of 1 μm to 500 μm, more preferably in the range of 3 μm to 300 μm, and still more preferably in the range of 5 μm to 100 μm.

Further, the silencing system according to the embodiment of the invention may include another commercially available soundproof member.

For example, the silencing device 14 of the invention may be disposed at one end portion of a tubular member 12 and an insertion type silencer may be disposed in the tubular member 12.

Furthermore, the silencing device 14 of the invention is disposed at one end portion of a tubular member 12 and an outdoor installation type soundproof hood may be disposed at the other end portion of the tubular member 12.

Alternatively, the silencing device 14 of the invention is disposed at one end portion of a tubular member 12, the insertion type silencer is disposed in the tubular member 12, and the outdoor installation type soundproof hood may be disposed at the other end portion of the tubular member 12.

In this way, high soundproof performance is obtained in a wider band through a combination of other soundproof members.

This is the same in the other embodiments.

Various publicly known insertion type silencers can be used as the insertion type silencer. For example, a soundproof sleeve (SK-BO100 and the like) manufactured by Shinkyowa Co., Ltd., a soundproof sleeve (100NS2 and the like) manufactured by Daiken Plastics Corporation, a silencer for natural ventilation (SEIHO NPJ100 and the like) manufactured by Seiho Kogyo Co., Ltd., a silencer (UPS100SA and the like) manufactured by UNIX Co., Ltd., a silent sleeve P (HMS-K and the like) manufactured by Kenyu Co., Ltd., and the like can be used.

Various publicly known soundproof sleeves can be used as the outdoor installation type soundproof hood. For example, a soundproof hood (SSFW-A10M and the like) manufactured by UNIX Co., Ltd., a soundproof hood (BONTS and the like) manufactured by SYLPHA Corporation, and the like can be used.

Here, the tubular member 12 is not limited to a straight tubular member, and may be a member having bending structure. In a case where the tubular member 12 has bending structure, not only wind (the flow of air) but also acoustic waves are also reflected to the upstream side at a bent portion. For this reason, it is difficult for not only wind but also acoustic waves to pass through the tubular member 12. A case where a bent portion is formed of a curved surface and makes a change in the angle of a wall be moderate to ensure ventilation performance or a case where a distributing plate is provided at a bent portion and changes the traveling direction of wind to ensure ventilation performance is considered.

However, in a case where a bent portion is formed of a curved surface or a distributing plate is provided at a bent portion, ventilation performance is improved but acoustic wave transmittance is also increased.

Figure 62:
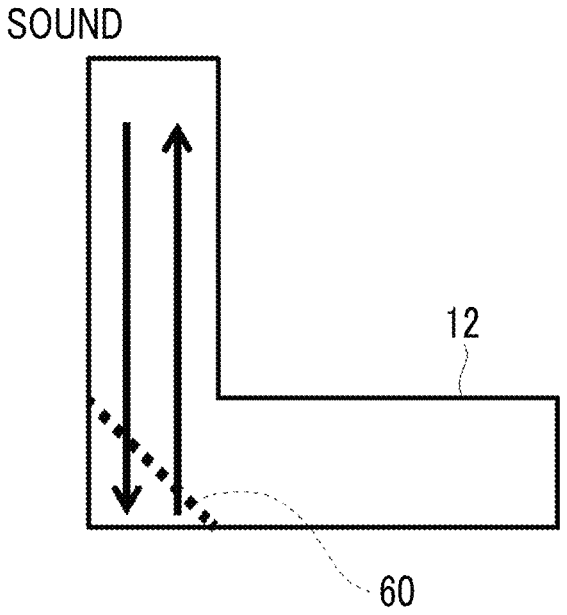
FIG. 62 is a cross-sectional view schematically showing a bent portion of a tubular member in which a sound transmission wall is disposed.
Figure 63:
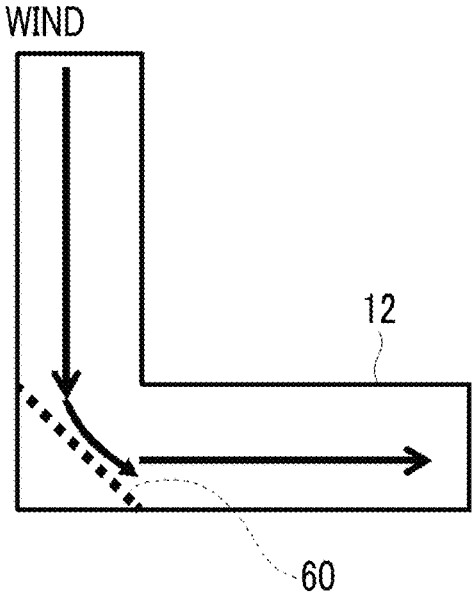
FIG. 63 is a cross-sectional view schematically showing the bent portion of the tubular member in which the sound transmission wall is disposed.

Accordingly, as shown in FIG. 62, a sound transmission wall 60, which does not allow wind to pass (makes it difficult for wind to pass) and transmits acoustic waves, is disposed at a bent portion of the tubular member 12. In FIG. 62, the tubular member 12 includes a bent portion that is bent at an angle of about 90°. The sound transmission wall 60 is disposed at the bent portion of the tubular member 12 so that the surface of the sound transmission wall 60 is inclined with respect to each of the longitudinal direction of the tubular member 12 on an incident side and the longitudinal direction of the tubular member 12 on an emission side by an angle of about 45°. In FIGS. 62 and 63, an upper side is the incident side and a right side is the emission side.

Since the sound transmission wall 60 transmits acoustic waves, acoustic waves incident from the upstream side are transmitted through the sound transmission wall 60 at the bent portion and are reflected to the upstream side by the wall of the tubular member 12 as shown in FIG. 62. That is, the characteristics of the original tubular member 12 are maintained. On the other hand, since the sound transmission wall 60 does not allow wind to pass, the traveling direction of wind entering from the upstream side is bent at the bent portion by the sound transmission wall 60 and the wind flows to the downstream side as shown in FIG. 63. In a case where the sound transmission wall 60 is disposed at the bent portion in this way, ventilation performance can be improved while low sound transmittance is maintained.

Nonwoven fabric having low density and a film having a small thickness and low density can be used as the sound transmission wall 60.

Examples of the nonwoven fabric having low density include a stainless steel fiber sheet (Tommyfilec SS) manufactured by Tomoegawa Paper Co., Ltd., usual tissue paper, and the like. Examples of the film having a small thickness and low density include various commercially available wrap films, a silicone rubber film, metal foil, and the like.

Second Embodiment

Figure 64:
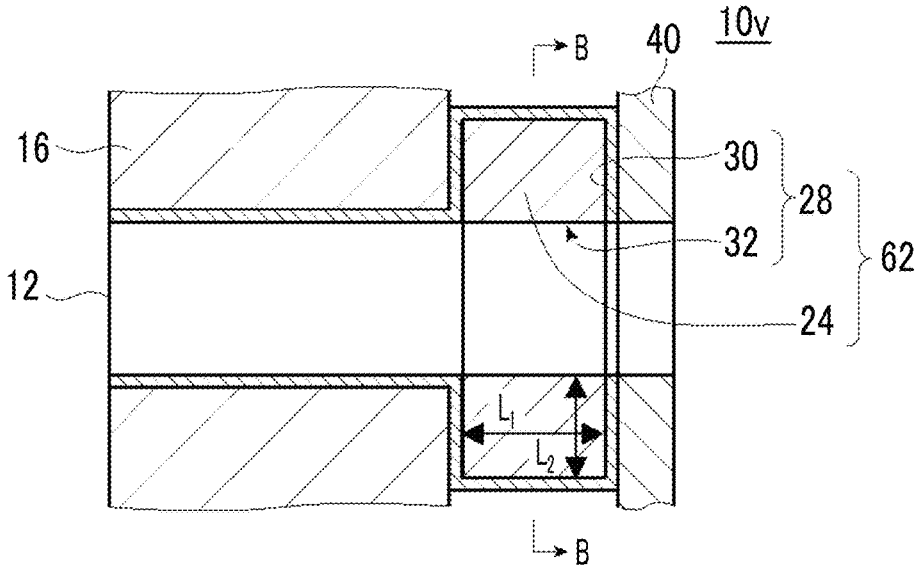
FIG. 64 is a cross-sectional view conceptually showing an example of a silencing system according to a second embodiment of the invention.

In order to make configuration where a standardized effective modulus Bn of elasticity satisfy "$0<Re[Bn]<1$" and "$Im[Bn]>0$", the silencer may have configuration shown in FIG. 64.

Figure 65:
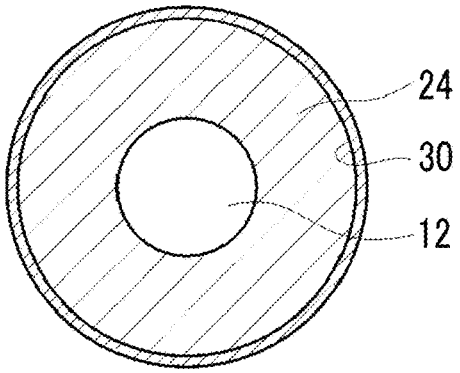
FIG. 65 is a cross-sectional view taken along line B-B of FIG. 64.

FIG. 64 is a schematic cross-sectional view showing an example of a silencing system according to a preferred second embodiment of the invention. FIG. 65 is a cross-sectional view taken along line B-B of FIG. 64.

As shown in FIG. 64, a silencing system 10*v* has configuration where a silencer 62 is disposed at the outer peripheral portion of a cylindrical ventilation sleeve 12 provided to penetrate a wall 16 separating two spaces.

In the example shown in FIG. 64, the silencing system 10*v* includes a wall 16, a decorative plate 40 that is spaced from the wall 16 by a predetermined distance and is provided in parallel to the wall 16, a ventilation sleeve 12 that penetrates the wall 16 and the decorative plate 40, and a silencer 62 that is disposed at the outer peripheral portion of the ventilation sleeve 12 in a space between the wall 16 and the decorative plate 40.

The ventilation sleeve 12, the wall 16, and the decorative plate 40 are the same as those of the first embodiment.

The silencer 62 includes a case part 28 that includes a cavity portion 30 and an opening portion 32 allowing the cavity portion 30 and the inside of the ventilation sleeve 12 to communicate with each other, and a porous sound-absorbing material 24 that is disposed in the cavity portion 30 of the case part 28.

As shown in FIGS. 64 and 65, the case part 28 includes the opening portion 32 and the cavity portion 30 over the entire outer peripheral portion of the ventilation sleeve 12 in a circumferential direction. That is, in the silencing system 10*v*, the case part 28 has a diameter larger than the diameter of the ventilation sleeve 12 at the position of the silencer 62 in the axial direction of the ventilation sleeve 12.

Since the opening portion 32 of the case part 28 communicates with the inside of the ventilation sleeve 12, the opening portion 32 is connected to a sound field space of first resonance occurring in the ventilation sleeve 12 of the silencing system 10*v*.

Here, the case part 28 (cavity portion 30) of the silencer 62 has a substantially annular shape along the entire outer peripheral surface of the ventilation sleeve 12 in the example shown in FIG. 65, but is not limited thereto. The case part 28 only has to have various three-dimensional shapes including a cavity portion. For example, the case part 28 may have a semi-ring shape or may have the shape of a rectangular parallelepiped.

The porous sound-absorbing material 24 is disposed over the entire inside of the cavity portion 30 of the case part 28. Accordingly, the porous sound-absorbing material 24 has an annular shape.

As well known, the porous sound-absorbing material is to absorb sound by converting the sound energy of sound, which passes therethrough, into thermal energy.

The porous sound-absorbing material 24 described in the first embodiment can be used as the porous sound-absorbing material 24.

The porous sound-absorbing material 24 is disposed over the entire inside of the cavity portion 30 of the case part 28 in the example shown in FIGS. 64 and 65, but is not limited thereto. The porous sound-absorbing material 24 may be disposed in at least a part of the cavity portion 30. Alternatively, the porous sound-absorbing material 24 may be disposed so as to cover at least a part of the opening portion 32 of the silencer 62.

Here, it is preferable that the silencing system according to the second embodiment also depends on the shapes and volumes of the silencer and the porous sound-absorbing material and the frequency of an acoustic wave as an object to be silenced but satisfies "$-1.0<\log(\alpha/\lambda)<0.3$" in a case where the frequency of an acoustic wave at which the first resonance of the ventilation sleeve occurs is denoted by $f_1$, the wavelength thereof is denoted by $\lambda$, and an effective sound propagation length in the silencer at the frequency $f_1$ is denoted by $\alpha$.

In the expressions, log is natural logarithm.

Further, an effective sound propagation length in the silencer at the frequency $f_1$ is an effective sound propagation length in a case where it is thought that sound having a frequency $f_1$ is propagated in the cavity portion in a state where a porous sound-absorbing material is disposed.

An effective sound propagation length $\alpha_0$ in the porous sound-absorbing material is obtained from "$\alpha_0=1/\mathrm{Re}[\gamma]$".

Here, $\gamma$ denotes a propagation constant. Further, $\mathrm{Re}[\gamma]$ means the real part of the propagation constant.

The propagation constant of an acoustic material can be obtained from measurement that is performed by a transfer function method using an acoustic tube and two microphones. This method complies with the standards of JIS A1405-2, ISO 10534-2, and ASTM E 1050.

For example, an acoustic tube of which the measurement principle is the same as that of WinZac manufactured by Nittobo Acoustic Engineering Co., Ltd. can be used as the acoustic tube. A propagation constant in a wide spectral range can be measured by this method.

An effective sound propagation length $\alpha$ in the silencer coincides with the effective sound propagation length $\alpha_0$ of the porous sound-absorbing material in a case where the cavity portion of the case part is filled with the porous sound-absorbing material. Further, in a case where a part of the cavity portion of the case part is filled with the porous sound-absorbing material, the sum of the effective sound propagation length $\alpha_0$ of the porous sound-absorbing material and the length of a space in which the porous sound-absorbing material is not disposed is the effective sound propagation length $\alpha$ in the silencer. Configuration where the entire cavity portion of the case part is basically filled with the porous sound-absorbing material will be described in the following description. Accordingly, there is a case where the effective sound propagation length $\alpha_0$ of the porous sound-absorbing material and the effective sound propagation length $\alpha$ in the silencer are described without being distinguished from each other.

In the silencing system according to the second embodiment, the silencer includes the case part that includes the cavity portion formed at the outer peripheral portion of the ventilation sleeve and the opening portion allowing the cavity portion and the ventilation sleeve to communicate with each other, and the porous sound-absorbing material that is disposed in at least a part of the cavity portion of the case part or at a position where the porous sound-absorbing material covers at least a part of the opening portion of the case part; the opening portion of the silencer is connected to the sound field space of the ventilation sleeve in the silencing system; and the silencing system according to the second embodiment has configuration satisfying "$-1.0<\log(\alpha/\lambda)<0.3$" in a case where the frequency of an acoustic wave at which the first resonance of the ventilation sleeve occurs is denoted by $f_1$, the wavelength thereof is denoted by $\lambda$, and an effective sound propagation length in the silencer at the frequency $f_1$ is denoted by $\alpha$. According to this configuration, the real part and the imaginary part of a standardized effective modulus Bn of elasticity of an octave band in which first resonance is present can satisfy "$0<\mathrm{Re}[Bn]<1$" and "$\mathrm{Im}[Bn]>0$".

Accordingly, high soundproof performance and high ventilation performance can be achieved.

Further, since the principle of this silencing does not use the resonance of the silencer, the dependence of soundproof performance on a wavelength is low, soundproof performance can be achieved even in a case where the length, the shape, and the like of the ventilation sleeve 12 vary, and general-purpose properties are high since the silencer does not need to be designed according to the ventilation sleeve 12.

Furthermore, since the principle of this silencing does not use resonance, wind noise is not amplified.

In terms of soundproof performance, $\log(\alpha/\lambda)$ also depends on the shapes or volumes of the silencer and the porous sound-absorbing material or the frequency of an acoustic wave as an object to be silenced, but "$-0.7 \leq \log(\alpha/\lambda) \leq 0.25$" is preferable, "$-0.4 \leq \log(\alpha/\lambda) \leq 0.2$" is more preferable, and "$-0.2 < \log(aa) < 0.15$" is still more preferable.

The flow resistance $\sigma_l$ [Pa·s/m$^2$] per unit thickness of the porous sound-absorbing material 24 also depends on the shapes or volumes of the silencer and the porous sound-absorbing material or the frequency of an acoustic wave as an object to be silenced, but preferably satisfies "$3 < \log(\sigma_1) < 4.6$", more preferably satisfies "$3.1 < \log(\sigma_1) < 4.5$", and still more preferably satisfies "$3.3 < \log(\sigma_1) < 4.3$".

Here, in terms of soundproof performance, it is preferable that the width $L_1$ of the cavity portion 30 of the case part 28 of the silencer 62 in the axial direction of the ventilation sleeve satisfies "$0.02 \times \lambda \leq L_1 \leq 0.15 \times \lambda$,". Further, it is preferable that the depth $L_2$ of the cavity portion 30 in the radial direction of the ventilation sleeve satisfies "$0.03 \times \lambda \leq L_2 \leq 0.12 \times \lambda$.".

In a case where the depth of the cavity portion 30 varies depending on a position, the depth $L_2$ of the cavity portion 30 is an average value of depths obtained at the respective positions.

Further, in a case where the width of the opening portion 32 varies depending on a position, the width $L_1$ of the opening portion 32 is an average value of widths obtained at the respective positions.

The width $L_1$ and the depth $L_2$ may be measured with a resolution of 1 mm. That is, in a case where the cavity portion has fine structures, such as unevenness smaller than 1 mm, the width $L_1$ and the depth $L_2$ may be obtained through the averaging of the fine structures.

In terms of obtaining sufficient soundproof performance of 3 dB or more in a 500 Hz band, it is preferable that the width $L_1$ and the depth $L_2$ of the cavity portion are set in the same ranges as those of the second embodiment.

Here, the silencer 62 is adapted in the example shown in FIG. 64 so that the length of the opening portion 32 in the axial direction (hereinafter, referred to as the width of the opening portion) is equal to the width $L_1$ of the cavity portion 30, but is not limited thereto. The width of the opening portion 32 may be smaller than the width $L_2$ of the cavity portion.

Further, the silencing system is adapted to include one silencer 62 in the example shown in FIG. 64, but is not limited thereto. The silencing system may be adapted so that two or more silencers 62 are arranged in the axial direction of the ventilation sleeve 12. In other words, the opening portions 32 of a plurality of silencers 62 may be arranged at least two or more positions in the axial direction of the ventilation sleeve 12.

Furthermore, in a case where a plurality of silencers are arranged in the axial direction, the dimensions of the opening portions, the cavity portions, and the like of the respective silencers may be different from each other.

Further, in a case where a plurality of silencers are arranged in the axial direction, porous sound-absorbing materials having different acoustic characteristics may be disposed in the cavity portions of the respective silencers.

Furthermore, a plurality of sound-absorbing materials may be disposed in one cavity portion.

Further, as in the first embodiment, the opening portion of the silencer may be covered with a windproof film that transmits acoustic waves and blocks air (wind).

Furthermore, the silencer is formed integrally with the ventilation sleeve in the example shown in FIG. 64, but is not limited thereto. The silencer may be formed of a member separate from the ventilation sleeve.

In a case where the silencer is formed of a member separate from the ventilation sleeve, the silencer may be fixed to an end face of the ventilation sleeve (wall) with a publicly known fixing method, such as an adhesive. In this case, it is preferable that the silencer is attachably and detachably installed on the ventilation sleeve. Accordingly, the replacement, reform, or the like of the silencer can be easily performed.

Further, the silencer may be installed on either the interior-side end face or the exterior-side end face of the ventilation sleeve (wall) as in the first embodiment, but it is preferable that the silencer is installed on the interior-side end face, that is, between the concrete wall and the decorative plate. Furthermore, the silencer may be adapted to be separable.

Further, an entering prevention plate may be provided in the ventilation sleeve as in the first embodiment. Alternatively, a lid portion 36 may be provided.

Furthermore, as in the first embodiment, a member forming the surface of the silencer 62 facing the opening portion 32 may be formed of a separate member (partition member) and the partition member may be adapted to be replaceable.

EXAMPLES

The invention will be described in more detail below on the basis of Examples. Materials, the amounts of used materials, ratios of the materials, the contents of treatment, the procedure of treatment, and the like described in the following examples can be appropriately changed without departing from the scope of the invention. Accordingly, the scope of the invention should not be interpreted in a limited way by examples to be described below.

Example 1

Figure 66:
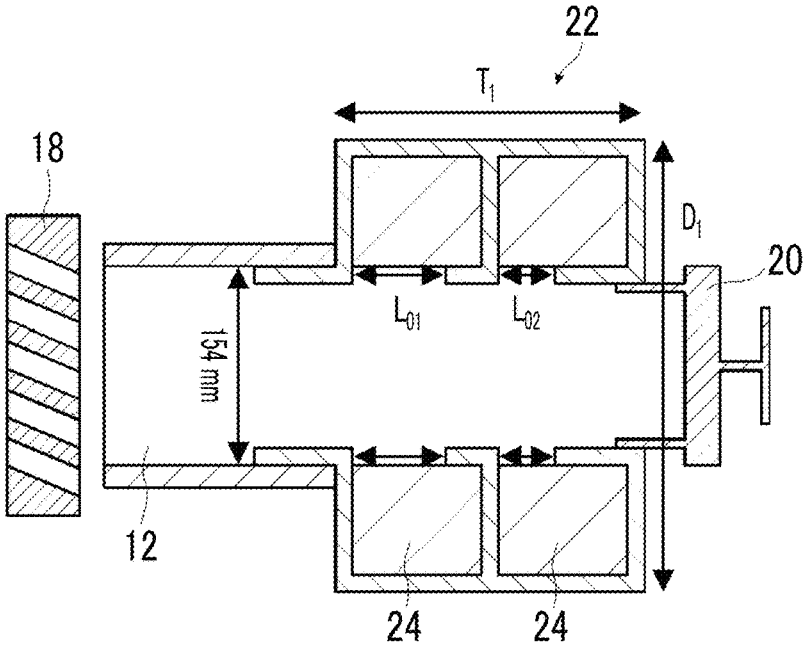
FIG. 66 is a diagram conceptually showing a simulation model.

Next, a simulation was performed about configuration where silencers 22 were disposed on the outer peripheral surface of a tubular member 12 (configuration of the first embodiment) as shown in FIG. 66 as Example 1.

The silencer 22 is an L-shaped silencer, has an annular shape along the entire outer peripheral surface of the tubular member 12 in a peripheral direction, and has a shape where an opening portion 32 is formed in the shape of a slit extending in the peripheral direction. Further, two silencers 22 (opening portions and cavity portions) were provided in the axial direction. Furthermore, a porous sound-absorbing material 24 was disposed in each of the cavity portions of the two silencers 22.

Further, a louver (cover member) was disposed on the open surface of the tubular member 12 opposite to a side where the silencer 22 is installed, and a register (air volume-adjusting member) was disposed on the surface of the silencer 22 opposite to the tubular member 12.

The inner diameter of the tubular member 12 was set to 154 mm, the total length Ti of the two silencers 22 in the axial direction was set to 90 mm, the outer diameter of the silencer was set to 267 mm, and the frame thickness of the silencer was set to 2 mm. The width of each cavity portion in the axial direction was set to 42 mm and the depth thereof was set to 56.5 mm. Further, the width $L_{01}$ of one opening portion in the axial direction was set to 27 mm and the width $L_{02}$ of the other opening portion in the axial direction was set to 10 mm.

Furthermore, the entire cavity portion 30 was filled with the porous sound-absorbing material 24. The flow resistance of the porous sound-absorbing material 24 was set to 7000 [Pa·s/m$^2$]. As long as not particularly described even in the following examples, a simulation was performed in a state where the entire cavity portion 30 was filled with the porous sound-absorbing material 24 and the flow resistance of the porous sound-absorbing material 24 is set to 7000 [Pa·s/m$^2$].

A transmission loss was obtained through a simulation. Further, a reflection coefficient R and a transmission coefficient $T_0$ were obtained, and a standardized effective modulus Bn of elasticity in a corresponding region $RA_0$ (see FIG. 67) was obtained from Equations (3) to (5) having been described above. Since the first resonant frequency of the tubular member 12 was in a 250 Hz-octave band (170 Hz to 354 Hz) in this example, a standardized effective modulus Bn of elasticity in the 250 Hz-octave band was obtained.

Examples 2 and 3 and Comparative Example 2

Transmission losses and standardized effective moduli Bn of elasticity were obtained in the same manner as Example 1 except that the outer diameters of the silencers 22 were set to 250 mm, 230 mm, and 210 mm.

In Example 2, the depth of a cavity portion is 46 mm. In Example 3, the depth of a cavity portion is 36 mm. In Comparative Example 2, the depth of a cavity portion is 26 mm.

Figure 68:
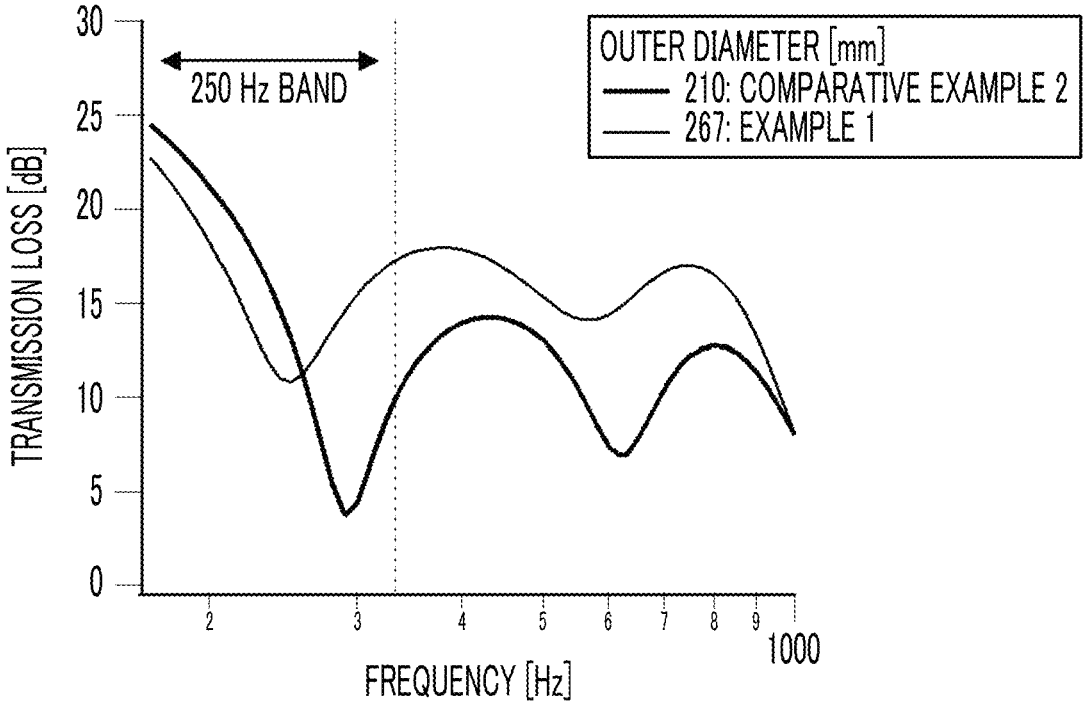
FIG. 68 is a graph showing relationships between frequencies and transmission losses.
Figure 69:
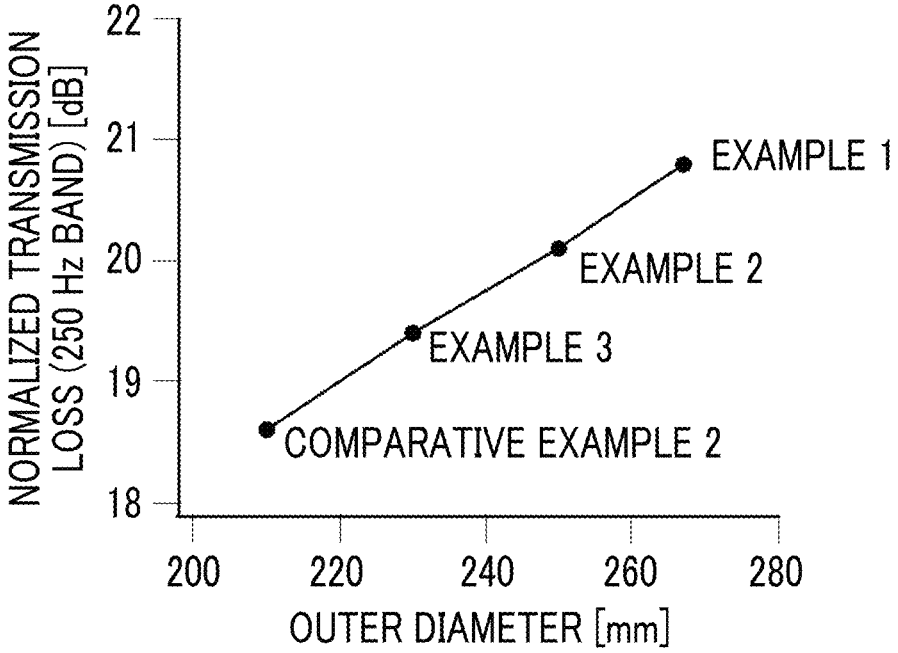
FIG. 69 is a graph showing a relationship between an outer diameter and a normalized transmission loss.
Figure 70:
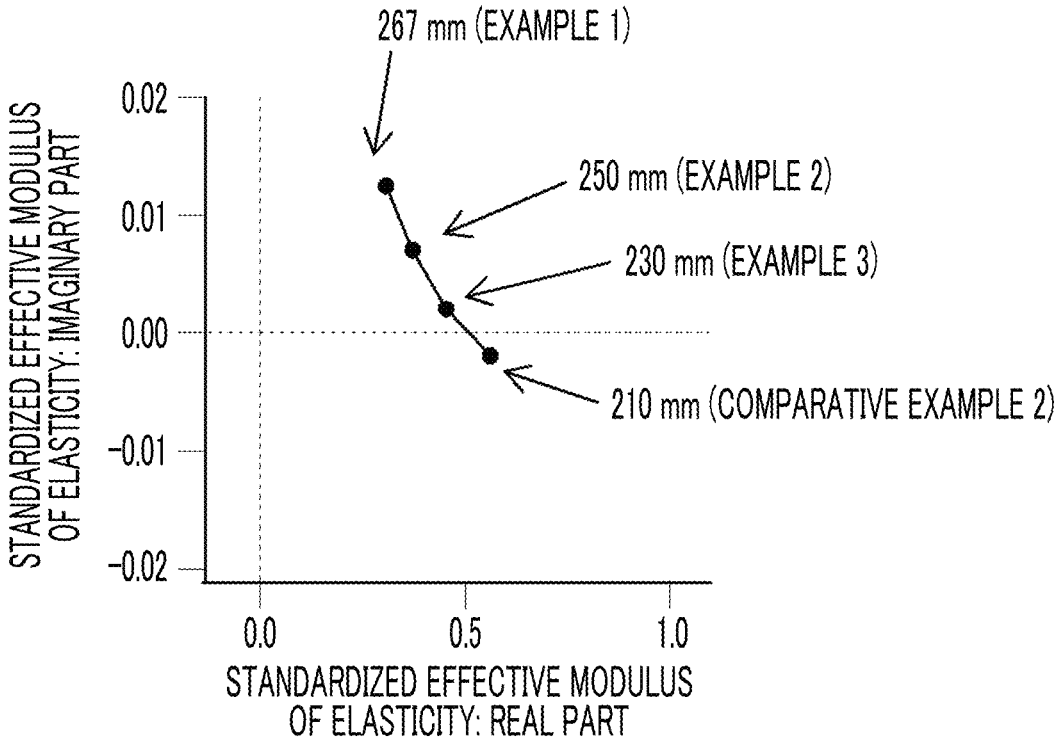
FIG. 70 is a graph in which the real parts and the imaginary parts of standardized effective moduli of elasticity are plotted.

FIG. 68 shows a graph showing relationships between frequencies and transmission losses of Example 1 and Comparative Example 2. FIG. 69 shows a graph showing a relationship between an outer diameter and a normalized transmission loss obtained from experiments in a case where silencers of the respective Examples and Comparative Example are produced. FIG. 70 shows a graph in which the real parts and the imaginary parts of standardized effective moduli of elasticity of the respective Examples and Comparative Example are plotted.

It is found from FIG. 70 that the real parts and the imaginary parts of standardized effective moduli of elasticity of Examples 1 to 3 satisfy "0<Re[Bn]<1" and "Im[Bn]>0" and are in the range of the invention. On the other hand, it is found that the imaginary part of a standardized effective modulus of elasticity of Comparative Example 2 is 0 or less and is out of the range of the invention.

It is found from FIG. 68 that a transmission loss is low near the first resonant frequency of the tubular member in Comparative Example 2. In contrast, it is found that a transmission loss is high even near the first resonant frequency of the tubular member and high soundproof performance is obtained in Example 1.

Further, it is found from FIG. 69 that a transmission loss in each of Examples 1 to 3 is higher than that in Comparative Example.

Furthermore, since the silencing systems of Examples 1 to 3 have configuration where silencers are disposed on the outer peripheral portion of the tubular member, it is clear that ventilation performance is equal to or higher than that in a case where silencers are not provided.

Next, only wind was generated through the setting of pressure without the generation of sound from a speaker sound source to examine whether or not wind noise is generated in the tubular member. Since a ventilation flue is narrowed in a case where a silencer is disposed in the tubular member, wind noise is likely to be generated.

Comparative Example 3

Figure 71:
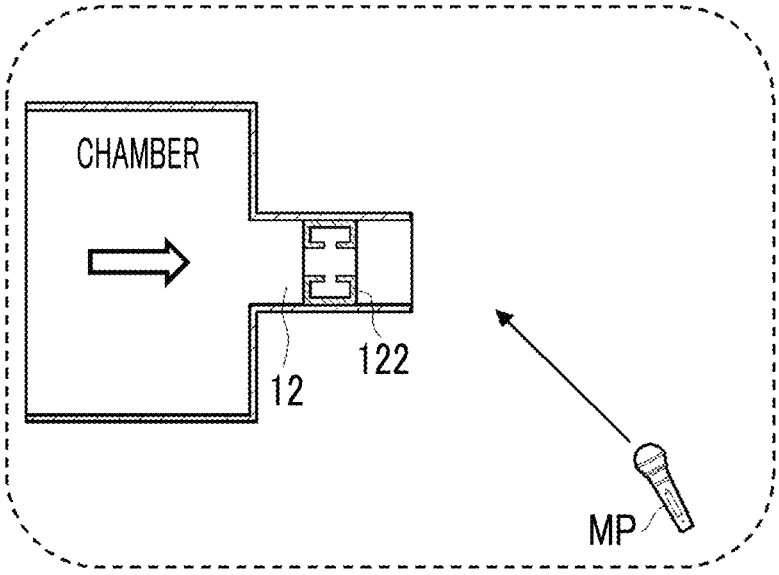
FIG. 71 is a diagram conceptually showing the configuration of Comparative Example.

As shown in FIG. 71, an insertion type silencer (a silencer UPS150SA manufactured by UNIX Co., Ltd.) was installed in a tubular member 12 of which one opening portion was connected to a chamber and gauge pressure in the chamber was set to 30 Pa to generate wind blowing toward the tubular member 12. A microphone MP was installed at a position that was spaced from the open surface of the tubular member 12 by a distance of 50 cm at an angle of 45° with respect to the open surface of the tubular member 12, sound pressure was measured, and a difference between the measured sound pressure and sound pressure, which is obtained in a case where a silencer was not disposed, (a difference in sound pressure) was measured.

A tube made of vinyl chloride and having an inner diameter of 15 cm and a length 20 cm, was used as the tubular member.

Further, the diameter of the opening of the insertion type silencer is 8.2 cm and a ratio of the opening to the opening area of the tubular member 12 is about 30%.

Example 4

Figure 72:
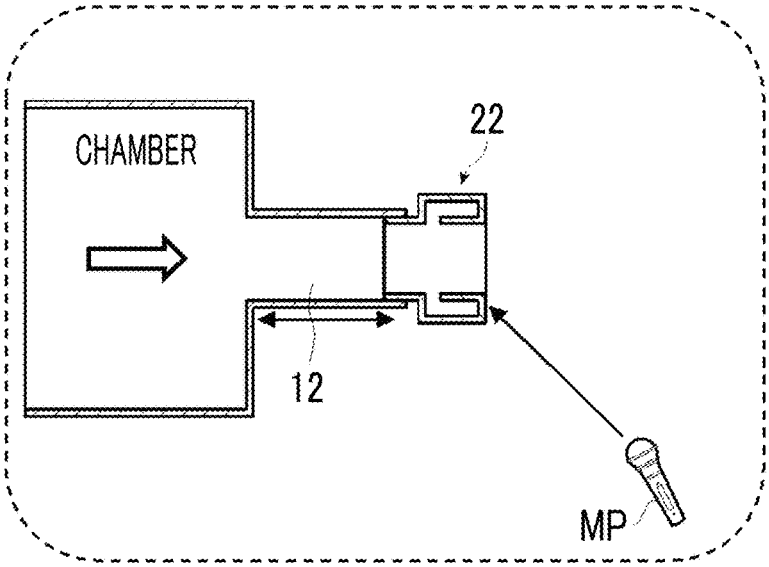
FIG. 72 is a diagram conceptually showing the configuration of Example.

Sound pressure was measured in the same manner as Comparative Example 3 except that a silencer was installed on the end face of the tubular member 12 connected to the chamber as shown in FIG. 72, and a difference between the measured sound pressure and sound pressure, which is obtained in a case where a silencer was not disposed, (a difference in sound pressure) was measured.

The configuration of the silencer is the same as that of Example 1.

Further, the diameter of the opening of the silencer is 15 cm and a ratio of the opening to the opening area of the tubular member 12 is about 100%.

Figure 73:
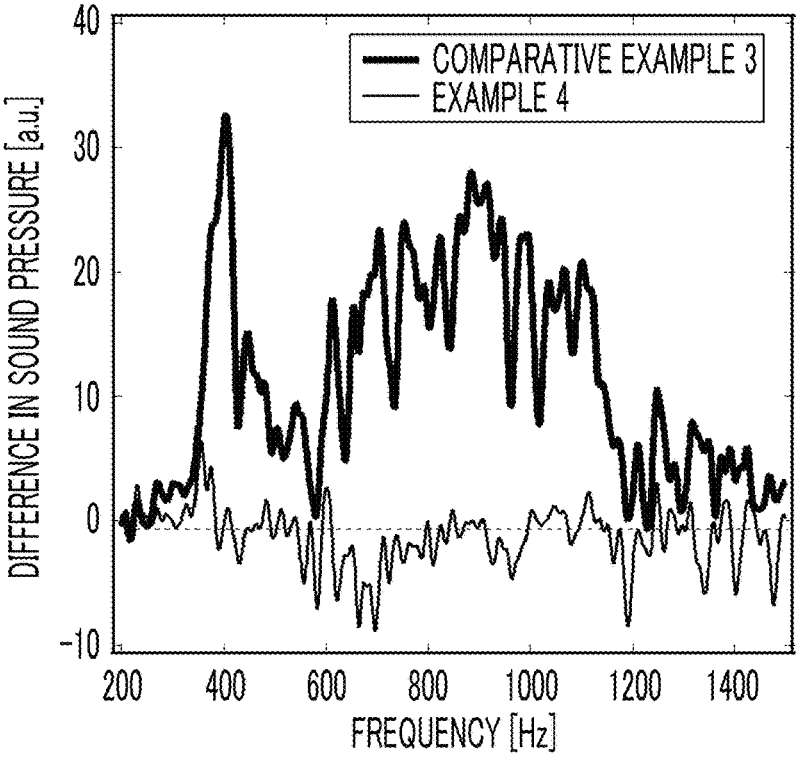
FIG. 73 is a graph showing a relationship between a frequency and a difference in sound pressure.

Results are shown in FIG. 73.

It is found from FIG. 73 that wind noise is generated since wind passes through the tubular member in Comparative Example 3. In FIG. 73, a peak near 400 Hz is caused by the resonance of the tubular member. Further, peaks in the range of 600 Hz to 1200 Hz are by the resonance of the silencer. Since the opening area of the tubular member is narrowed in a case where a silencer is disposed in the tubular member as in Comparative Example 3, wind noise is likely to be generated. Furthermore, in a case where a resonance body is present close to the silencing system, wind noise is amplified. Moreover, it is found that there is a problem that wind noise generated in the tubular member causes noise to be generated on both the exterior and the interior.

In contrast, it is found that the generation of wind noise is suppressed since a difference in sound pressure is small even near 400 Hz that is the first resonant frequency of the tubular member and a difference in sound pressure is small even in other frequency bands in Example 4.

The effects of the invention are clear from the above-mentioned results.

EXPLANATION OF REFERENCES

10*a* to 10*w*: silencing system
12: tubular member
14: silencing device
16: wall
18: cover member
20: air volume-adjusting member
21, 22, 22*a*, 22*b*, 23, 60, 62: silencer
24, 24*a* to 24*e*: porous sound-absorbing material
26: insertion part
28: case part
30, 30*a*, 30*b*: cavity portion
32, 32*a*, 32*b*: opening portion
34: entering prevention plate
36: lid portion
38: second opening portion
40: decorative plate
42: boundary cover
44: windproof film
46: membrane member
54: partition member
60: sound transmission wall

What is claimed is:

1. A silencing system comprising:

one or more silencers that are disposed in a tubular member provided to penetrate a wall separating two spaces, wherein the silencer does not have a structure resonating at a first resonant frequency of the tubular member, "0<Re[Bn]<1" and "Im[Bn]>0" are satisfied in a case where a standardized effective modulus of elasticity in an interior space of the tubular member in which the silencers are disposed is denoted by Bn, the standardized effective modulus Bn of elasticity is an average value in an octave band in which a first resonant frequency of the tubular member is present, and a frequency $F_0$ of first resonance occurring in the tubular member and a resonant frequency $F_1$ of the silencer satisfy "$1.15 \times F_0 < F_1$".

2. The silencing system according to claim 1, wherein the tubular member is a ventilation sleeve, and the silencer is disposed at an end portion of the ventilation sleeve between the wall and a decorative plate that is disposed so as to be spaced from the wall.

3. The silencing system according to claim 1, wherein the silencer includes a conversion mechanism for converting sound energy into thermal energy.

4. The silencing system according to claim 3, wherein the conversion mechanism is a porous sound-absorbing material.

5. The silencing system according to claim 1, wherein a cross-sectional area at a position where the silencer is disposed is larger than a cross-sectional area of the tubular member alone in a cross section perpendicular to a central axis of the tubular member.

6. The silencing system according to claim 1, wherein the silencer includes a cavity portion that communicates with the interior space of the tubular member, and a total volume of the interior space of the tubular member and the cavity portion of the silencer is larger than a volume of an interior space of the tubular member alone.

7. The silencing system according to claim 6, wherein a total volume of the interior space of the tubular member is 18000 $cm^3$ or less.

8. The silencing system according to claim 1, wherein a shortest distance between one space side and the other space side in the ventilation sleeve in which the silencer is disposed is 1.9 times or less a thickness of the wall.

9. The silencing system according to claim 1, wherein a cross section of the tubular member parallel to the wall is 900 $cm^2$ or less.

10. The silencing system according to claim 1, wherein at least a part of a ventilation flue, which is a space capable of being ventilated in the ventilation sleeve in which the silencer is disposed, is positioned on a straight line in a plane direction of a cross section perpendicular to a central axis of the ventilation sleeve.

11. The silencing system according to claim 1, wherein the tubular member is a ventilation sleeve, and the silencer is disposed at an end portion of the ventilation sleeve between the wall and a decorative plate that is disposed so as to be spaced from the wall.

12. The silencing system according to claim 1, wherein the silencer includes a conversion mechanism for converting sound energy into thermal energy.

13. The silencing system according to claim 12, wherein the conversion mechanism is a porous sound-absorbing material.

14. The silencing system according to claim 1, wherein a cross-sectional area at a position where the silencer is disposed is larger than a cross-sectional area of the tubular member alone in a cross section perpendicular to a central axis of the tubular member.

15. The silencing system according to claim 1, wherein the silencer includes a cavity portion that communicates with the interior space of the tubular member, and a total volume of the interior space of the tubular member and the cavity portion of the silencer is larger than a volume of an interior space of the tubular member alone.

16. The silencing system according to claim 15, wherein a total volume of the interior space of the tubular member is 18000 $cm^3$ or less.

17. The silencing system according to claim 1, wherein a shortest distance between one space side and the other space side in the ventilation sleeve in which the silencer is disposed is 1.9 times or less a thickness of the wall.

18. The silencing system according to claim 1, wherein a cross section of the tubular member parallel to the wall is 900 $cm^2$ or less.

19. The silencing system according to claim 1, wherein at least a part of a ventilation flue, which is a space capable of being ventilated in the ventilation sleeve in which the silencer is disposed, is positioned on a straight line in a plane direction of a cross section perpendicular to a central axis of the ventilation sleeve.

* * * * *